US007392004B2

(12) United States Patent
Sato et al.

(10) Patent No.: US 7,392,004 B2
(45) Date of Patent: Jun. 24, 2008

(54) IMAGE FORMING APPARATUS AND SYSTEM WITH FIXING UNIT THAT CHANGES INTENSITY OF PRESS-CONTACT FORCE BETWEEN ROLLERS

(75) Inventors: Makoto Sato, Nagano-ken (JP); Yoshikazu Makiuchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 11/295,737

(22) Filed: Dec. 6, 2005

(65) Prior Publication Data

US 2006/0147226 A1 Jul. 6, 2006

(30) Foreign Application Priority Data

Dec. 7, 2004 (JP) ..... 2004-354669
Dec. 7, 2004 (JP) ..... 2004-354670
Dec. 7, 2004 (JP) ..... 2004-354671
Dec. 7, 2004 (JP) ..... 2004-354672

(51) Int. Cl.
*G03G 15/20* (2006.01)

(52) U.S. Cl. ..... 399/328; 219/216; 399/45; 399/341

(58) Field of Classification Search ..... 399/67, 399/122, 124, 126, 45, 320, 328, 329, 341; 347/156; 219/216
See application file for complete search history.

(56) References Cited

U.S. PATENT DOCUMENTS 5,708,926 A * 1/1998 Sagara et al. ..... 399/122
5,956,547 A * 9/1999 Kamei et al. ..... 399/122
6,253,046 B1 * 6/2001 Horrall et al. ..... 399/124
6,580,894 B1 * 6/2003 Kobashigawa ..... 399/329
6,631,252 B2 * 10/2003 Ando et al. ..... 399/328
6,865,364 B2 * 3/2005 Matsumoto ..... 399/329
6,950,619 B2 9/2005 Sunohara (Continued)

FOREIGN PATENT DOCUMENTS

JP 08-006426 1/1996

(Continued)

OTHER PUBLICATIONS

European Search Report for corresponding European application No. 05026711.1-2209 lists the references above.

*Primary Examiner*—Sophia S Chen
(74) *Attorney, Agent, or Firm*—Hogan & Hartson LLP

(57) ABSTRACT

An image forming apparatus includes (a) an openable and closable cover, (b) a fixing unit, and (c) a press-contact releasing member. The fixing unit has a first roller, a second roller that can be pressed in contact against the first roller, and a retaining member adapted to retain a state in which the press-contact of the second roller against the first roller has been released by the press-contact releasing member. The fixing unit is attachable/detachable to/from a body of the image forming apparatus. The fixing unit is adapted to fix a developer image, which is formed on a medium that is pinched between the first roller and the second roller being pressed in contact against the first roller via the medium, onto that medium in a state where the cover is closed. The press-contact releasing member is adapted to release the press-contact of the second roller against the first roller in conjunction with an opening movement of the cover.

11 Claims, 25 Drawing Sheets

U.S. PATENT DOCUMENTS

| | | | | |
|---|---|---|---|---|
| 6,983,119 | B2 * | 1/2006 | Nakayama | 399/341 |
| 7,039,332 | B2 * | 5/2006 | Suzuki | 399/45 |
| 2004/0234290 | A1 * | 11/2004 | Tomatsu | 399/67 |
| 2005/0141932 | A1 * | 6/2005 | Sugiyama | 399/328 |
| 2005/0191071 | A1 * | 9/2005 | Katayanagi et al. | 399/45 |

FOREIGN PATENT DOCUMENTS

| | | | | |
|---|---|---|---|---|
| JP | 10123877 | A | | 5/1998 |
| JP | 10-177314 | A | * | 6/1998 |
| JP | 10-250874 | A | * | 9/1998 |
| JP | 11-065348 | | | 3/1999 |
| JP | 2000338815 | A | | 12/2000 |
| JP | 2003186340 | A | | 7/2003 |
| JP | 2003287973 | A | | 10/2003 |

* cited by examiner

IMAGE FORMING APPARATUS AND SYSTEM WITH FIXING UNIT THAT CHANGES INTENSITY OF PRESS-CONTACT FORCE BETWEEN ROLLERS

CROSS-REFERENCE TO RELATED APPLICATIONS

The present application claims priority upon Japanese Patent Application No. 2004-354669, Japanese Patent Application No. 2004-354670, Japanese Patent Application No. 2004-354671, and Japanese Patent Application No. 2004-354672 filed on Dec. 7, 2004, which are herein incorporated by reference.

BACKGROUND

1. Technical Field

The present invention relates to fixing units, image forming apparatuses, and image forming systems.

2. Related Art

Image forming apparatuses such as laser beam printers are well known. An image forming apparatus is provided with a cover that is openable and closable, and a fixing unit that is for fixing a developer image formed on a medium onto that medium and that is attachable to and detachable from the image-forming-apparatus body. The fixing unit has a first roller and a second roller that can be pressed in contact against the first roller, and in a state in which the cover is closed, the fixing unit fixes the developer image formed on the medium, which is pinched between the first roller and the second roller that is pressed in contact against the first roller via the medium, onto that medium. In order to make the second roller be pressed in contact against the first roller with a stable press-contact force, the fixing unit is provided with a spring, which is an example of an "urging member" that can urge the second roller.

Further, the fixing unit is also provided with a grip that is used for holding the fixing unit when, for example, a user etc. attaches or detaches the fixing unit to or from the image-forming-apparatus body. The fixing unit also has a handle for locking the fixing unit to the image-forming-apparatus body when the user etc. attaches the fixing unit to the image-forming-apparatus body.

When the fixing unit gets jammed, it becomes necessary for the user etc. to open up the cover and perform trouble-shooting. In order for the troubleshooting to be carried out properly, it is preferable that the press-contact of the second roller against the first roller be released.

With this aim, some image forming apparatuses are provided with a press-contact releasing member that operates together with the opening movement of the cover to release the press-contact. In such image forming apparatuses, when the user etc. opens the cover, the press-contact releasing member moves in conjunction with the opening movement of the cover so as to release the press-contact.

As described above, in the above-mentioned image forming apparatus, the fixing unit can be attached to and detached from the image-forming-apparatus body. Therefore, there are instances in which the user etc. detaches the fixing unit from the image-forming-apparatus body. In a state where the fixing unit is detached from the image-forming-apparatus body, it is preferable that the press-contact of the second roller against the first roller is released, from the standpoint of preventing warping of the first and second rollers, for example.

When the user etc. detaches the fixing unit from the image-forming-apparatus body, the user etc. will first open the cover and then take the fixing unit off. As described above, when the cover is opened, the press-contact releasing member moves together with the opening movement of the cover, thereby releasing the press-contact.

When, however, the fixing unit is once detached from the image-forming-apparatus body, the fixing unit will be moved to a location far away from the press-contact releasing member. Thus, the function of the press-contact releasing member of releasing the press-contact will no longer be achieved. As a result, the second roller may get pressed in contact against the first roller when the fixing unit is in a state detached from the image-forming-apparatus body. In view of the above, there has been a demand for an image forming apparatus etc. with which the press-contact of the second roller against the first roller can be reliably released even in a state where the fixing unit has been detached from the image-forming-apparatus body.

Further, when the user etc. attaches the fixing unit to the image-forming-apparatus body, the user etc. will carry out, as a series of operations, an operation of holding and carrying the fixing unit to a fixing-unit holding section provided in the image-forming-apparatus body and an operation of locking the fixing unit to the image-forming-apparatus body.

Therefore, in order to improve user convenience, it is preferable that the above-described series of operations be carried out smoothly. In other words, there is a demand for a fixing unit etc. that has a high level of convenience for users etc.

Moreover, when the user etc. attaches a unit, such as the fixing unit, to the image-forming-apparatus body, there is a possibility that the user etc. may make an error in operation and the unit may not be attached in a predetermined position (i.e., the correct position) of the image-forming-apparatus body. In such a case, various problems (such as malfunctioning or damaging of the unit due to the image forming apparatus operating without the unit being attached in the predetermined position) may arise. Therefore, it is necessary to let the user etc. know that the unit has not been attached properly when the unit is not attached in the predetermined position.

Further, when the unit has not been attached in the predetermined position, the user etc. will have to attach the unit again in the predetermined position (i.e., reattach the unit). In order to allow the user etc. to carry out this reattachment smoothly, it is preferable to let the user etc. know that the unit has not been attached properly immediately after the user etc. attaches the unit in a position other than the predetermined position (i.e., the incorrect position). Accordingly, there is a demand for an image forming apparatus etc. that can let users etc. know that the unit has not been attached properly at an early stage.

Furthermore, in cases where the medium onto which the developer image is to be fixed is, for example, an envelope, it is known that crimples may occur on the medium if the press-contact force of the second roller against the first roller is too large. To address this problem, a fixing unit would be particularly advantageous, in which the intensity of the press-contact force of the second roller against the first roller can be changed, that is, in which a low press-contact-force mode can be employed when fixing the developer image onto a medium in which crimples are prone to occur, such as an envelope, from the viewpoint of preventing crimples, and a high press-contact-force mode can be employed when fixing the developer image onto a medium such as plain paper from the viewpoint of fixing ability.

Existing fixing units are provided with only a single spring for urging the second roller, and achieves the change in the press-contact force by changing the amount of expansion (or the amount of contraction) of the spring between the high press-contact-force mode and the low press-contact-force mode using a cam, for example.

However, in cases of changing the press-contact force through the above-described measure, there is a problem that a desired press-contact force cannot be obtained, due to the fact that it is difficult to set the amount of expansion of the spring to a predetermined value with high precision. Further, there is another problem that it is not possible to achieve a sufficient difference in press-contact force between the high press-contact-force mode and the low press-contact-force mode, due to restrictions in the size of the cam etc. Therefore, existing fixing units are not capable of changing the intensity of the press-contact force appropriately. Accordingly, there is a demand for a fixing unit etc. in which the intensity of the press-contact force of the second roller against the first roller can be changed appropriately.

SUMMARY

An advantage of some aspects of the present invention is that it is possible to achieve an image forming apparatus and an image forming system with which the press-contact of the second roller against the first roller is reliably released even when the fixing unit has been detached from the image-forming-apparatus body.

An aspect of the invention is an image forming apparatus including:

an openable and closable cover;

a fixing unit having a first roller, a second roller that can be pressed in contact against the first roller, and a retaining member adapted to retain a state in which the press-contact of the second roller against the first roller has been released by a press-contact releasing member, the fixing unit being attachable to and detachable from a body of the image forming apparatus, the fixing unit being adapted to fix a developer image, which is formed on a medium that is pinched between the first roller and the second roller being pressed in contact against the first roller via the medium, onto that medium in a state where the cover is closed; and the press-contact releasing member adapted to release the press-contact of the second roller against the first roller in conjunction with an opening movement of the cover.

Another advantage of some aspects of the present invention is that it is possible to achieve a fixing unit, an image forming apparatus, and an image forming system that have a high level of convenience for users etc.

Another aspect of the invention is a fixing unit adapted to fix a developer image formed on a medium onto that medium, including:

a grip used for holding the fixing unit, the fixing unit being attachable to and detachable from a body of an image forming apparatus, the grip being a handle adapted to lock the fixing unit to the body of the image forming apparatus when the fixing unit is attached to the body of the image forming apparatus.

Another advantage of some aspects of the present invention is that it is possible to achieve an image forming apparatus and an image forming system that can let users etc. know that a unit, such as a fixing unit, has not been attached properly at an early stage.

Another aspect of the invention is an image forming apparatus including:

a unit that is attachable to a body of the image forming apparatus and that has a handle adapted to lock the unit to the body of the image forming apparatus when the unit is attached to the body of the image forming apparatus; and an improper-attachment preventing section that prevents the unit from being attached improperly, by restricting movement of the handle when the unit is not attached to a predetermined position of the body of the image forming apparatus, and allowing movement of the handle when the unit is attached to the predetermined position.

Another advantage of some aspects of the present invention is that it is possible to achieve a fixing unit, an image forming apparatus, and an image forming system in which the intensity of the press-contact force of the second roller against the first roller can be changed appropriately.

Another aspect of the invention is a fixing unit adapted to fix a developer image formed on a medium onto that medium, including:

a first roller;

a second roller that can be pressed in contact against the first roller and that is pressed in contact against the first roller when the developer image formed on the medium is being fixed onto that medium;

a plurality of urging members that can urge the second roller in order to press the second roller in contact against the first roller; and a changing section adapted to change an intensity of a press-contact force of the second roller against the first roller, by selecting at least one urging member for urging the second roller from among the plurality of urging members.

Other features of the invention will be made clear through the following description with reference to the accompanying drawings.

BRIEF DESCRIPTION OF THE DRAWINGS

For a more complete understanding of the present invention and the advantages thereof, reference is now made to the following description taken in conjunction with the accompanying drawings, wherein.

DESCRIPTION OF EXEMPLARY EMBODIMENTS

Figure 1:
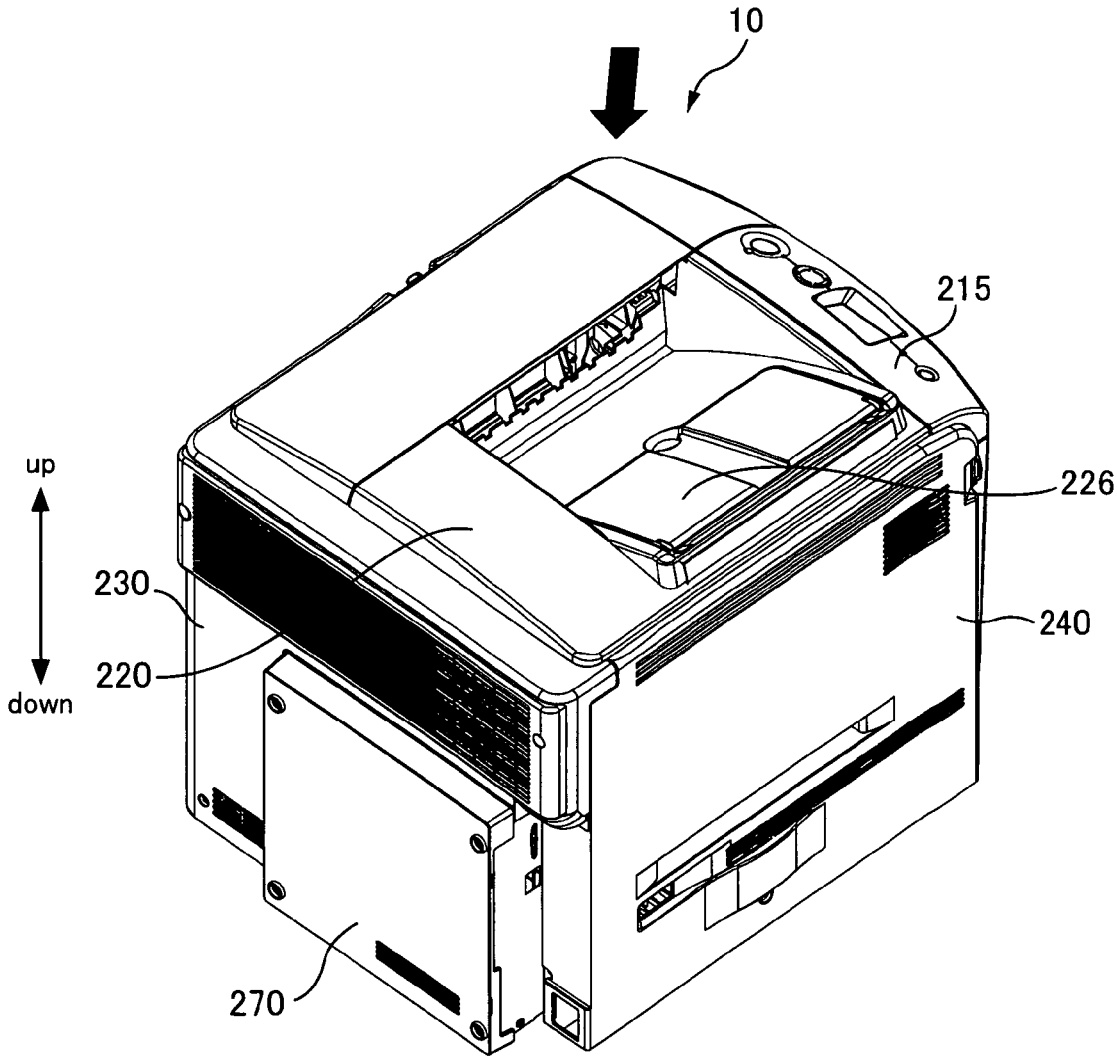
FIG. 1 is a first perspective view showing an exterior configuration of a printer 10.

At least the following matters will become clear by the explanation in the present specification and the description of the accompanying drawings.

An image forming apparatus includes:

an openable and closable cover;

a fixing unit having a first roller, a second roller that can be pressed in contact against the first roller, and a retaining member adapted to retain a state in which the press-contact of the second roller against the first roller has been released by a press-contact releasing member, the fixing unit being attachable to and detachable from a body of the image forming apparatus, the fixing unit being adapted to fix a developer image, which is formed on a medium that is pinched between the first roller and the second roller being pressed in contact against the first roller via the medium, onto that medium in a state where the cover is closed; and the press-contact releasing member adapted to release the press-contact of the second roller against the first roller in conjunction with an opening movement of the cover.

In this way, it is possible to achieve an image forming apparatus with which the press-contact of the second roller against the first roller is reliably released even when the fixing unit has been detached from the image-forming-apparatus body.

Further, the fixing unit may have a handle; and when the handle is operated, the retaining member may move in conjunction with the movement of the handle and retain the state in which the press-contact has been released.

In this way, it is possible to obtain the above-described effect, i.e., the effect that it is possible to achieve an image forming apparatus with which the press-contact is reliably released even when the fixing unit has been detached from the image-forming-apparatus body, with a simple structure.

Further, the handle may be adapted to release a lock of the fixing unit with respect to the body of the image forming apparatus when the fixing unit is detached from the body of the image forming apparatus; and the lock of the fixing unit with respect to the body of the image forming apparatus may be released when the handle is operated and the state in which the press-contact has been released is retained by the retaining member.

In this way, the press-contact released state is retained at the same time as the releasing of the lock, which is inevitably performed when detaching the fixing unit from the image-forming-apparatus body, and therefore, it is possible to suitably avoid a situation in which the user etc. forgets to operate the handle to retain the press-contact released state with the retaining member.

Further, the fixing unit may have a pressing member adapted to press the second roller toward the first roller to make the second roller be pressed in contact against the first roller; and the pressing member may be provided with a spring.

By retaining the press-contact released state with the retaining member in this way, not only is it possible to obtain the effect that the press-contact of the second roller against the first roller is prevented when the fixing unit has been detached from the image-forming-apparatus body, but it is also possible to obtain the effect that an impact that occurs when the second roller is pressed in contact against the first roller due to the urging force of the spring can be prevented from being applied to the user etc.

Further, the pressing member may have a rotatable lever that is connected to the spring and the second roller; and the press-contact releasing member may come into contact with the lever to make the lever rotate, make the second roller move, and release the press-contact.

Further, the retaining member may move and come into contact with the lever to retain the state in which the press-contact has been released.

Further, when the retaining member moves and comes into contact with the lever, the retaining member may make the lever rotate to disengage the lever from the press-contact releasing member.

In this way, there is no inconvenience that smooth detachment/attachment of the fixing unit is inhibited due to interference between the lever and the press-contact releasing member when the fixing unit is detached from the image-forming-apparatus body or when the fixing unit is attached to the image-forming-apparatus body by the user etc.

It is also possible to achieve an image forming apparatus including:

an openable and closable cover;

a fixing unit having a first roller, a second roller that can be pressed in contact against the first roller, and a retaining member adapted to retain a state in which the press-contact of the second roller against the first roller has been released by a press-contact releasing member, the fixing unit being attachable to and detachable from a body of the image forming apparatus, the fixing unit being adapted to fix a developer image, which is formed on a medium that is pinched between the first roller and the second roller being pressed in contact against the first roller via the medium, onto that medium in a state where the cover is closed; and the press-contact releasing member adapted to release the press-contact of the second roller against the first roller in conjunction with an opening movement of the cover;

wherein the fixing unit has a handle;

wherein, when the handle is operated, the retaining member moves in conjunction with the movement of the handle and retains the state in which the press-contact has been released;

wherein the handle is adapted to release a lock of the fixing unit with respect to the body of the image forming apparatus when the fixing unit is detached from the body of the image forming apparatus;

wherein the lock of the fixing unit with respect to the body of the image forming apparatus is released when the handle is operated and the state in which the press-contact has been released is retained by the retaining member;

wherein the fixing unit has a pressing member adapted to press the second roller toward the first roller to make the second roller be pressed in contact against the first roller;

wherein the pressing member is provided with a spring;

wherein the pressing member has a rotatable lever that is connected to the spring and the second roller;

wherein the press-contact releasing member comes into contact with the lever to make the lever rotate, make the second roller move, and release the press-contact;

wherein the retaining member moves and comes into contact with the lever to retain the state in which the press-contact has been released; and wherein, when the retaining member moves and comes into contact with the lever, the retaining member makes the lever rotate to disengage the lever from the press-contact releasing member.

In this way, the object of the present invention can be achieved more effectively because all of the effects described above can be obtained.

It is also possible to achieve an image forming system including:

a computer; and an image forming apparatus that is connectable to the computer and that includes:

an openable and closable cover;

a fixing unit having a first roller, a second roller that can be pressed in contact against the first roller, and a retaining member adapted to retain a state in which the press-contact of the second roller against the first roller has been released by a press-contact releasing member, the fixing unit being attachable to and detachable from a body of the image forming apparatus, the fixing unit being adapted to fix a developer image, which is formed on a medium that is pinched between the first roller and the second roller being pressed in contact against the first roller via the medium, onto that medium in a state where the cover is closed; and the press-contact releasing member adapted to release the press-contact of the second roller against the first roller in conjunction with an opening movement of the cover.

In this way, it is possible to achieve an image forming system with which the press-contact of the second roller against the first roller is reliably released even when the fixing unit has been detached from the image-forming-apparatus body.

A fixing unit adapted to fix a developer image formed on a medium onto that medium, includes:

a grip used for holding the fixing unit, the fixing unit being attachable to and detachable from a body of an image forming apparatus, the grip being a handle adapted to lock the fixing unit to the body of the image forming apparatus when the fixing unit is attached to the body of the image forming apparatus.

In this way, the user etc. can carry out an operation of holding and carrying the fixing unit to a fixing-unit holding section provided in the image-forming-apparatus body, as well as an operation of locking the fixing unit to the image-forming-apparatus body, smoothly as a series of operations when the user etc. attaches the fixing unit to the image-forming-apparatus body. Therefore, it is possible to achieve a fixing unit that has a high level of convenience for users etc.

Further, the grip may be a handle adapted to release the lock of the fixing unit with respect to the body of the image forming apparatus when the fixing unit is detached from the body of the image forming apparatus.

In this way, the user etc. can carry out an operation of releasing the lock of the fixing unit to the image-forming-apparatus body, as well as an operation of lifting the fixing unit up from the fixing-unit holding section, smoothly as a series of operations when the user etc. detaches the fixing unit from the image-forming-apparatus body. Therefore, it is possible to achieve a fixing unit that is even more convenient for users etc.

Further, two grips may be provided on an upper section of the fixing unit, one each being provided at both ends, in a longitudinal direction, of the fixing unit.

In this way, the user etc. can hold the fixing unit reliably and easily and also lock the fixing unit to the image-forming-apparatus body more reliably.

Further, a support member adapted to support the grip may be provided on the fixing unit in such a manner that the support member projects upward from a body of the fixing unit, and one end, in a longitudinal direction, of the grip is fixed to the support member; and in a state where the lock is released, the longitudinal direction of the grip may be parallel to the longitudinal direction of the body of the fixing unit.

In this way, the user etc. can hold the fixing unit reliably and easily.

Further, in a state where the lock is released, the other end, in the longitudinal direction, of the grip may be positioned on an outer side of the body of the fixing unit in the longitudinal direction of the body of the fixing unit.

In this way, it is possible to prevent any negative influence of the heat, which is generated by the fixing roller, to the hand more suitably when the user etc. holds or operates the grip.

Further, the fixing unit may further include a restricting section adapted to restrict movement of the grip when the lock has been released due to the grip having been operated.

In this way, movement of the grip will be restricted when the user etc. uses the grip to hold the fixing unit, and therefore, the user etc. will be able to hold the fixing unit reliably.

Further, the restricting section may include a pin that moves in conjunction with the movement of the grip, and a hole into which the pin can be fitted; and the movement of the grip may be restricted as a result of the pin fitting into the hole when the lock has been released due to the grip having been operated.

In this way, the above-described effect, that is, the effect that the user etc. can hold the fixing unit reliably, can be obtained with a simple configuration.

It is also possible to achieve a fixing unit adapted to fix a developer image formed on a medium onto that medium, including:

a grip used for holding the fixing unit, the fixing unit being attachable to and detachable from a body of an image forming apparatus, the grip being a handle adapted to lock the fixing unit to the body of the image forming apparatus when the fixing unit is attached to the body of the image forming apparatus;

wherein the grip is a handle adapted to release the lock of the fixing unit with respect to the body of the image forming apparatus when the fixing unit is detached from the body of the image forming apparatus;

wherein two of the grips are provided on an upper section of the fixing unit, one each being provided at both ends, in a longitudinal direction, of the fixing unit;

wherein a support member adapted to support the grip is provided on the fixing unit in such a manner that the support member projects upward from a body of the fixing unit, and one end, in a longitudinal direction, of the grip is fixed to the support member;

wherein, in a state where the lock is released, the longitudinal direction of the grip is parallel to the longitudinal direction of the body of the fixing unit;

wherein, in a state where the lock is released, the other end, in the longitudinal direction, of the grip is positioned on an outer side of the body of the fixing unit in the longitudinal direction of the body of the fixing unit;

wherein the fixing unit further comprises a restricting section adapted to restrict movement of the grip when the lock has been released due to the grip having been operated;

wherein the restricting section includes a pin that moves in conjunction with the movement of the grip, and a hole into which the pin can be fitted; and wherein the movement of the grip is restricted as a result of the pin fitting into the hole when the lock has been released due to the grip having been operated.

In this way, the object of the present invention can be achieved more effectively because all of the effects described above can be obtained.

It is also possible to achieve an image forming apparatus including:

a fixing unit that is attachable to and detachable from a body of the image forming apparatus and that is adapted to fix a developer image formed on a medium onto that medium, the fixing unit having a grip used for holding the fixing unit, the grip being a handle adapted to lock the fixing unit to the body of the image forming apparatus when the fixing unit is attached to the body of the image forming apparatus.

In this way, the user etc. can carry out an operation of holding and carrying the fixing unit to a fixing-unit holding section provided in the image-forming-apparatus body, as well as an operation of locking the fixing unit to the image-forming-apparatus body, smoothly as a series of operations when the user etc. attaches the fixing unit to the image-forming-apparatus body. Therefore, it is possible to achieve an image forming apparatus that has a high level of convenience for users etc.

Further, the grip may be a handle adapted to release the lock of the fixing unit with respect to the body of the image forming apparatus when the fixing unit is detached from the body of the image forming apparatus.

In this way, the user etc. can carry out an operation of releasing the lock of the fixing unit to the image-forming-apparatus body, as well as an operation of lifting the fixing unit up from the fixing-unit holding section, smoothly as a series of operations when the user etc. detaches the fixing unit from the image-forming-apparatus body. Therefore, it is possible to achieve an image forming apparatus that is even more convenient for users etc.

Further, the image forming apparatus may further include an openable and closable cover; the fixing unit may further include a first roller and a second roller that can be pressed in contact against the first roller, and fixes the developer image, which is formed on the medium that is pinched between the first roller and the second roller being pressed in contact against the first roller via the medium, onto that medium in a state where the cover is closed; the image forming apparatus may further include a press-contact releasing member adapted to release the press-contact of the second roller against the first roller in conjunction with an opening movement of the cover; the fixing unit may further include a retaining member adapted to retain a state in which the press-contact has been released by the press-contact releasing member; the grip may be a handle adapted to move the retaining member to make the retaining member retain the state in which the press-contact has been released; and the state in which the press-contact has been released may be retained by the retaining member when the grip is operated and the lock is released.

In this way, there is an advantage in that it is not necessary to separately provide a handle having the function of making the retaining member retain the press-contact released state.

Further, the fixing unit may further include a restricting section adapted to restrict movement of the grip when the lock has been released and the state in which the press-contact has been released is being retained by the retaining member due to the grip having been operated.

In this way, not only is it possible to obtain the effect that movement of the grip is restricted when the user etc. uses the grip for holding the fixing unit, but it is also possible to obtain the effect that the press-contact released state retained by the retaining member can be maintained more appropriately by restricting the movement of the grip.

It is also possible to achieve an image forming system including:

a computer; and an image forming apparatus that is connectable to the computer and that includes:

a fixing unit that is attachable to and detachable from a body of the image forming apparatus and that is adapted to fix a developer image formed on a medium onto that medium, the fixing unit having a grip used for holding the fixing unit, the grip being a handle adapted to lock the fixing unit to the body of the image forming apparatus when the fixing unit is attached to the body of the image forming apparatus.

In this way, it is possible to achieve an image forming system that has a high level of convenience for users etc.

An image forming apparatus includes:

a unit that is attachable to a body of the image forming apparatus and that has a handle adapted to lock the unit to the body of the image forming apparatus when the unit is attached to the body of the image forming apparatus; and an improper-attachment preventing section that prevents the unit from being attached improperly, by restricting movement of the handle when the unit is not attached to a predetermined position of the body of the image forming apparatus, and allowing movement of the handle when the unit is attached to the predetermined position.

In this way, it is possible to achieve an image forming apparatus that can let users etc. know that a unit has not been attached properly at an early stage.

Further, the improper-attachment preventing section may restrict the movement of the handle when the unit is in a state detached from the body of the image forming apparatus.

In this way, the handle can be used as a holding section used for holding the unit.

Further, the improper-attachment preventing section may include a pin that is provided in the unit and that is movable in conjunction with the movement of the handle, and a hole that is also provided in the unit and into which the pin can be fitted; the pin may be fitted into the hole when the unit is in a state detached from the body of the image forming apparatus; when the unit is not attached to the predetermined position, a state in which the pin is fitted into the hole may be maintained and the hole may restrict the movement of the pin in conjunction with the movement of the handle; and when the unit is attached to the predetermined position, the state in which the pin is fitted into the hole may be canceled and the movement of the pin in conjunction with the movement of the handle may be allowed.

In this way, it is possible to achieve the improper-attachment preventing section having the above-mentioned function using a simple configuration consisting of a pin and a hole.

Further, the improper-attachment preventing section may further include a canceling section that is provided in the body of the image forming apparatus and that is adapted to cancel the state in which the pin is fitted into the hole; and when the unit is not attached to the predetermined position, the canceling section does not have to cancel the state in which the pin is fitted into the hole, and when the unit is attached to the predetermined position, the canceling section may cancel the state in which the pin is fitted into the hole.

Further, the canceling section may be a projecting section projecting upward; and when the unit is attached to the predetermined position, the pin may come into contact with the projecting section and the projecting section may push the pin up to cancel the state in which the pin is fitted into the hole, and when the unit is not attached to the predetermined position, the pin does not have to come into contact with the projecting section and the state in which the pin is fitted into the hole may be maintained.

In this way, it is possible to achieve the improper-attachment preventing section having the above-mentioned function with a simple configuration.

Further, the improper-attachment preventing section may further include an urging member that is provided in the unit and that is adapted to urge the pin downward.

In this way, the state in which the pin is fitted into the hole is reliably maintained when, for example, the unit is not attached to the predetermined position.

Further, the unit may be a fixing unit that is attachable to and detachable from the body of the image forming apparatus and that is adapted to fix a developer image formed on a medium onto that medium.

Further, the image forming apparatus may further include an openable and closable cover; the fixing unit may further include a first roller and a second roller that can be pressed in contact against the first roller, and may fix the developer image, which is formed on the medium that is pinched between the first roller and the second roller being pressed in contact against the first roller via the medium, onto that medium in a state where the cover is closed; the image forming apparatus may further include a press-contact releasing member adapted to release the press-contact of the second roller against the first roller in conjunction with an opening movement of the cover; the fixing unit may further include a retaining member adapted to retain a press-contact released state in which the press-contact has been released by the press-contact releasing member; the handle may be a handle adapted to release the lock of the fixing unit with respect to the body of the image forming apparatus when the fixing unit is detached from the body of the image forming apparatus, and also adapted to move the retaining member to make the retaining member retain the state in which the press-contact has been released; and if the fixing unit is not attached to the predetermined position when being attached to the body of the image forming apparatus, the improper-attachment preventing section may restrict the movement of the handle to maintain the press-contact released state that is retained by the retaining member.

From the viewpoint of preventing warping of the first roller and the second roller, it is preferable that the press-contact of the second roller against the first roller is released when the fixing unit is in a state detached from the image-forming-apparatus body. With the above-mentioned configuration, the improper-attachment preventing section not only has the function of letting the user etc. know that the fixing unit has not been attached properly, but also the function of maintaining the press-contact released state retained by the retaining member when the fixing unit is not attached correctly to the image-forming-apparatus body. Therefore, even when the user etc. detaches the fixing unit from the image-forming-apparatus body in order to re-attach the fixing unit, the press-contact released state will be retained by the retaining member, and thus, the above-mentioned warping can be suitably prevented.

It is also possible to achieve an image forming apparatus including:

a unit that is attachable to a body of the image forming apparatus and that has a handle adapted to lock the unit to the body of the image forming apparatus when the unit is attached to the body of the image forming apparatus; and an improper-attachment preventing section that prevents the unit from being attached improperly, by restricting movement of the handle when the unit is not attached to a predetermined position of the body of the image forming apparatus, and allowing movement of the handle when the unit is attached to the predetermined position;

wherein the improper-attachment preventing section restricts the movement of the handle when the unit is in a state detached from the body of the image forming apparatus;

wherein the improper-attachment preventing section includes a pin that is provided in the unit and that is movable in conjunction with the movement of the handle, and a hole that is also provided in the unit and into which the pin can be fitted;

wherein the pin is fitted into the hole when the unit is in a state detached from the body of the image forming apparatus;

wherein, when the unit is not attached to the predetermined position, a state in which the pin is fitted into the hole is maintained and the hole restricts the movement of the pin in conjunction with the movement of the handle;

wherein, when the unit is attached to the predetermined position, the state in which the pin is fitted into the hole is canceled and the movement of the pin in conjunction with the movement of the handle is allowed;

wherein the improper-attachment preventing section further includes a canceling section that is provided in the body of the image forming apparatus and that is adapted to cancel the state in which the pin is fitted into the hole;

wherein, when the unit is not attached to the predetermined position, the canceling section does not cancel the state in which the pin is fitted into the hole, and when the unit is attached to the predetermined position, the canceling section cancels the state in which the pin is fitted into the hole;

wherein the canceling section is a projecting section projecting upward;

wherein, when the unit is attached to the predetermined position, the pin comes into contact with the projecting section and the projecting section pushes the pin up to cancel the state in which the pin is fitted into the hole, and when the unit is not attached to the predetermined position, the pin does not come into contact with the projecting section and the state in which the pin is fitted into the hole is maintained;

wherein the improper-attachment preventing section further includes an urging member that is provided in the unit and that is adapted to urge the pin downward;

wherein the unit is a fixing unit that is attachable to and detachable from the body of the image forming apparatus and that is adapted to fix a developer image formed on a medium onto that medium;

wherein the image forming apparatus further comprises an openable and closable cover;

wherein the fixing unit further includes a first roller and a second roller that can be pressed in contact against the first roller, and fixes the developer image, which is formed on the medium that is pinched between the first roller and the second roller being pressed in contact against the first roller via the medium, onto that medium in a state where the cover is closed;

wherein the image forming apparatus further comprises a press-contact releasing member adapted to release the press-contact of the second roller against the first roller in conjunction with an opening movement of the cover;

wherein the fixing unit further includes a retaining member adapted to retain a press-contact released state in which the press-contact has been released by the press-contact releasing member;

wherein the handle is a handle adapted to release the lock of the fixing unit with respect to the body of the image forming apparatus when the fixing unit is detached from the body of the image forming apparatus, and also adapted to move the retaining member to make the retaining member retain the state in which the press-contact has been released; and wherein, if the fixing unit is not attached to the predetermined position when being attached to the body of the image forming apparatus, the improper-attachment preventing section restricts the movement of the handle to maintain the press-contact released state that is retained by the retaining member.

In this way, the object of the present invention can be achieved more effectively because all of the effects described above can be obtained.

It is also possible to achieve an image forming system including:

a computer; and an image forming apparatus that is connectable to the computer and that includes:

a unit that is attachable to a body of the image forming apparatus and that has a handle adapted to lock the unit to the body of the image forming apparatus when the unit is attached to the body of the image forming apparatus; and an improper-attachment preventing section that prevents the unit from being attached improperly, by restricting movement of the handle when the unit is not attached to a predetermined position of the body of the image forming apparatus, and allowing movement of the handle when the unit is attached to the predetermined position.

In this way, it is possible to achieve an image forming system that can let users etc. know that a unit has not been attached properly at an early stage.

A fixing unit adapted to fix a developer image formed on a medium onto that medium, includes:

a first roller;

a second roller that can be pressed in contact against the first roller and that is pressed in contact against the first roller when the developer image formed on the medium is being fixed onto that medium;

a plurality of urging members that can urge the second roller in order to press the second roller in contact against the first roller; and a changing section adapted to change an intensity of a press-contact force of the second roller against the first roller, by selecting at least one urging member for urging the second roller from among the plurality of urging members.

In this way, it is possible to achieve a fixing unit in which the intensity of the press-contact force of the second roller against the first roller can be changed appropriately.

Further, the plurality of urging members may be a first spring and a second spring whose spring constants differ from one another; and the changing section may change the intensity of the press-contact force by selecting at least one spring for urging the second roller from among the first spring and the second spring.

In this way, it is possible to suitably change the press-contact force using a minimum number of springs.

Further, the changing section may change the intensity of the press-contact force in two stages, by selecting either both the first spring and the second spring or only the first spring as the spring for urging the second roller.

In this way, it becomes possible to make the intensity of the press-contact force during the high-press-contact-force mode even larger.

Further, the spring constant of the first spring may be smaller than the spring constant of the second spring.

In this way, it is possible to achieve a significant difference in press-contact force between the high-press-contact-force mode and the low-press-contact-force mode.

Further, the fixing unit may further include a first pressing member that is connected to the first spring and that is adapted to press the second roller toward the first roller, and a second pressing member that is connected to the second spring and that is adapted to press the second roller toward the first roller via the first pressing member; the changing section may be a rotating member that is provided to the first pressing member and that can come into contact with the second pressing member by rotating; when the rotating member is rotated and is in contact with the second pressing member, a pressing force of the second pressing member may be transmitted to the second roller via the first pressing member and both the first spring and the second spring may urge the second roller via the first pressing member and the second pressing member; and when the rotating member is not in contact with the second pressing member, the pressing force of the second pressing member does not have to be transmitted to the first pressing member and only the first spring may urge the second roller via the first pressing member.

In this way, the pressing force of the second pressing member is appropriately transmitted to the second roller via the changing section thanks to the configuration that the changing section provided in/on the first pressing member can, by rotating, maintain the state of contact with the second pressing member.

Further, the first pressing member may be a lever that can rotate about a rotation shaft, and the second pressing member may also be a lever that can rotate about a rotation shaft; and a distance from the rotation shaft of the second pressing member to a connecting section of the second pressing member at which the second pressing member is connected to the second spring may be longer than a distance from the rotation shaft of the first pressing member to a connecting section of the first pressing member at which the first pressing member is connected to the first spring.

In this way, it becomes possible to make the intensity of the press-contact force during the high-press-contact-force mode even larger.

Further, the fixing unit may further include an operating section operated for changing the intensity of the press-contact force.

In this way, it is possible to achieve a fixing unit in which the intensity of the press-contact force of the second roller against the first roller is changed appropriately with a simple configuration.

It is also possible to achieve a fixing unit adapted to fix a developer image formed on a medium onto that medium, including:

a first roller;

a second roller that can be pressed in contact against the first roller and that is pressed in contact against the first roller when the developer image formed on the medium is being fixed onto that medium;

a plurality of urging members that can urge the second roller in order to press the second roller in contact against the first roller; and a changing section adapted to change an intensity of a press-contact force of the second roller against the first roller, by selecting at least one urging member for urging the second roller from among the plurality of urging members;

wherein the plurality of urging members are a first spring and a second spring whose spring constants differ from one another;

wherein the changing section changes the intensity of the press-contact force by selecting at least one spring for urging the second roller from among the first spring and the second spring;

wherein the changing section changes the intensity of the press-contact force in two stages, by selecting either both the first spring and the second spring or only the first spring as the spring for urging the second roller;

wherein the spring constant of the first spring is smaller than the spring constant of the second spring;

wherein the fixing unit further comprises a first pressing member that is connected to the first spring and that is adapted to press the second roller toward the first roller, and a second pressing member that is connected to the second spring and that is adapted to press the second roller toward the first roller via the first pressing member;

wherein the changing section is a rotating member that is provided to the first pressing member and that can come into contact with the second pressing member by rotating;

wherein, when the rotating member is rotated and is in contact with the second pressing member, a pressing force of the second pressing member is transmitted to the second roller via the first pressing member and both the first spring and the second spring urge the second roller via the first pressing member and the second pressing member;

wherein, when the rotating member is not in contact with the second pressing member, the pressing force of the second pressing member is not transmitted to the first pressing member and only the first spring urges the second roller via the first pressing member;

wherein the first pressing member is a lever that can rotate about a rotation shaft, and the second pressing member is also a lever that can rotate about a rotation shaft;

wherein a distance from the rotation shaft of the second pressing member to a connecting section of the second pressing member at which the second pressing member is connected to the second spring is longer than a distance from the rotation shaft of the first pressing member to a connecting section of the first pressing member at which the first pressing member is connected to the first spring; and wherein the fixing unit further comprises an operating section operated for changing the intensity of the press-contact force.

In this way, the object of the present invention can be achieved more effectively because almost all of the effects described above can be obtained.

It is also possible to achieve an image forming apparatus including:

a fixing unit including a first roller and a second roller that can be pressed in contact against the first roller, the fixing unit being adapted to fix a developer image formed on a medium onto that medium in a state where the second roller is pressed in contact against the first roller via the medium, the fixing unit further including a plurality of urging members that can urge the second roller in order to press the second roller in contact against the first roller, and a changing section adapted to change an intensity of a press-contact force of the second roller against the first roller, by selecting at least one urging member for urging the second roller from among the plurality of urging members.

In this way, it is possible to achieve an image forming apparatus in which the intensity of the press-contact force of the second roller against the first roller can be changed appropriately.

Further, the image forming apparatus may further include an openable and closable cover; the fixing unit may fix the developer image formed on the medium onto that medium in a state where the cover is closed and the second roller is pressed in contact against the first roller via the medium; the plurality of urging members may be a first spring and a second spring whose spring constants differ from one another; the changing section may change the intensity of the press-contact force in two stages, by selecting either both the first spring and the second spring or only the first spring as the spring for urging the second roller; and the image forming apparatus may further include a press-contact-force changing member adapted to reduce the intensity of the press-contact force in a state where both the first spring and the second spring have been selected by the changing section and both the first spring and the second spring are urging the second roller, by canceling a state in which the second spring is urging the second roller in conjunction with an opening movement of the cover.

In this way, since the intensity of the press-contact force becomes small when the cover is opened, it becomes possible to perform troubleshooting easily when the fixing unit gets jammed up. Further, since the press-contact is not completely released when the cover is opened, it is possible to suitably prevent an inconvenience that the user's hands will become dirty with unfixed developer when the user performs troubleshooting.

It is also possible to achieve an image forming system including:

a computer; and an image forming apparatus that is connectable to the computer and that includes:

a fixing unit including a first roller and a second roller that can be pressed in contact against the first roller, the fixing unit being adapted to fix a developer image formed on a medium onto that medium in a state where the second roller is pressed in contact against the first roller via the medium, the fixing unit further including a plurality of urging members that can urge the second roller in order to press the second roller in contact against the first roller, and a changing section adapted to change an intensity of a press-contact force of the second roller against the first roller, by selecting at least one urging member for urging the second roller from among the plurality of urging members.

In this way, it is possible to achieve an image forming system in which the intensity of the press-contact force of the second roller against the first roller can be changed appropriately.

External Configuration Example of Image Forming Apparatus

Figure 2:
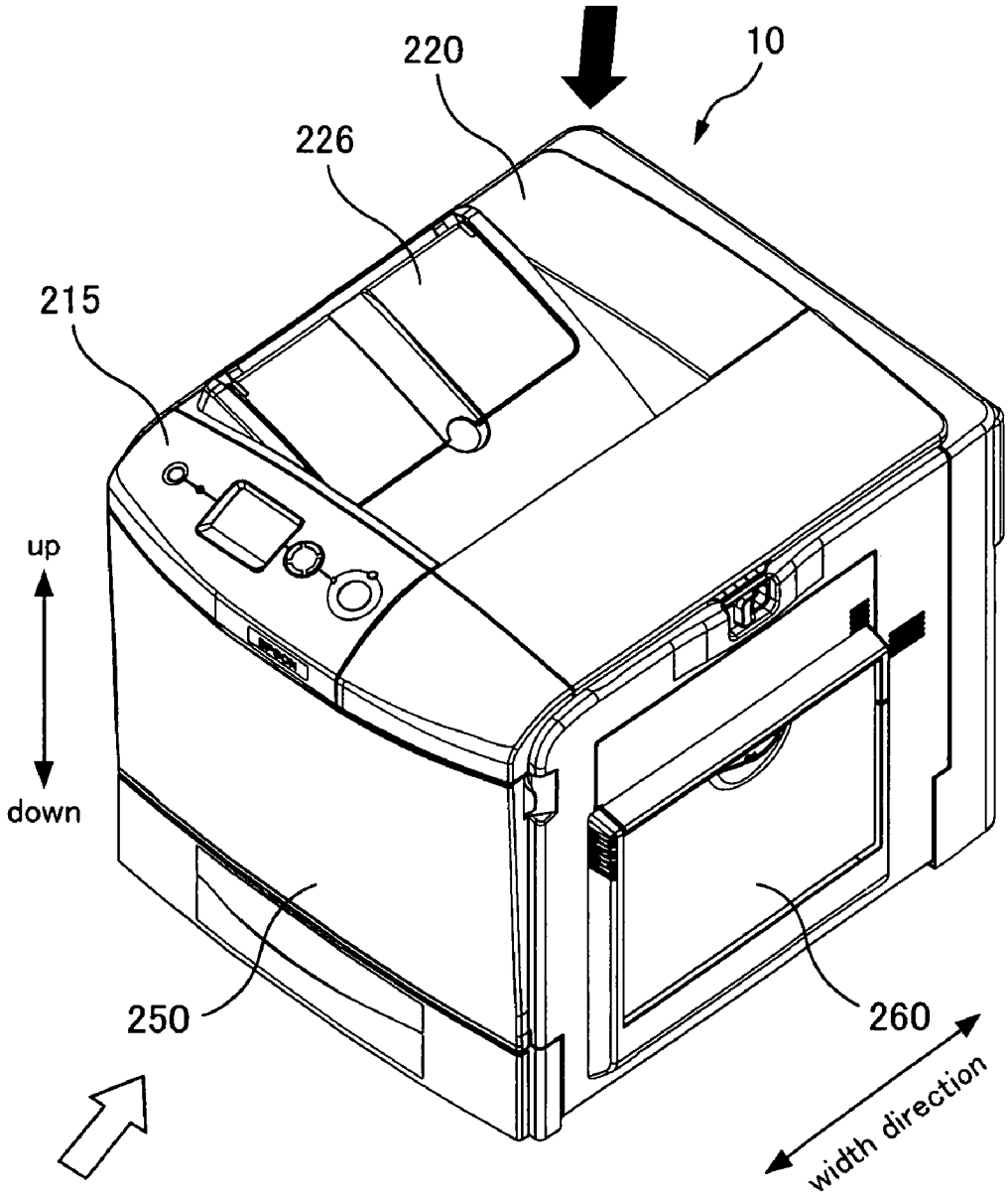
FIG. 2 is a second perspective view showing an exterior configuration of the printer 10.

With reference to FIG. 1 and FIG. 2, an exterior configuration example of an image forming apparatus is described next, taking a laser beam printer 10 (also referred to below as "printer 10") as an example. FIG. 1 and FIG. 2 are perspective views showing an exterior configuration of the printer 10. It should be noted that FIG. 1 is a perspective view of the printer 10 when viewed from the direction of the black arrow shown in FIG. 2. Similarly, FIG. 2 is a perspective view of the printer 10 when viewed from the direction of the black arrow shown in FIG. 1. Further, in FIG. 1 and FIG. 2, the arrow indicates the vertical direction.

As shown in FIG. 1 and FIG. 2, the printer 10 according to the present embodiment has a control panel 215, an upper-surface cover 220, a first side-surface cover 230, a second side-surface cover 240 adjacent to the first side-surface cover 230, a third side-surface cover 250 that is located on the back side of the first side-surface cover 230, a fourth side-surface cover 260 which is an example of a "cover" and located on the back side of the second side-surface cover 240, and a controller box 270.

The control panel 215 is provided on an upper portion of the printer 10, and serves as an interface between the printer and the user etc. More specifically, the control panel 215 has an instruction receiving section for receiving instructions from the user etc., and an information outputting section made of, for example, a liquid crystal panel for providing various information to the user etc.

The upper-surface cover 220 is a detachable-type cover that is provided on the upper portion of the printer 10. More specifically, the upper-surface cover 220 is configured such that it can be detached by, for example, a printer supplier for maintenance etc. of devices inside the printer 10. The upper-surface cover 220 has two screw holes, and is fixed by screws at two points to the printer body 12, which is an example of an "image-forming-apparatus body" or "body of an image forming apparatus".

Further, the upper-surface cover 220 has the function of supporting recording media, which are an example of "discharged media". In order to achieve this function, the upper-surface cover 220 has a recording-medium supporting section 226. Further, the control panel 215 is fixed to the upper-surface cover 220, with the back side of the control panel 215 being fixed with screws (not shown).

The first side-surface cover 230 and the second side-surface cover 240 are detachable-type covers that are provided on the sides of the printer 10. More specifically, the first and second side-surface covers 230 and 240 are configured such that they can be detached by, for example, a printer supplier for maintenance etc. of devices inside the printer 10. The first and second side-surface covers 230 and 240 each has three screw holes, and each of them is fixed by screws at three points to the printer body 12.

The third side-surface cover 250 and the fourth side-surface cover 260 are open/close-type covers that are provided on the sides of the printer 10. More specifically, the third and fourth side-surface covers 250 and 260 are configured such that they can be opened and closed by a user etc. by grasping a grip. The third side-surface cover 250 is a "consumable-item replacement cover" that is opened/closed mainly when replacing consumable items (such as developing devices 51, 52, 53, and 54 described later) provided in the printer 10. The fourth side-surface cover 260 is a "troubleshooting cover" that is opened/closed for troubleshooting such as when a medium is jammed inside the printer 10, as well as a "consumable-item replacement cover" that is opened/closed when replacing consumable items (such as a fixing unit 90 described later) provided in the printer 10.

The controller box 270 is for accommodating memories, hard disks, etc. The controller box 270 has four screw holes, and is fixed by screws at four points to the printer body 12. When the user etc. wishes to replace, for example, the memory or the hard disk, he/she can perform the replacement by unscrewing the screws and taking off the controller box 270 from the printer body 12.

Inner Configuration Example of Image Forming Apparatus

Figure 3:
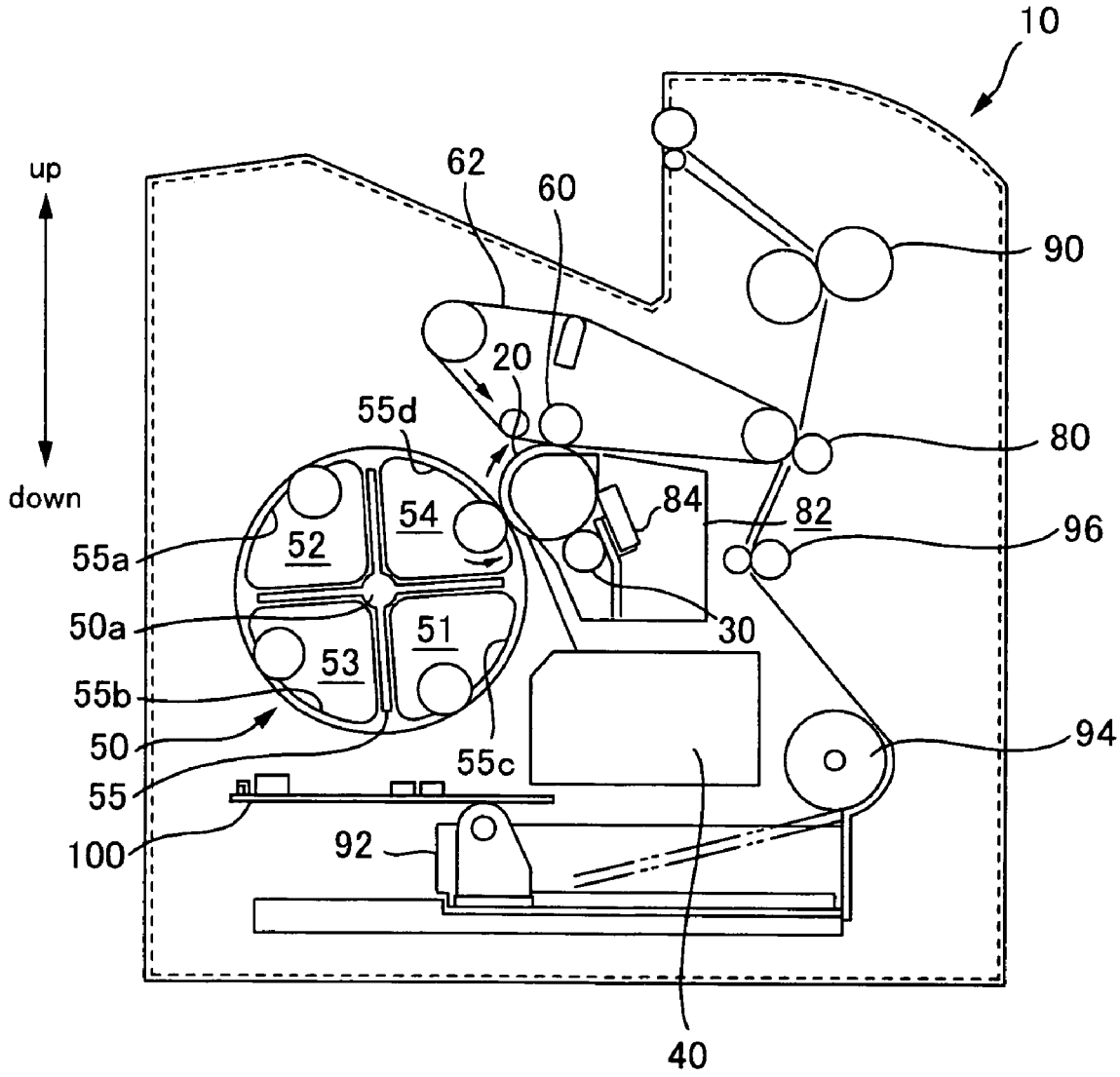
FIG. 3 is a diagram showing main structural components constructing the printer 10.

Next, with reference to FIG. 3, an inner configuration example of the printer 10, which is an example of an "image forming apparatus", is described. FIG. 3 is a diagram showing main structural components constructing the printer 10. It should be noted that in FIG. 3, the vertical direction is shown by the arrow, and, for example, a paper supply tray 92 is arranged at a lower section of the printer 10, and a fixing unit 90 is arranged at an upper section of the printer 10. FIG. 3 is also a diagram of the printer 10 viewed with the third side-surface cover 250 facing the front, that is, viewed from the direction of the white arrow of FIG. 2.

As shown in FIG. 3, the printer 10 according to the present embodiment is provided with a charging unit 30, an exposing unit 40, a YMCK developing unit 50, a first transferring unit 60, an intermediate transferring body 62, and a photoconductor cleaning unit 82. These components are arranged in the direction of rotation of a photoconductor 20 which is for bearing latent images. The printer 10 is further provided with a second transferring unit 80, a fixing unit 90, and a control unit 100 for controlling these units etc. and managing the operations as a printer.

The photoconductor 20 has a cylindrical electrically-conductive base and a photoconductive layer formed on the outer peripheral surface of the electrically-conductive base, and it is rotatable about its central axis. In the present embodiment, the photoconductor 20 rotates clockwise, as shown by the arrow in FIG. 3.

The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image signals having been input from a not-shown host computer such as a personal computer or a word processor.

The YMCK developing unit 50 is a device for developing the latent image formed on the photoconductor 20 using toner T, that is, black (K) toner contained in a black developing device 51, magenta (M) toner contained in a magenta developing device 52, cyan (C) toner contained in a cyan developing device 53, and yellow (Y) toner contained in a yellow developing device 54. The toner T is an example of a "developer" contained in each of the developing devices.

The YMCK developing unit 50 can move the positions of the four developing devices 51, 52, 53, and 54 by rotating while the developing devices 51, 52, 53, and 54 are in an attached state. More specifically, the YMCK developing unit 50 holds the four developing devices 51, 52, 53, and 54 with four developing-device holding sections 55*a*, 55*b*, 55*c*, and 55*d*. The four developing devices 51, 52, 53, and 54 can be rotated about a rotation shaft 50*a* while maintaining their relative positions. Every time an image forming process for one page is finished, each of the developing devices selectively opposes the photoconductor 20 to successively develop the latent image formed on the photoconductor 20 using the toner T contained in each of the developing devices 51, 52, 53, and 54. It should be noted that each of the four developing devices 51, 52, 53, and 54 described above is attachable to and detachable from the printer body 12, more specifically, the respective developing-device holding sections 55*a*, 55*b*, 55*c*, and 55*d* of the YMCK developing unit 50.

The first transferring unit 60 is a device for transferring, onto the intermediate transferring body 62 (described later), a single-color toner image formed on the photoconductor 20. When the toners of all four colors are successively transferred in a superimposing manner, a full-color toner image will be formed on the intermediate transferring body 62.

The intermediate transferring body 62 is a laminated endless belt that is made by providing an aluminum layer on the surface of a PET film by vapor deposition and then further applying semiconducting coating on the outer layer thereof. The intermediate transferring body 62 is driven to rotate at substantially the same circumferential speed as the photoconductor 20.

The second transferring unit 80 is a device for transferring the single-color toner image or the full-color toner image formed on the intermediate transferring body 62 onto a recording medium such as paper, film, and cloth.

The fixing unit 90 is a device for fixing the toner image formed on the recording medium, which is an example of a "developer image", onto that recording medium. That is, the fixing unit 90 fuses the single-color toner image or the full-color toner image, which has been transferred onto the recording medium, to the recording medium to make it into a permanent image. It should be noted that the fixing unit 90 is attachable to and detachable from the printer body 12, more specifically, to and from a fixing-unit holding section 91 provided in the printer body 12. The fixing unit 90 and the fixing-unit holding section 91 will be described in detail further below.

The photoconductor cleaning unit 82 is a device that is provided between the first transferring unit 60 and the charging unit 30, that has a rubber, photoconductor cleaning blade 84 made to abut against the surface of the photoconductor 20, and that is for removing the toner T remaining on the photoconductor 20 by scraping it off with the photoconductor cleaning blade 84 after the toner image has been transferred onto the intermediate transferring body 62 by the first transferring unit 60.

Figure 4:
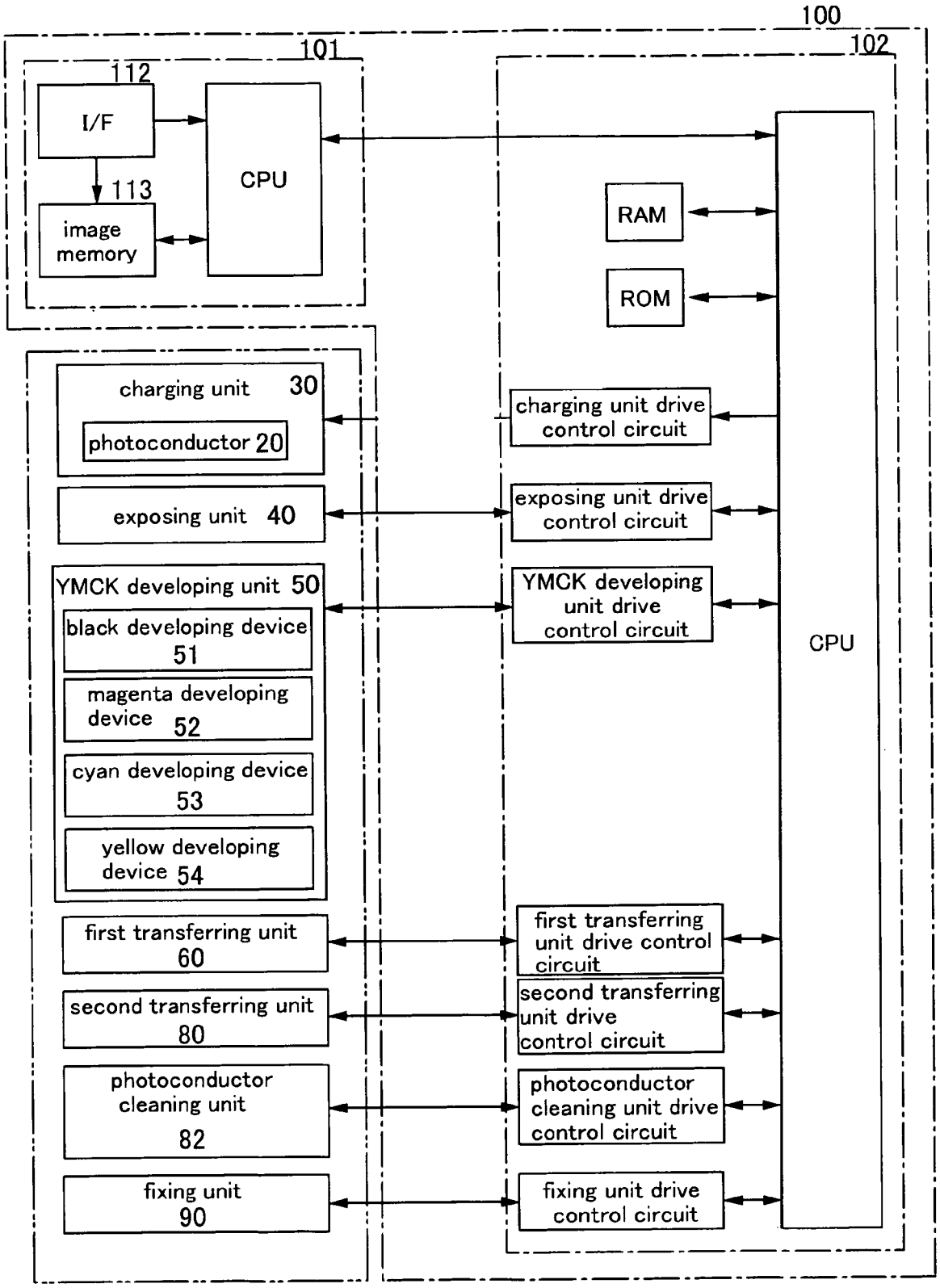
FIG. 4 is a block diagram showing a configuration of a control unit of the printer 10.

The control unit 100 is provided with a main controller 101 and a unit controller 102 as shown in FIG. 4. Image signals and control signals are input to the main controller 101, and according to instructions based on the image signals and control signals, the unit controller 102 controls each of the above-mentioned units etc. to form an image.

Next, operations of the printer 10 structured as above will be described.

First, when image signals and control signals are input from the not-shown host computer to the main controller 101 of the printer 10 through an interface (I/F) 112, the photoconductor 20 and the intermediate transferring body 62 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing unit 50 positions the yellow developing device 54, which contains yellow (Y) toner, at the developing position, which is in opposition to the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring body 62 by the first transferring unit 60. At this time, a first transferring voltage, which has an opposite polarity from the polarity to which the toner T has been charged, is applied to the first transferring unit 60. It should be noted that, during this process, the photoconductor 20 and the intermediate transferring body 62 are placed in contact with each other, but the second transferring unit 80 is kept separated from the intermediate transferring body 62.

By subsequently performing the above-mentioned processes for the second, the third, and the fourth colors using each of the developing devices, toner images in four colors corresponding to the respective image signals are transferred onto the intermediate transferring body 62 in a superimposed manner. As a result, a full-color toner image is formed on the intermediate transferring body 62.

With the rotation of the intermediate transferring body 62, the full-color toner image formed on the intermediate transferring body 62 reaches a second transferring position, and is transferred onto a recording medium by the second transferring unit 80. It should be noted that the recording medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 62.

The full-color toner image transferred onto the recording medium is heated and pressurized by the fixing unit 90 and thereby fused to the recording medium.

On the other hand, after the photoconductor 20 passes the first transferring position, the toner T adhering to the surface of the photoconductor 20 is scraped off by the photoconductor cleaning blade 84 that is supported on the photoconductor cleaning unit 82, and the photoconductor 20 is prepared for electrical charging for forming the next latent image. The scraped-off toner T is collected in a remaining-toner collector of the photoconductor cleaning unit 82.

Overview of Control Unit

Next, a configuration of the control unit 100 is described with reference to FIG. 4. The main controller 101 of the control unit 100 is connected to a host computer via the interface 112, and is provided with an image memory 113 for storing the image signals that have been input from the host computer. The unit controller 102 is electrically connected to the units in the body of the apparatus (i.e., the charging unit 30, the exposing unit 40, the YMCK developing unit 50, the first transferring unit 60, the second transferring unit 80, the photoconductor cleaning unit 82, and the fixing unit 90), and it detects the state of the units by receiving signals from sensors provided in those units, and also controls those units based on the signals that are input from the main controller 101.

First Embodiment

Configuration Example of Fixing Unit, and its Periphery, According to First Embodiment Next, with reference to FIG. 5 through FIG. 15, description will be made on a configuration example of the fixing unit 90, which is an example of a unit attachable to the printer body 12, and members of the printer body 12 located in the periphery of the fixing unit 90 when the fixing unit 90 is attached to the printer body 12 (also referred to as "peripheral members").

Figure 5:
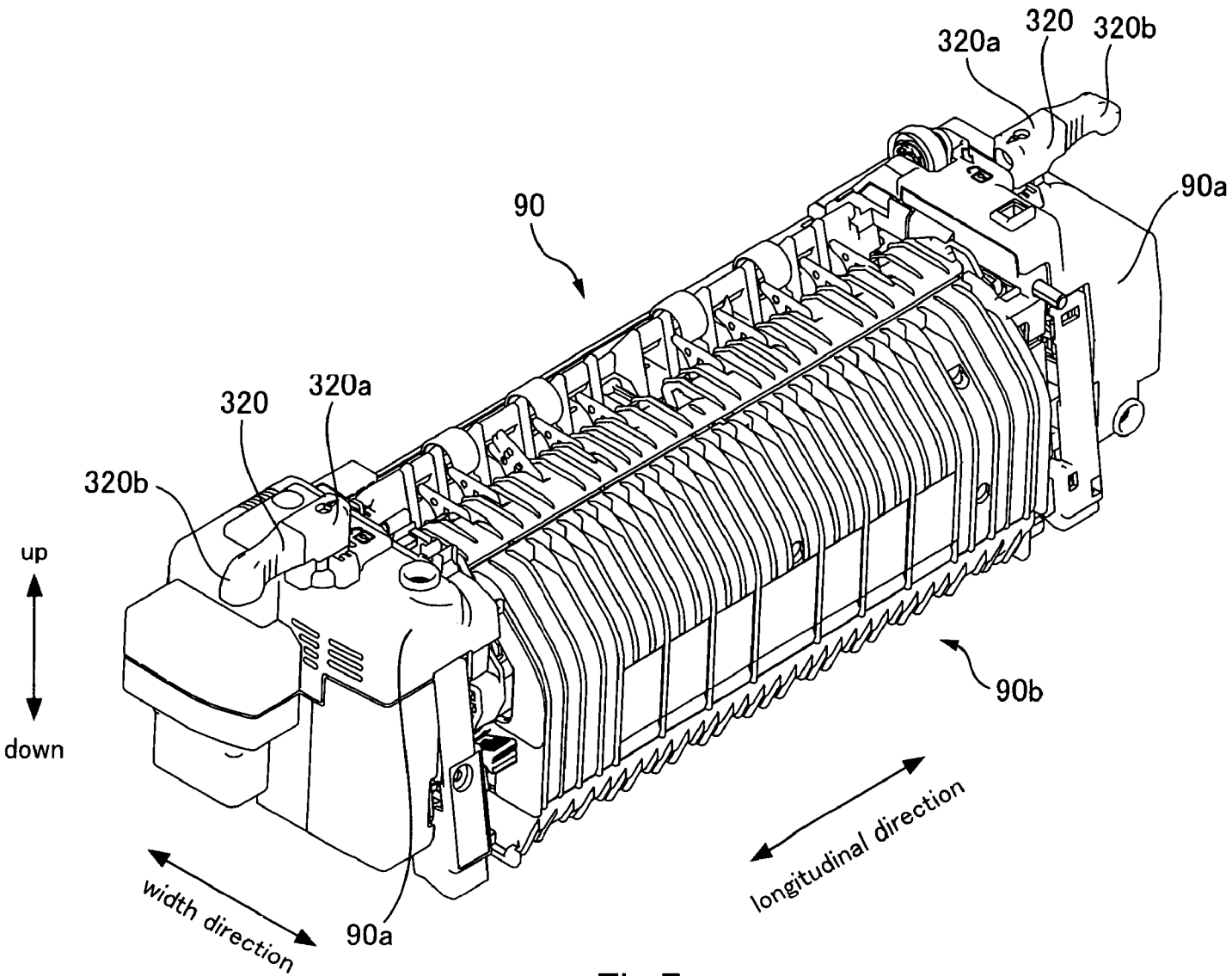
FIG. 5 is a perspective view showing an external configuration of a fixing unit 90 according to a first embodiment.

FIG. 5 is a perspective view showing an external configuration of the fixing unit 90.

Figure 6:
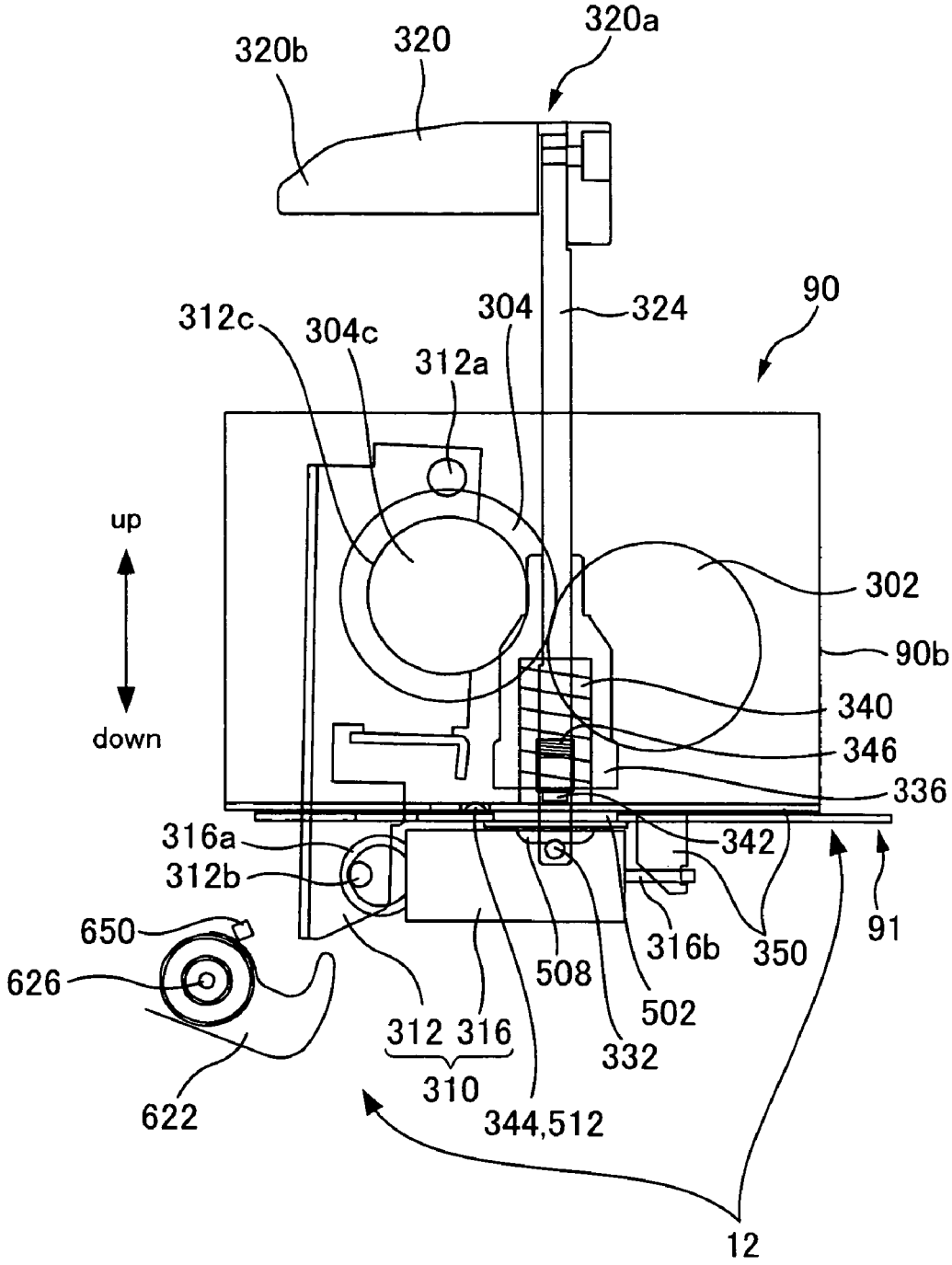
FIG. 6 is a front view according to the first embodiment, showing a state in which the fixing unit 90 is attached to a fixing-unit holding section 91 and the fixing unit 90 is locked to the printer body 12.
Figure 7:
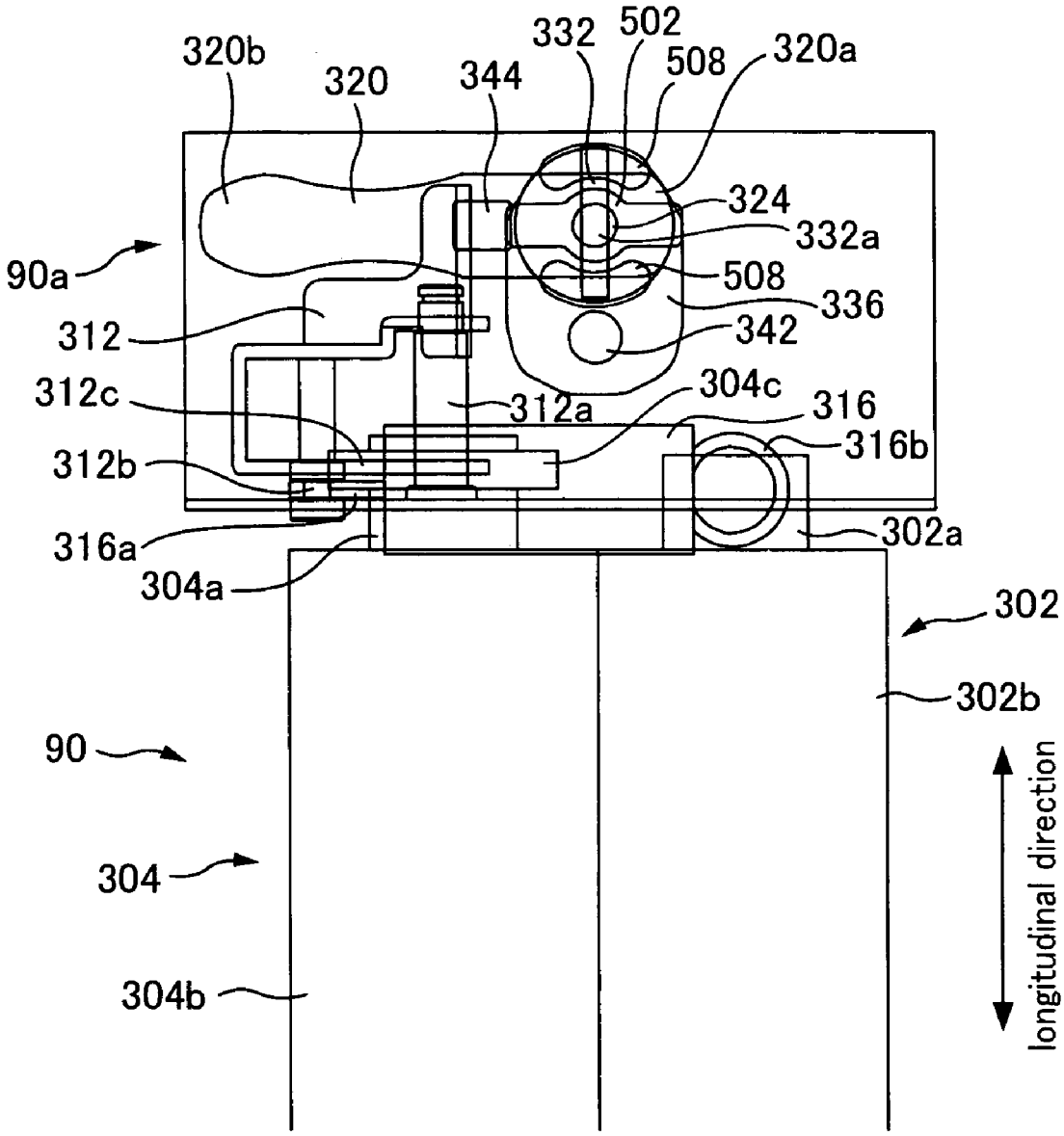
FIG. 7 is a plan view according to the first embodiment, showing a state in which the fixing unit 90 is attached to the fixing-unit holding section 91 and the fixing unit 90 is locked to the printer body 12.
Figure 8:
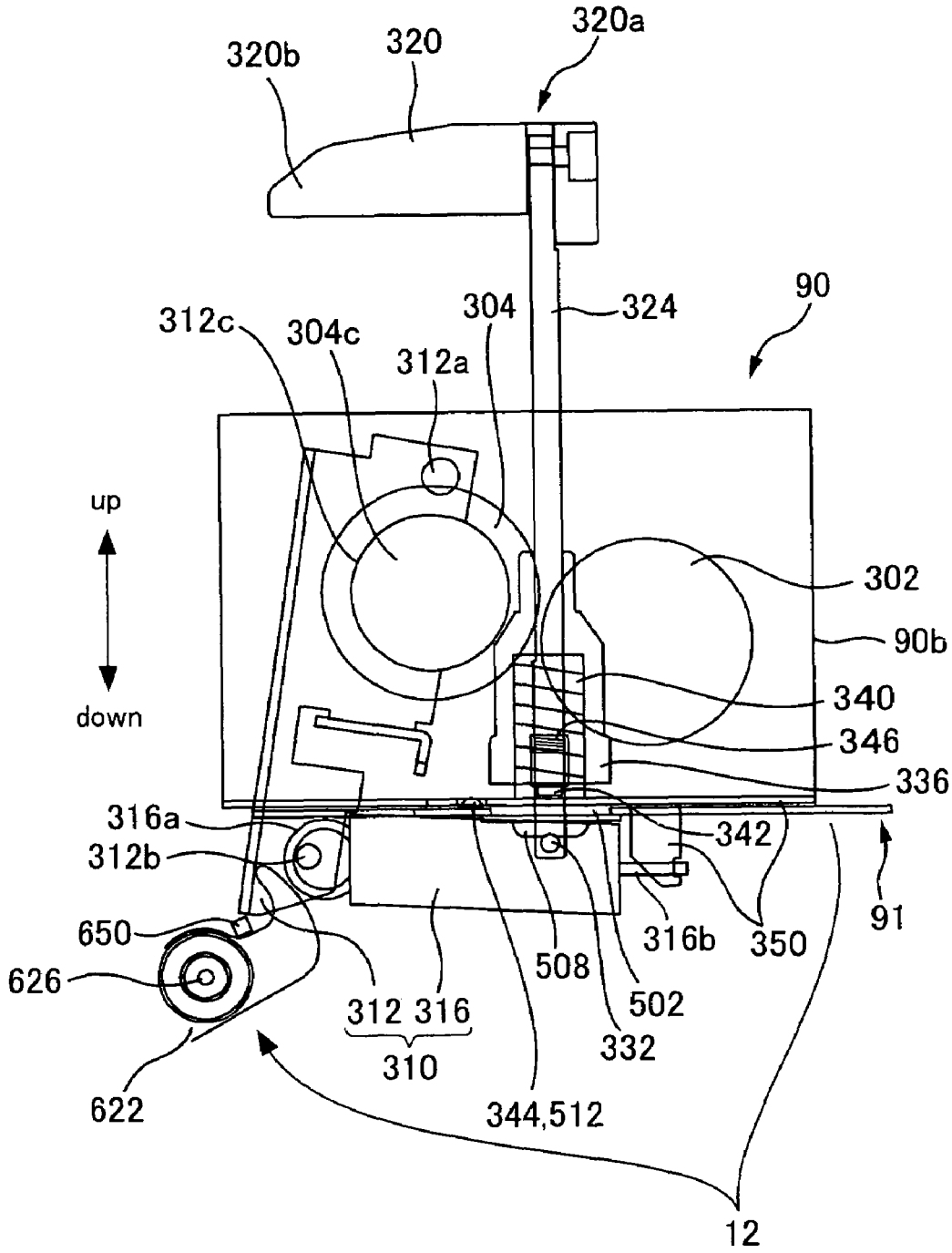
FIG. 8 is a front view according to the first embodiment, showing a state in which the fixing unit 90 is attached to the fixing-unit holding section 91 and the fixing unit 90 is locked to the printer body 12.
Figure 9:
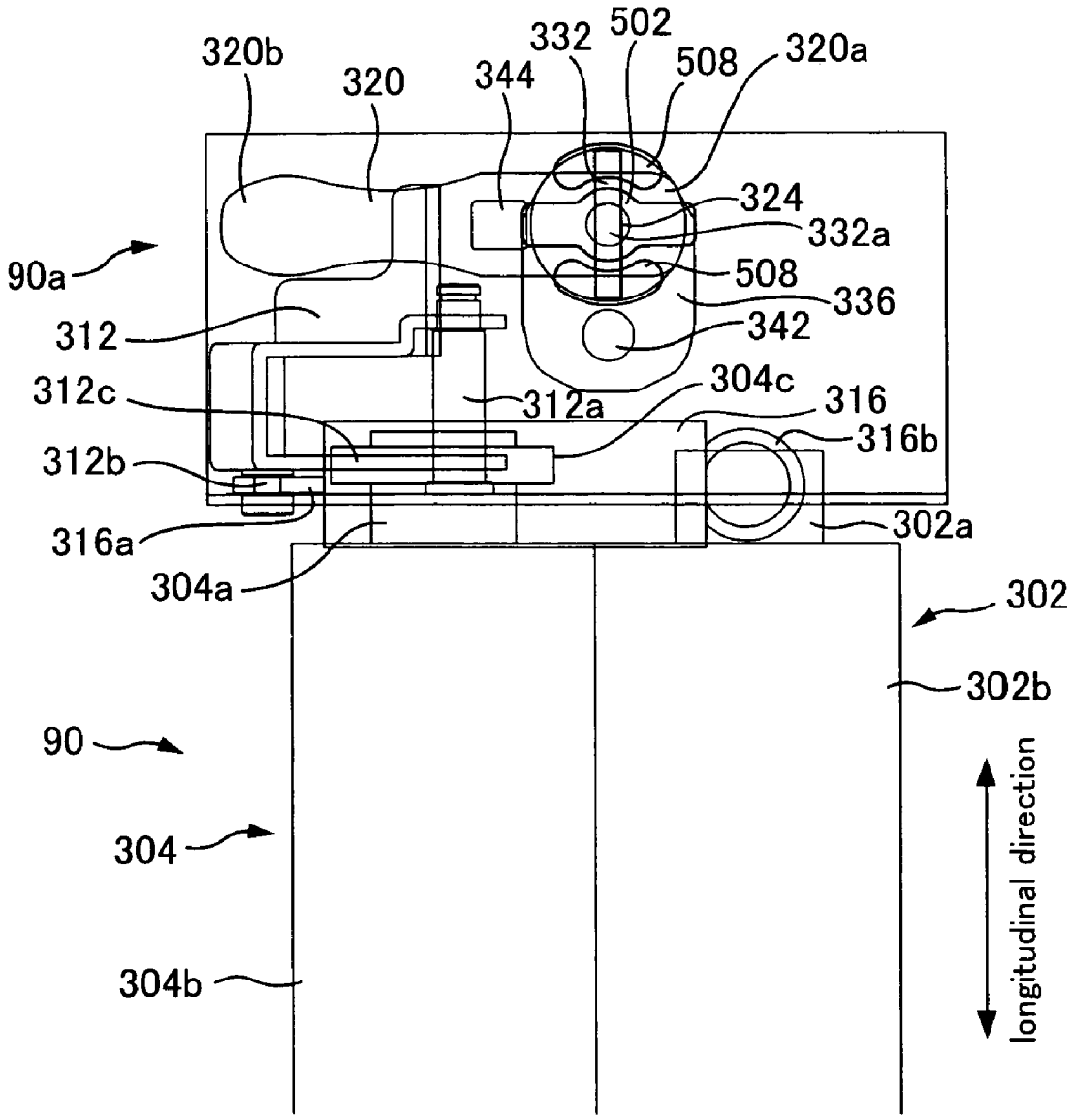
FIG. 9 is a plan view according to the first embodiment, showing a state in which the fixing unit 90 is attached to the fixing-unit holding section 91 and the fixing unit 90 is locked to the printer body 12.
Figure 10:
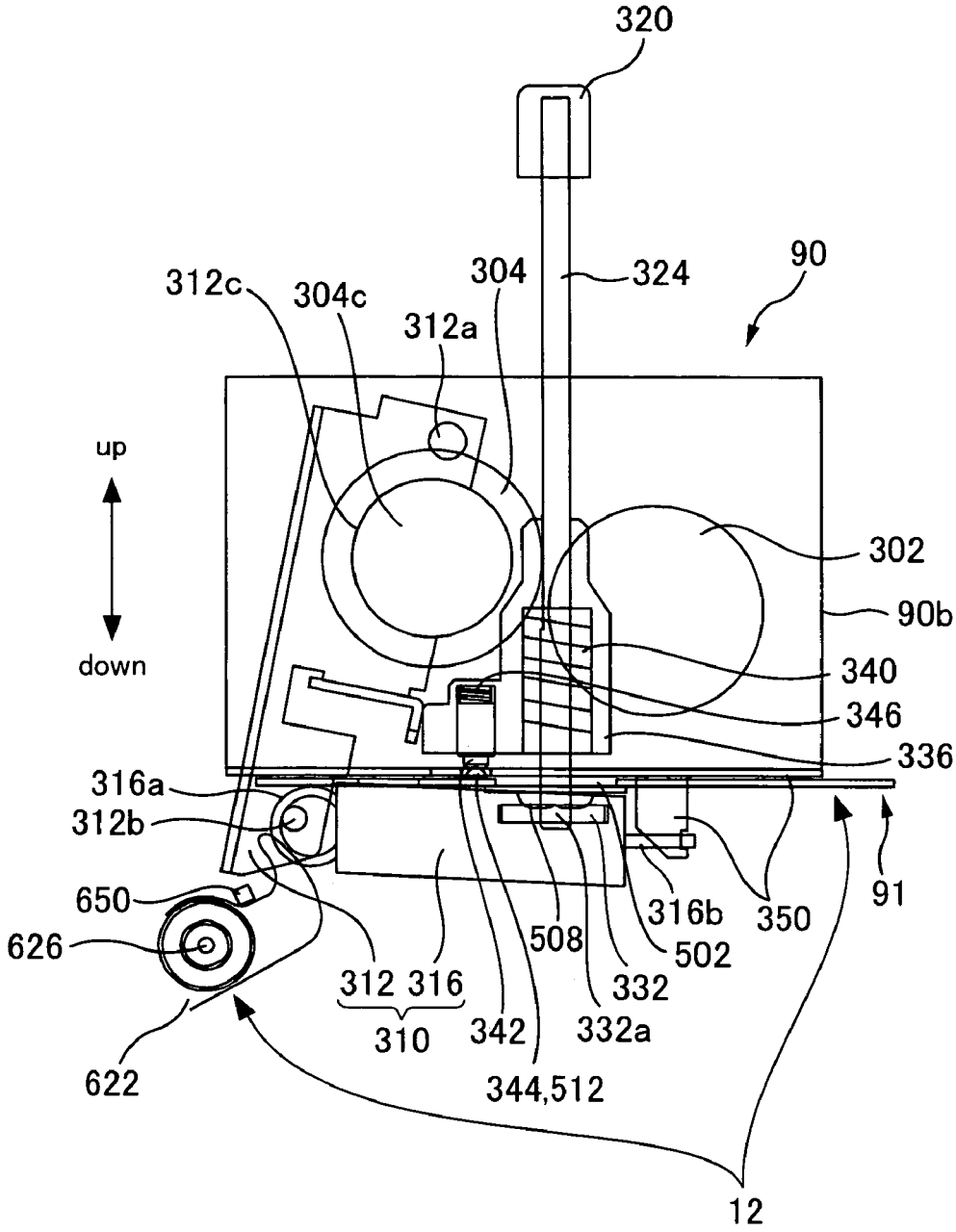
FIG. 10 is a front view according to the first embodiment, showing a state in which the fixing unit 90 is attached to the fixing-unit holding section 91, but in which the lock between the fixing unit 90 and the printer body 12 is released.
Figure 11:
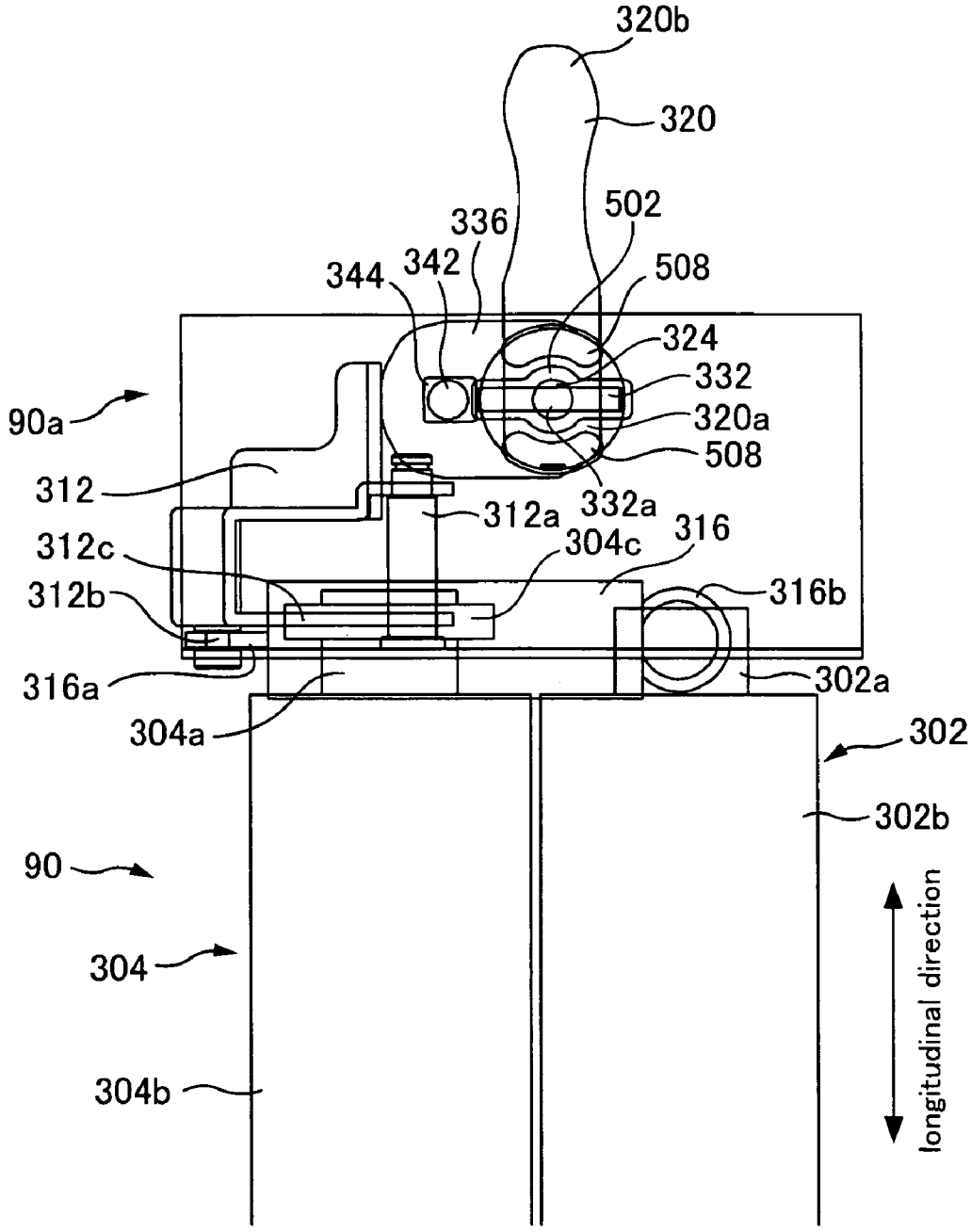
FIG. 11 is a plan view according to the first embodiment, showing a state in which the fixing unit 90 is attached to the fixing-unit holding section 91, but in which the lock between the fixing unit 90 and the printer body 12 is released.
Figure 12:
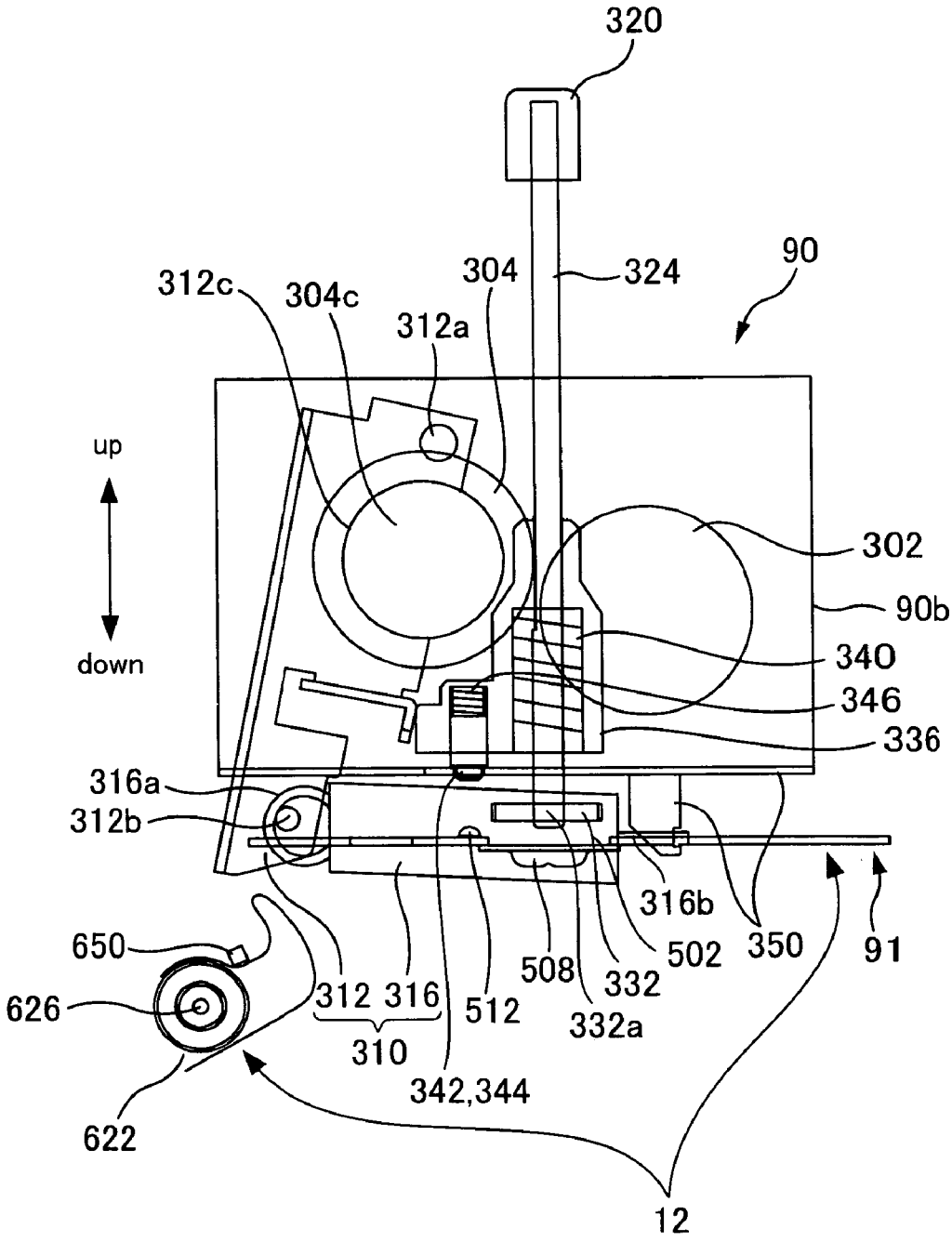
FIG. 12 is a front view according to the first embodiment, showing a state in which the fixing unit 90 is detached from the fixing-unit holding section 91.
Figure 13:
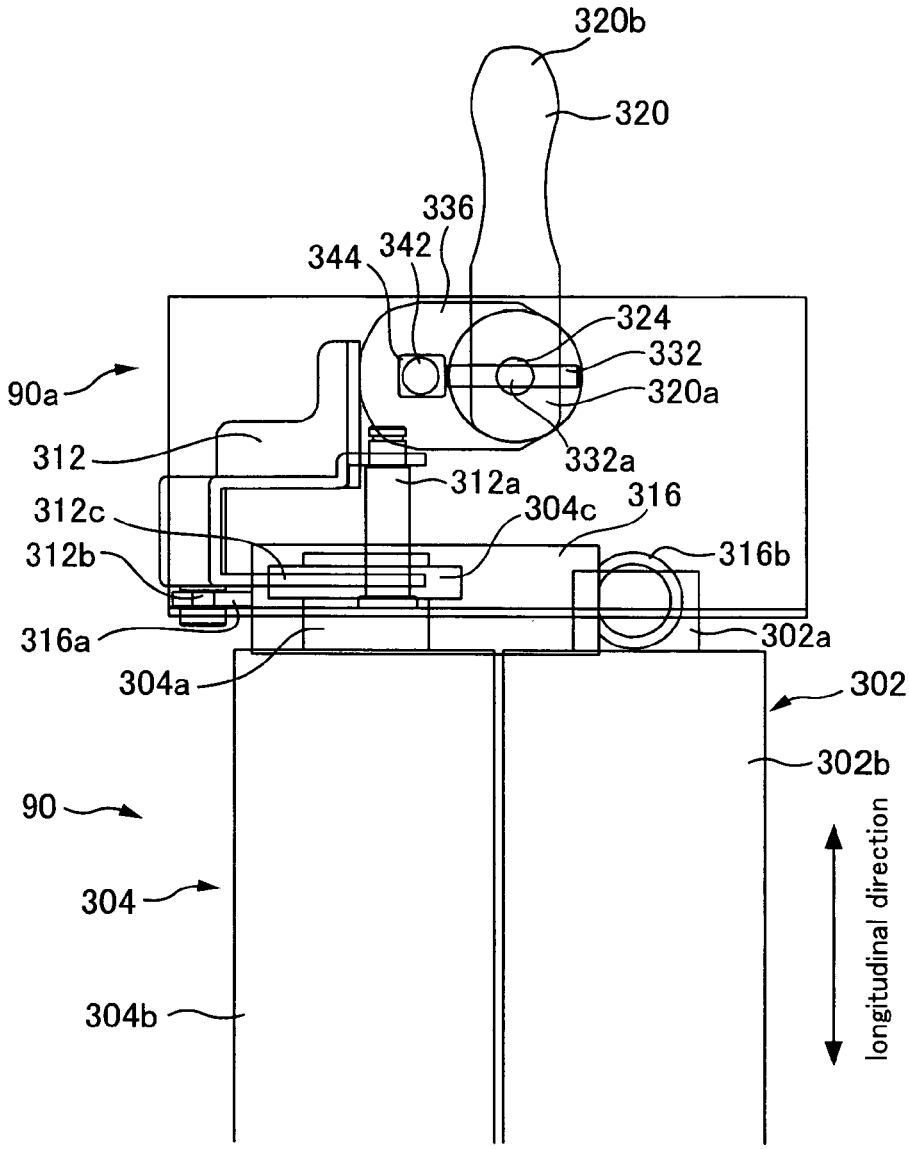
FIG. 13 is a plan view according to the first embodiment, showing a state in which the fixing unit 90 is detached from the fixing-unit holding section 91.

FIG. 6 through FIG. 13 are diagrams showing one end 90*a*, in the longitudinal direction, of the fixing unit 90, and peripheral members in its periphery. FIG. 6 and FIG. 7 are, respectively, a front view and a plan view showing a state in which the fixing unit 90 is attached to the fixing-unit holding section 91 and the fixing unit 90 is locked to the printer body 12. FIG. 8 and FIG. 9 are similar to FIG. 6 and FIG. 7, and are, respectively, a front view and a plan view showing a state in which the fixing unit 90 is attached to the fixing-unit holding section 91 and the fixing unit 90 is locked to the printer body 12; FIG. 6 and FIG. 7 show a state in which the fourth side-surface cover 260 is closed, but FIG. 8 and FIG. 9 show a state in which the fourth side-surface cover 260 is opened. FIG. 10 and FIG. 11 are, respectively, a front view and a plan view showing a state in which the fixing unit 90 is attached to the fixing-unit holding section 91, but in which the lock between the fixing unit 90 and the printer body 12 is released. FIG. 12 and FIG. 13 are, respectively, a front view and a plan view showing a state in which the fixing unit 90 is detached from the fixing-unit holding section 91. It should be noted that FIG. 10 through FIG. 13 show a state in which the fourth side-surface cover 260 is opened.

Figure 14:
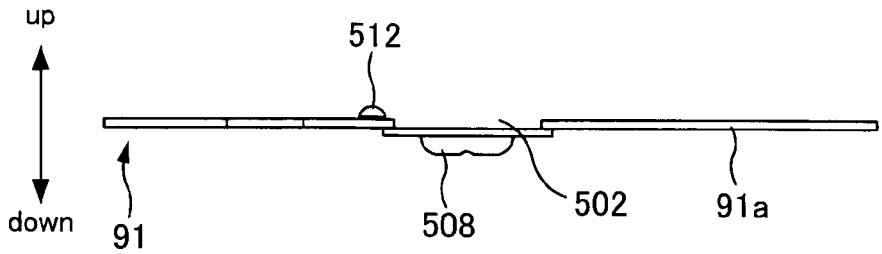
FIG. 14 is a front view according to the first embodiment, showing a configuration of one end 91*a*, in the longitudinal direction, of the fixing-unit holding section 91.
Figure 15:
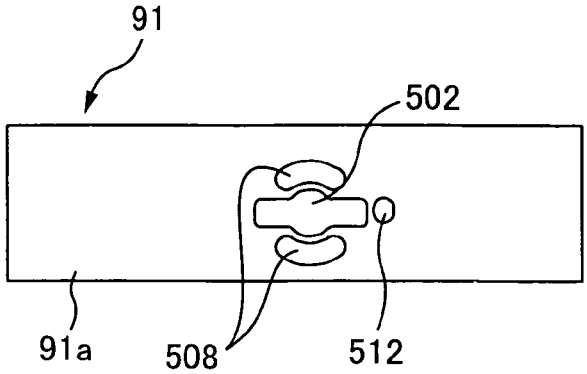
FIG. 15 is a plan view according to the first embodiment, showing a configuration of one end 91*a*, in the longitudinal direction, of the fixing-unit holding section 91.

FIG. 14 and FIG. 15 are, respectively, a front view and a plan view showing a configuration of one end 91*a*, in the longitudinal direction, of the fixing-unit holding section 91.

It should be noted that the arrows in FIGS. 5, 6, 8, 10, 12, and 14 indicate the vertical direction, the arrows in FIGS. 5, 7, 9, 11, and 13 indicate the longitudinal direction of the fixing unit 90, and another arrow in FIG. 5 indicates the width direction of the fixing unit 90.

As described above, FIG. 6 through FIG. 13 are diagrams showing an end 90*a* etc., in the longitudinal direction, of the fixing unit 90, and FIG. 14 and FIG. 15 are diagrams showing one end 91*a*, in the longitudinal direction, of the fixing-unit holding section 91; since one longitudinal-direction end and the other longitudinal-direction end of the fixing unit 90, as well as the fixing-unit holding section 91, have substantially the same structure, only one end, in the longitudinal direction, of the fixing unit 90 or the fixing-unit holding section 91 is shown in the figures.

The fixing unit 90 is a device that heats and pressurizes the toner image on the recording medium to fix the image onto the recording medium. The fixing unit 90 has: a fixing roller 302, which is an example of a "first roller"; a pressurizing roller 304, which is an example of a "second roller"; pressing members 310; grips 320, which are an example of a "handle"; support shafts 324, which are an example of a "support member"; parallel pins 332; a cam 336, which is an example of a "retaining member"; and a frame 350. The cam 336 is provided with a pin 342 and a second compression spring 346, which is an example of an "urging member". The frame 350 is provided with a pin-fitting hole 344, which is an example of a "hole".

Further, the fixing-unit holding section 91 and a later-described printer-body-side lever 622, which is an example of a "press-contact releasing member" are provided as the "peripheral members". The fixing-unit holding section 91 is provided with a projecting section 512, which is an example of a "canceling section".

The pin 342, the second compression spring 346, the pin-fitting hole 344, the projecting section 512, and so forth, make up a later-described "improper-attachment preventing section".

The fixing roller 302 heats the toner image on the recording medium and fuses the toner image onto the recording medium. The fixing roller 302 is provided so that its longitudinal direction is arranged in the longitudinal direction of the fixing unit 90. Further, as shown, for example, in FIG. 7, the fixing roller 302 has a rotation shaft 302*a* and a large-diameter section 302*b*, and is rotatable about the rotation shaft 302*a*. A heater (not shown) is provided inside the large-diameter section 302*b*, and the heat generated by the heater causes the toner image on the recording medium to be heated and become fixed onto the recording medium.

The pressurizing roller 304 operates in cooperation with the fixing roller 302 to pressurize the toner image on the recording medium. The pressurizing roller 304 is provided such that its longitudinal direction is arranged in the longitudinal direction of the fixing unit 90 and that it is positioned adjacent to the fixing roller 302. Further, as shown, for example, in FIG. 7, the pressurizing roller 304 has a rotation shaft 304*a* and a large-diameter section 304*b*, and is rotatable about the rotation shaft 304*a*.

Further, the pressurizing roller 304 is configured such that it can be pressed in contact against the fixing roller 302. When the fixing unit 90 fixes the toner image on the recording medium onto that recording medium, the pressurizing roller 304 presses against the fixing roller 302 via the recording medium, so that the toner image on the recording medium that is pinched between the fixing roller 302 and the pressurizing roller 304 is pressurized by these two rollers. It should be noted that as shown in FIG. 7 etc., the ends, in the longitudinal direction, of the pressurizing roller 304 (that is, the two outer portions of the large-diameter section 304*b*) are each provided with a grasped section 304*c* that is grasped by a later-described lever 312.

The pressing members 310 press the pressurizing roller 304 toward the fixing roller 302 so as to press the pressurizing roller 304 in contact against the fixing roller 302. As shown in FIG. 6 etc., one pressing member 310 is provided on both ends, in the longitudinal direction, of the fixing unit 90, and each pressing member 310 has a lever 312 and a tension spring 316, which is an example of a "spring".

As shown in FIG. 6 etc., the lever 312 has a rotation shaft 312*a* in its upper section, and a connecting section 312*b* for connection with the tension spring 316 in its lower section. Between the rotation shaft 312*a* and the connecting section 312*b* is provided a grasping section 312*c* for grasping the grasped section 304*c*. The lever 312 is configured such that, in a state where the grasping section 312*c* is grasping the grasped section 304*c* (i.e., in a state where the lever 312 is connected to the pressurizing roller 304), the lever 312 can rotate (e.g., pivot) about the rotation shaft 312*a*.

As shown in FIG. 6 etc., the tension spring 316 has hooks 316*a* and 316*b* at both ends; the hook 316*a* on one end side (on the left in FIG. 6) is connected to the connecting section 312*b* of the lever 312, and the hook 316*b* on the other end side (on the right in FIG. 6) is connected to the frame 350. The tension spring 316, with its tension force, pulls the lower section of the lever 312 (i.e., the connecting section 312*b* of the lever 312) to the side of the fixing roller 302 (in FIG. 6, the direction from the left toward the right).

In the pressing member 310 configured as above, since the rotation shaft 312*a* of the lever 312 is positioned in the upper section of the lever 312, the tension force of the tension spring 316 is transmitted to the lever 312 and thus converted into a rotation force of the lever 312 in the counterclockwise direction in FIG. 6. Accordingly, the pressurizing roller 304 that is grasped by the grasping section 312*c*, which is positioned between the rotation shaft 312*a* and the connecting section 312*b*, is pressed toward the fixing roller 302 by the rotation force exerted on the lever 312.

Further, a rotatable printer-body-side lever 622 is provided on the side of the printer body 12 and below the lever 312. The printer-body-side lever 622 rotates (e.g., pivots) in conjunction with the opening movement of the fourth side-surface cover 260, and achieves the function of releasing the press-contact of the pressurizing roller 304 against the fixing roller 302.

When the fourth side-surface cover 260 is closed, the printer-body-side lever 622 is positioned at a first rotated position shown in FIG. 6. When the printer-body-side lever 622 is positioned at the first rotated position, the printer-body-side lever 622 is not in contact with the lever 312, as shown in FIG. 6, and the pressurizing roller 304 is pressed in contact against the fixing roller 302 due to the lever 312 pressing against the pressurizing roller 304.

On the other hand, the printer-body-side lever 622 rotates in conjunction with the opening movement of the fourth side-surface cover 260, and rotates, in the counterclockwise direction in FIG. 8, from the first rotated position to a second rotated position shown in FIG. 8. When the printer-body-side lever 622 is positioned at the second rotated position, the printer-body-side lever 622 is in contact with the lever 312 as shown in FIG. 8 and presses the lower section of the lever 312 in a direction opposite from the direction in which the tension spring 316 is pulling the lever 312 (the direction from left to right in FIG. 6). Thus, in this state, the press-contact of the pressurizing roller 304, which is grasped by the grasping section 312*c* of the lever 312, against the fixing roller 302 is released as shown in FIG. 8. It should be noted that a stopper 650 for restricting the printer-body-side lever 622 from rotating beyond the second rotated position is provided in the vicinity of the printer-body-side lever 622.

In this way, when the fourth side-surface cover 260 is closed (for example, when the fixing unit 90 is fixing the toner image on the recording medium onto the recording medium), the pressing member 310 presses the pressurizing roller 304 toward the fixing roller 302 to make the pressurizing roller 304 be in press-contact with the fixing roller 302. (In other words, the tension spring 316 of the pressing member 310 urges the pressurizing roller 304 via the lever 312 to make the pressurizing roller 304 be in press-contact with the fixing roller 302.)

On the other hand, when the fourth side-surface cover 260 is opened by or more than a certain amount, the above-described action of the printer-body-side lever 622 prevents the pressurizing roller 304 from being pressed in contact against the fixing roller 302, even though the pressing member 310 is pressing the pressurizing roller 304 toward the fixing roller 302. It should be noted that the mechanism by which the printer-body-side lever 622 rotates in conjunction with the opening movement of the fourth side-surface cover 260 will be described in detail later on.

The grips 320 serve as a handle, as described further below, and also function as a holding section used for holding the fixing unit 90. As shown in FIG. 5 etc., the grips 320 are provided on the upper section of the fixing unit 90, and one each is provided at both ends, in the longitudinal direction, of the fixing unit 90.

Further, as shown in FIG. 6 etc., support shafts 324 for supporting the respective grips 320 are provided on the fixing unit 90 such that they protrude upward from the fixing-unit body 90*b*. An end 320*a*, in the longitudinal direction, of each grip 320 is fixed to the upper section of the corresponding support shaft 324.

Each support shaft 324 is configured such that it can be rotated (turned) about its axis. The grip 320 fixed to the support shaft 324 serves as a handle for rotating the support shaft 324. By the user etc. operating the grip 320 as a handle (more specifically, by the user etc. turning the handle) in a state where the fourth side-surface cover 260 is opened, the support shaft 324 can be rotated back and forth between a first rotated position shown in FIG. 6 through FIG. 9 and a second rotated position shown in FIG. 10 through FIG. 13. It should be noted that as shown in these figures, when the support shaft 324 is positioned at the first rotated position, the longitudinal direction of the grip 320 intersects with the longitudinal direction of the fixing-unit body 90*b*, whereas when the support shaft 324 is positioned at the second rotated position, the longitudinal direction of the grip 320 is parallel to the longitudinal direction of the fixing-unit body 90*b*.

The parallel pins 332 have the function of locking the fixing unit 90 to the printer body 12 as well as releasing the lock between the fixing unit 90 and the printer body 12. As shown in FIG. 7 etc., the parallel pins 332 are each fixed to the lower section of the corresponding support shaft 324 such that the support shaft 324 is positioned in the central section 332*a*, in the longitudinal direction, of the parallel pin 332. The parallel pin 332 is also configured such that, in conjunction with the back-and-forth rotation of the support shaft 324, it is rotated back and forth about the central section 332*a* in the longitudinal direction. It should be noted that when the support shaft 324 is positioned at the first rotated position as shown in FIG. 7 etc., the longitudinal direction of the parallel pin 332 is parallel to the longitudinal direction of the fixing-unit body 90*b*, whereas when the support shaft 324 is positioned at the second rotated position as shown in FIG. 11 etc., the longitudinal direction of the parallel pin 332 intersects with the longitudinal direction of the fixing-unit body 90*b*.

Further, as shown in FIG. 14 and FIG. 15, the fixing-unit holding section 91 is provided with parallel-pin insertion holes 502, into each of which the parallel pin 332 can be inserted when the fixing unit 90 is attached to the fixing-unit holding section 91.

When the fixing unit 90 is attached to the fixing-unit holding section 91 and the support shaft 324 is positioned at the second rotated position, the parallel pin 332 passes through the parallel-pin insertion hole 502 and is positioned below the hole 502 and the longitudinal direction of the parallel pin 332 is parallel to the longitudinal direction of the parallel-pin insertion hole 502, as shown in FIG. 10 and FIG. 11. When the support shaft 324 is rotated from the second rotated position to the first rotated position due to the grip 320 being operated, then, as shown in FIG. 8 and FIG. 9, the longitudinal direction of the parallel pin 332 intersects with the longitudinal direction of the parallel-pin insertion hole 502. In this state, the parallel pin 332 cannot pass through the parallel-pin insertion hole 502, and thus, the fixing unit 90 is locked to the fixing-unit holding section 91 (and to printer body 12).

Further, as shown in FIG. 14 and FIG. 15, the fixing-unit holding section 91 has stops 508 on the back side of the holding section 91 and one on each side of the parallel-pin insertion hole 502. Further, inside the cam 336 of the fixing unit 90 (described later), there is provided a first compression spring 340 (see FIG. 10 etc.) at a position between the frame 350 and an upper section of the cam 336. These members function to make the locking of the fixing unit 90 more reliable. More specifically, in a state where the longitudinal direction of the parallel pin 332 is parallel to the longitudinal direction of the parallel-pin insertion hole 502 (i.e., in a state before being locked), the stops 508 are not in contact with the parallel pin 332 as shown in FIG. 11, whereas in a state where the longitudinal direction of the parallel pin 332 intersects with the longitudinal direction of the parallel-pin insertion hole 502 (i.e., in the locked state), the stops 508 come into contact with the parallel pin 332 (the parallel pin 332 runs onto the stops 508) as shown in FIG. 8 and FIG. 9. Further, the first compression spring 340 presses the parallel pin 332 upwards via the cam 336 and the support shaft 324 due to it being interposed between the frame 350 and the upper section of the cam 336. Thus, pressing the parallel pin 332 against the stops 508 with the urging force of the first compression spring 340 allows for the fixing unit 90 to be locked reliably.

When the grip 320 is operated and the support shaft 324 is rotated from the first rotated position to the second rotated position in a state where the longitudinal direction of the parallel pin 332 intersects with the longitudinal direction of the parallel-pin insertion hole 502 (i.e., in the locked state), then the longitudinal direction of the parallel pin 332 becomes parallel to the longitudinal direction of the parallel-pin insertion hole 502 as shown in FIG. 10 and FIG. 11. In this state, the parallel pin 332 can pass through the parallel-pin insertion hole 502, and thus, the fixing unit 90 can be detached from the fixing-unit holding section 91 (printer body 12) and the lock between the fixing unit 90 and the printer body 12 will be released.

The cam 336 has the function of retaining the state in which the press-contact of the pressurizing roller 304 against the fixing roller 302 has been released by the printer-body-side lever 622. The cam 336 is fixed to the support shaft 324 between the grip 320 and the parallel pin 332, and is configured such that it is rotated back and forth in conjunction with the back-and-forth rotation of the support shaft 324.

As described above, when the fixing unit 90 is attached to the fixing-unit holding section 91 and the fourth side-surface cover 260 is opened by or more than a certain amount, the press-contact of the pressurizing roller 304 against the fixing roller 302 is released (see FIG. 8 and FIG. 9). Further, as shown in FIG. 8 and FIG. 9, when the support shaft 324 is positioned at the first rotated position, the cam 336 is located away from the lever 312.

Then, when, in this state, the grip 320 is operated and the support shaft 324 is rotated from the first rotated position to the second rotated position, the cam 336 moves (rotates) in conjunction with the movement of the grip 320 and the support shaft 324 and comes into contact with the lever 312 as shown in FIG. 10 and FIG. 11, and functions to retain the state in which the press-contact has been released. In this state, the cam 336 works so as to retain the state in which the press-contact has been released, even when the fixing unit 90 is in a state detached from the printer body 12 provided with the printer-body-side lever 622 (as shown in FIG. 12 and FIG. 13). It should be noted that when the cam 336 is moved (rotated) to bring it into contact with the lever 312, the lever 312 is rotated in the clockwise direction in FIG. 8. In this way, the lever 312 is disengaged from the printer-body-side lever 622 as shown in FIG. 10.

Further, as shown in FIG. 6 etc., the cam 336 is provided with a pin 342 and a second compression spring 346 for urging the pin 342 downward from above the pin 342. These members serve as a "restricting section" that work in cooperation with the pin-fitting hole 344 provided in the frame 350 to restrict the movement of the grip 320 and the support shaft 324.

More specifically, as shown in FIG. 12 and FIG. 13, when the fixing unit 90 is in a state detached from the fixing-unit holding section 91, the support shaft 324 is positioned at the second rotated position, and in this state, the pin 342 is urged downward by the second compression spring 346 and fitted into the pin-fitting hole 344. Thus, in this state, even when a user etc. attempts to operate the grip 320, the support shaft 324 will not rotate, so that the grip 320 will not rotate. As a result, the movement of the grip 320 and the support shaft 324 is restricted.

Further, as shown for example in FIG. 14 and FIG. 15, the fixing-unit holding section 91 has a projecting section 512 projecting upward, and this projecting section 512 serves as a "canceling section" for canceling the state in which the pin 342 is fitted into the pin-fitting hole 344. More specifically, the projecting section 512 is provided in a position where the pin 342 would come into contact when the fixing unit 90 is attached to a predetermined position (i.e., the correct position) of the fixing-unit holding section 91, as shown in FIG. 10 etc. When the fixing unit 90 is attached to the predetermined position, the pin 342 comes into contact with the projecting section 512 and is pressed upward thereby. Thus, the state in which the pin 342 is fitted into the pin-fitting hole 344 is canceled, and the grip 320 and the support shaft 324 become movable.

Since the pin 342 is provided in the cam 336 as described above, the pin 342 is now able to move along with the rotation of the cam 336, which moves in conjunction with the movement of the grip 320 and the support shaft 324. That is, when the grip 320 is operated and the support shaft 324 is rotated from the second rotated position to the first rotated position in a state where the fixing unit 90 is attached to the predetermined position (i.e., the correct position) of the fixing-unit holding section 91, the pin 342 will also move up to the position shown in FIG. 8 and FIG. 9.

It should be noted that, in case the fixing unit 90 is not attached to the predetermined position (i.e., the correct position), the pin 342 will not come into contact with the projecting section 512, and thus, the state in which the pin 342 is fitted into the pin-fitting hole 344 will be maintained without being canceled. Thus, even when the user etc. attempts to operate the grip 320, neither the grip 320 nor the support shaft 324 will rotate, and the state in which the movement of the grip 320 and the support shaft 324 is restricted will be maintained. In this way, the pin 342, the second compression spring 346, the pin-fitting hole 344, and the projecting section 512 function as an "improper-attachment preventing section" that prevents improper attachment of the fixing unit 90 by restricting the movement of the grip 320 and the support shaft 324 when the fixing unit 90 is not attached to the predetermined position (i.e., the correct position) of the fixing-unit holding section 91, and by allowing movement of the grip 320 and the support shaft 324 when the fixing unit 90 is attached to the predetermined position.

Example of How Fixing Unit and Its Peripheral Sections Operate Upon Attachment/Detachment of Fixing Unit According to First Embodiment Next, with reference to FIG. 5 through FIG. 15, an example of how the fixing unit 90 and its peripheral members operate upon attachment/detachment of the fixing unit 90 will be described.

Example of How Fixing Unit 90 and Peripheral Members Operate Upon Detachment of Fixing Unit 90

First, an example of how the fixing unit 90 and the peripheral members operate when the fixing unit 90 is being detached from the printer body 12 will be described.

[1. Initial State (FIG. 6 and FIG. 7)]

In this section, the initial state of the fixing unit 90 and the peripheral members, that is, the state of the fixing unit 90 and the peripheral members before the fixing unit 90 is detached from the printer body 12, will be described. In the initial state, the fixing unit 90 is in a state attached to the fixing-unit holding section 91 and locked to the printer body 12, and the fourth side-surface cover 260 is closed.

As described above, when the fourth side-surface cover 260 is closed, the printer-body-side lever 622 is not in contact with the lever 312, and the pressurizing roller 304 is pressed in contact against the fixing roller 302 due to the lever 312 being pressed against the pressurizing roller 304, as shown in FIG. 6 and FIG. 7.

Further, as shown in FIG. 6 and FIG. 7, the support shaft 324 is positioned at the first rotated position, and thus, the longitudinal direction of the grip 320 intersects with the longitudinal direction of the fixing-unit body 90*b*.

Further, as shown in FIG. 6 and FIG. 7, the longitudinal direction of the parallel pin 332 intersects with the longitudinal direction of the parallel-pin insertion hole 502 in a state where the parallel pin 332 is fitted into the parallel-pin insertion hole. That is, a state in which the parallel pin 332 cannot pass through the parallel-pin insertion hole 502, i.e. , a state in which the fixing unit 90 is locked to the fixing-unit holding section 91 (printer body 12), is maintained.

Further, as shown in FIG. 6 and FIG. 7, the cam 336 is located away from the lever 312, and the pin 342 provided in the cam 336 is located at a position where it is not in opposition to the projecting section 512 nor the pin-fitting hole 344.

[2. Operation of Fixing Unit 90 etc. When Opening Fourth Side-Surface Cover 260]

In order to detach the fixing unit 90 from the printer body 12, it is necessary for the user etc. to first open the fourth side-surface cover 260. In this section, the operation of the fixing unit 90 etc. when opening the fourth side-surface cover 260, that is, the operation of the fixing unit 90 etc. from the initial state shown in FIG. 6 and FIG. 7 to a state shown in FIG. 8 and FIG. 9, will be described.

As described above, in the initial state (see FIG. 6 and FIG. 7), the printer-body-side lever 622 is not in contact with the lever 312, and the pressurizing roller 304 is pressed in contact against the fixing roller 302 due to the lever 312 pressing the pressurizing roller 304.

When the user etc. opens the fourth side-surface cover 260, the printer-body-side lever 622 rotates in conjunction with the opening movement of the fourth side-surface cover 260, and finally comes in contact with the lever 312. Then, in conjunction with further opening movement of the fourth side-surface cover 260, the printer-body-side lever 622, which is now in contact with the lever 312, presses the lower section of the lever 312 (see FIG. 8) in a direction opposite from the direction in which the tension spring 316 is pulling the lever 312 (the direction from left to right in FIG. 6). This force is converted into a rotation force of the lever 312 in the clockwise direction in FIG. 8, and the press-contact of the pressurizing roller 304, which is grasped by the grasping section 312*c* of the lever 312, against the fixing roller 302 is released. That is, due to the printer-body-side lever 622 coming into contact with the lever 312 and rotating the lever 312, the printer-body-side lever 622 moves the pressurizing roller 304 and thereby releases the press-contact.

Then, when the printer-body-side lever 622 rotates up to the above-described second rotated position (FIG. 8), further rotation (i.e., rotation beyond the second rotated position) is restricted by the stopper 650, and the printer-body-side lever 622 stops in a state in which the press-contact has been released.

It should be noted that since, in this state (the state shown in FIG. 8 and FIG. 9), the fourth side-surface cover 260 is opened and the press-contact of the pressurizing roller 304 against the fixing roller 302 is released, it is possible to perform troubleshooting easily in this state when the fixing unit 90 is jammed up.

[3. Operation of Fixing Unit 90 etc. when Releasing Lock of Fixing Unit 90 and Detaching Fixing Unit 90]

In this section, the operation of the fixing unit 90 etc. when releasing the lock of the fixing unit 90 with respect to the printer body 12 and detaching the fixing unit 90 from the printer body 12, that is, the operation of the fixing unit 90 etc. from the state shown in FIG. 8 and FIG. 9 to the state shown in FIG. 12 and FIG. 13, via the state shown in FIG. 10 and FIG. 11, will be described.

In the state shown in FIG. 8 and FIG. 9, the longitudinal direction of the parallel pin 332 intersects with the longitudinal direction of the parallel-pin insertion hole 502 in a state where the parallel pin 332 is inserted into the parallel-pin insertion hole, and thus, the fixing unit 90 is locked to the fixing-unit holding section 91 (printer body 12).

The grip 320, which is used for holding the fixing unit 90, also serves as a "handle" for releasing the lock of the fixing unit 90 with respect to the printer body 12 when detaching the fixing unit 90 from the printer body 12. The lock is released when the user etc. turns the grip 320 by approximately 90 degrees in the clockwise direction in FIG. 9.

More specifically, when the user etc. turns the grip 320 by approximately 90 degrees in the clockwise direction in FIG. 9, the support shaft 324 is rotated from the first rotated position to the second rotated position, and as shown in FIG. 10 and FIG. 11, the longitudinal direction of the parallel pin 332 becomes parallel to the longitudinal direction of the parallel-pin insertion hole 502. In this state, the parallel pin 332 can pass through the parallel-pin insertion hole 502, and thus, the fixing unit 90 can be detached from the fixing-unit holding section 91 (printer body 12) and the lock between the fixing unit 90 and the printer body 12 will be released. It should be noted that as shown in FIG. 10 and FIG. 11, in a state where the lock is released, the longitudinal direction of the grip 320 is parallel to the longitudinal direction of the fixing-unit body 90*b* and the other end 320*b*, in the longitudinal direction, of the grip 320 is positioned on the outer side of the fixing-unit body 90*b*.

Further, when the lock between the fixing unit 90 and the printer body 12 is released as described above by the user etc. turning the grip 320, the state in which the press-contact of the pressurizing roller 304 against the fixing roller 302 has been released will be retained by the cam 336.

More specifically, in the state shown in FIG. 8 and FIG. 9, the press-contact of the pressurizing roller 304 against the fixing roller 302 is released and the cam 336 is located away from the lever 312; when, in this state, the support shaft 324 is rotated from the first rotated position to the second rotated position by the user etc. turning the grip 320, the cam 336 moves (rotates) in conjunction with the movement of the grip 320 and the support shaft 324 and comes into contact with the lever 312, as shown in FIG. 10 and FIG. 11. Further, when the cam 336 moves (rotates) and comes into contact with the lever 312, it causes the lever 312 to rotate, and thereby causes the lever 312 to disengage from the printer-body-side lever 622. In this way, the cam 336 maintains the state in which the press-contact of the pressurizing roller 304 against the fixing roller 302 is released.

In this way, the grip 320 not only serves as a handle for releasing the lock of the fixing unit 90 with respect to the printer body 12, but also serves as a handle for moving the cam 336 and making the cam 336 retain the press-contact released state.

Further, when the user etc. turns the grip 320 and the support shaft 324 is thereby rotated from the first rotated position to the second rotated position, the pin 342 provided in the cam 336 moves from the position shown in FIG. 8 and FIG. 9 to the position in opposition to the projecting section 512 and the pin-fitting hole 344 (see FIG. 10 and FIG. 11). At this time, the pin 342 comes into contact with the projecting section 512 and is pressed upward by the projecting section 512 (i.e., the pin 342 will not fit into the pin-fitting hole 344), and therefore, a state in which the grip 320 and the support shaft 324 are still movable is maintained.

Then, when the user etc., while keeping hold of the grip 320, lifts the fixing unit 90 upward after turning the grip 320, the fixing unit 90 is detached from the printer body 12 (see FIG. 12 and FIG. 13).

More specifically, in the state shown in FIG. 10 and FIG. 11, the lock between the fixing unit 90 and the printer body 12 is released and the parallel pin 332 can pass through the parallel-pin insertion hole 502. Therefore, by lifting the fixing unit 90 upward, the fixing unit 90 will be detached from the printer body 12, as shown in FIG. 12 and FIG. 13.

Further, when the fixing unit 90 is in a state detached from the printer body 12, the contact of the cam 336 against the lever 312 allows to maintain the state in which the press-contact of the pressurizing roller 304 against the fixing roller 302 has been released, as shown in FIG. 12 and FIG. 13.

Further, when the user etc. detaches the fixing unit 90 from the printer body 12 in a state where the lock of the fixing unit 90 is released (in a state where the press-contact released state is retained by the cam 336), the pin 342 disengages from the projecting section 512 and fits into the pin-fitting hole 344 by being urged downward by the second compression spring 346, as shown in FIG. 12. In this state, even when the user etc. attempts to operate the grip 320, neither will the support shaft 324 nor the grip 320 rotate, and thus, the movement of the grip 320 and the support shaft 324 will be restricted.

Example of How Fixing Unit 90 and Peripheral Members Operate Upon Attachment of Fixing Unit 90

Next, an example of how the fixing unit 90 and the peripheral members operate when the fixing unit 90 is being attached to the printer body 12 will be described. It should be noted that the operation of the fixing unit 90 etc. when it is attached to the printer body 12 is basically opposite from the above-described operation of the fixing unit 90 etc. when it is detached from the printer body 12. Detailed description is given below.

[1. Initial State (FIG. 12 and FIG. 13)]

In this section, the initial state of the fixing unit 90 and the peripheral members, that is, the state of the fixing unit 90 and the peripheral members before the fixing unit 90 is attached to the printer body 12, will be described. In the initial state, the fixing unit 90 is in a state detached from the fixing-unit holding section 91 and the fourth side-surface cover 260 is open. Needless to say, the lock of the fixing unit 90 with respect to the printer body 12 is in a released state.

As shown in FIG. 12 and FIG. 13, when the fixing unit 90 is in a detached state from the printer body 12, the longitudinal direction of the parallel pin 332 intersects with the longitudinal direction of the fixing-unit body 90*b*. Further, the longitudinal direction of the grip 320 is in the longitudinal direction of the fixing-unit body 90*b* and the other end 320*b*, in the longitudinal direction, of the grip 320 is positioned on the outer side of the fixing-unit body 90*b*.

Further, the cam 336 is in contact with the lever 312, and therefore, the press-contact of the pressurizing roller 304 against the fixing roller 302 is in a released state. Furthermore, the pin 342 is fitted into the pin-fitting hole 344, and therefore, the movement of the grip 320 and the support shaft 324 is restricted.

Moreover, when focusing on the printer body 12, the printer-body-side lever 622 is stopped at the above-described second rotated position as shown in FIG. 12 and FIG. 13, and further rotation from that position is restricted by the stopper 650.

[2. Operation of Fixing Unit 90 etc. when Attaching Fixing Unit 90 and Locking Fixing Unit 90]

In this section, the operation of the fixing unit 90 etc. when attaching the fixing unit 90 to the printer body 12 and locking the fixing unit 90 to the printer body 12 will be described. It should be noted that in this section, description will be given on the operations of the fixing unit 90 etc. when the fixing unit 90 is attached to the predetermined position (i.e., the correct position) of the printer body 12 (in other words, the operation of the fixing unit 90 etc. from the initial state shown in FIG. 12 and FIG. 13 to the state shown in FIG. 8 and FIG. 9, via the state shown in FIG. 10 and FIG. 11), as well as the operation of the fixing unit 90 etc. when the fixing unit 90 is not attached to the predetermined position.

When the user etc. holds the grip 320 and lowers the fixing unit 90 toward the fixing-unit holding section 91, the fixing unit 90 is attached to the printer body 12 (FIG. 10 and FIG. 11).

More specifically, the longitudinal direction of the parallel pin 332 intersects with the longitudinal direction of the fixing-unit body 90*b* in the state shown in FIG. 12 and FIG. 13, so that the parallel pin 332 can be inserted into the parallel-pin insertion hole 502. Thus, when the fixing unit 90 is attached to the printer body 12, the parallel pin 332 goes into the parallel-pin insertion hole 502 and comes to be positioned below the parallel-pin insertion hole 502, as shown in FIG. 10 and FIG. 11. It should be noted that at the time the fixing unit 90 is attached to the printer body 12, the lever 312 is located away from the printer-body-side lever 622.

When the fixing unit 90 is attached to the predetermined position (i.e., the correct position) of the fixing-unit holding section 91 (printer body 12), the pin 342 comes in contact with the projecting section 512 and the projecting section 512 presses the pin 342 upward, as shown in FIG. 10 and FIG. 11. Therefore, at this time, the state in which the pin 342 is fitted into the pin-fitting hole 344 is canceled, and the grip 320 and the support shaft 324 become movable (in other words, it becomes possible for the pin 342 to move in conjunction with the movement of the grip 320).

Then, when the user etc., while keeping hold of the grip 320, turns the grip 320 approximately 90 degrees in the counterclockwise direction in FIG. 11 after lowering the fixing unit 90, the fixing unit 90 is locked to the printer body 12 (see FIG. 8 and FIG. 9).

More specifically, in the state shown in FIG. 10 and FIG. 11, the longitudinal direction of the parallel pin 332 is in the longitudinal direction of the parallel-pin insertion hole 502 while the parallel pin 332 is in a state inserted through the parallel-pin insertion hole 502, and therefore, the lock of the fixing unit 90 with respect to the fixing-unit holding section 91 (printer body 12) is in a released state.

The grip 320, which is used to hold the fixing unit 90, also serves as a handle for locking the fixing unit 90 to the printer body 12 when the fixing unit 90 is attached to the printer body 12. When the user etc. turns the grip 320 approximately 90 degrees in the counterclockwise direction in FIG. 11, the support shaft 324 is rotated from the second rotated position to the first rotated position, and the longitudinal direction of the parallel pin 332 comes to intersect with the longitudinal direction of the parallel-pin insertion hole 502, as shown in FIG. 8 and FIG. 9. In this state, the parallel pin 332 cannot pass through the parallel-pin insertion hole 502, and thus, the fixing unit 90 is locked to the fixing-unit holding section 91 (printer body 12). It should be noted that as shown in FIG. 8 and FIG. 9, when the fixing unit 90 is locked, the longitudinal direction of the grip 320 comes to intersect with the longitudinal direction of the fixing-unit body 90*b*.

Further, when the support shaft 324 is rotated from the second rotated position to the first rotated position due to the user etc. turning the grip 320, the cam 336 that was in contact with the lever 312 moves (rotates) in conjunction with the movement of the grip 320 and the support shaft 324 and disengages from the lever 312, as shown in FIG. 8 and FIG. 9. The lever 312, however, comes into contact with the printer-body-side lever 622 during the course of the above-described movement of the cam 336, and therefore, the state in which the press-contact of the pressurizing roller 304 against the fixing roller 302 is released will be maintained (FIG. 8).

Further, when the support shaft 324 is rotated from the second rotated position to the first rotated position due to the user etc. turning the grip 320, the pin 342 provided in the cam 336 moves from the position shown in FIG. 10 and FIG. 11 to the position where it does not oppose the projecting section 512 nor the pin-fitting hole 344 (FIG. 8 and FIG. 9).

On the other hand, in case the fixing unit 90 is not attached to the predetermined position (i.e., the correct position) of the fixing-unit holding section 91 (printer body 12), the pin 342 does not come into contact with the projecting section 512, and thus the state in which the pin 342 is fitted into the pin-fitting hole 344 is maintained without being canceled. (In other words, the state in which the pin-fitting hole 344 restricts the pin 342 from moving in conjunction with the movement of the grip 320, is maintained.) Thus, in this state, even when the user etc. attempts to operate the grip 320, neither the grip 320 nor the support shaft 324 will rotate, and the state in which the movement of the grip 320 and the support shaft 324 is restricted will thus be maintained. In this way, when the fixing unit 90 is not attached to the predetermined position, the user etc. cannot turn the grip 320, and thus, it is not possible to lock the fixing unit 90 to the printer body 12.

Further, in this case, since the movement of the grip 320 is restricted, there is no chance that the cam 336 would move in conjunction with the movement of the grip 320 and the support shaft 324 and disengage from the lever 312. Accordingly, the press-contact released state, which is retained by the cam 336, can also be maintained.

[3. Operation of Fixing Unit 90 etc. when Closing Fourth Side-Surface Cover 260]

In order for the fixing unit 90 to operate, it is necessary for the fixing unit 90 to be attached to the predetermined position (i.e., the correct position) and be locked to the printer body 12, and then for the user etc. to close the fourth side-surface cover 260. In this section, the operation of the fixing unit 90 etc. when closing the fourth side-surface cover 260, that is, the operation of the fixing unit 90 etc. from the state shown in FIG. 8 and FIG. 9 to a state shown in FIG. 6 and FIG. 7, will be described.

As described above, in the state shown in FIG. 8 and FIG. 9, the printer-body-side lever 622 is in contact with the lever 312 and the press-contact of the pressurizing roller 304 against the fixing roller 302 is in a released state.

When the user etc. closes the fourth side-surface cover 260, the printer-body-side lever 622 rotates in conjunction with the closing movement of the fourth side-surface cover 260 and finally disengages from the lever 312. When the printer-body-side lever 622 disengages from the lever 312, the pressurizing roller 304 is pressed in contact against the fixing roller 302 due to the pressing force of the lever 312 pressing the pressurizing roller 304 (in other words, the urging force of the tension spring 316 urging the pressurizing roller 304 via the lever 312).

Figure 16:
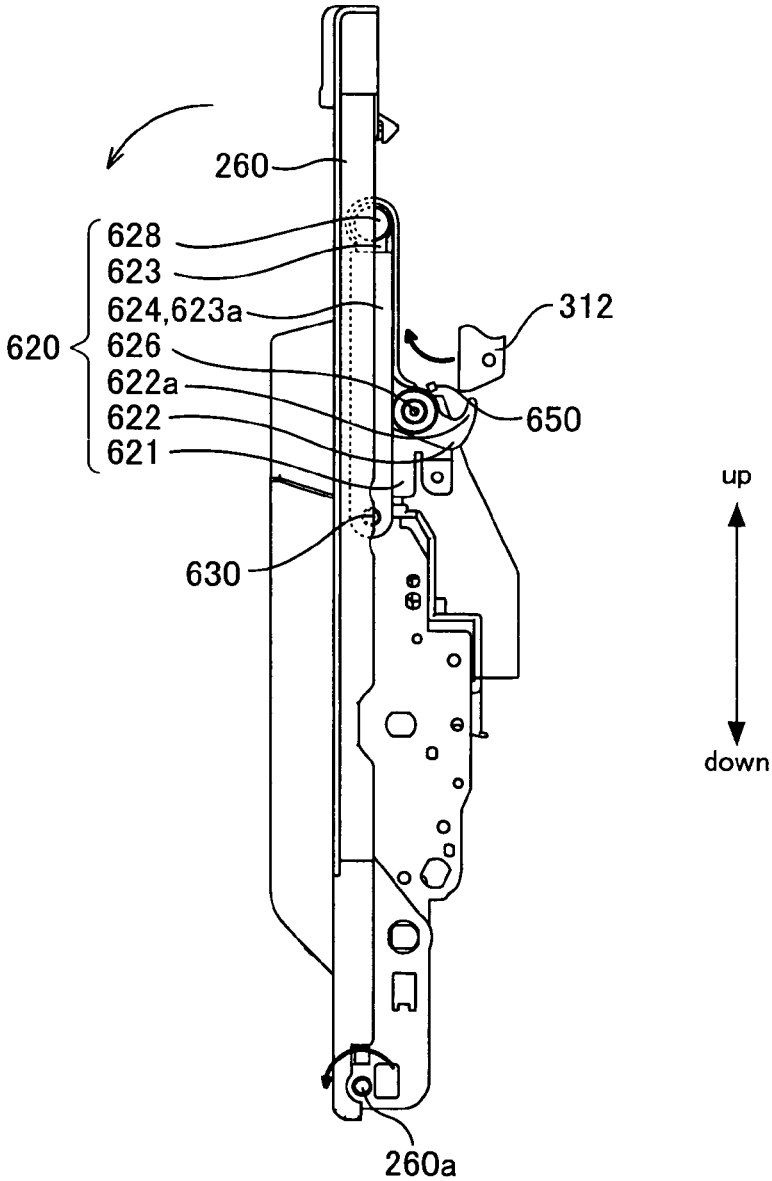
FIG. 16 is a diagram according to the first embodiment, showing a state of an arm 620 etc. when a fourth side-surface cover 260 is closed.
Figure 17:
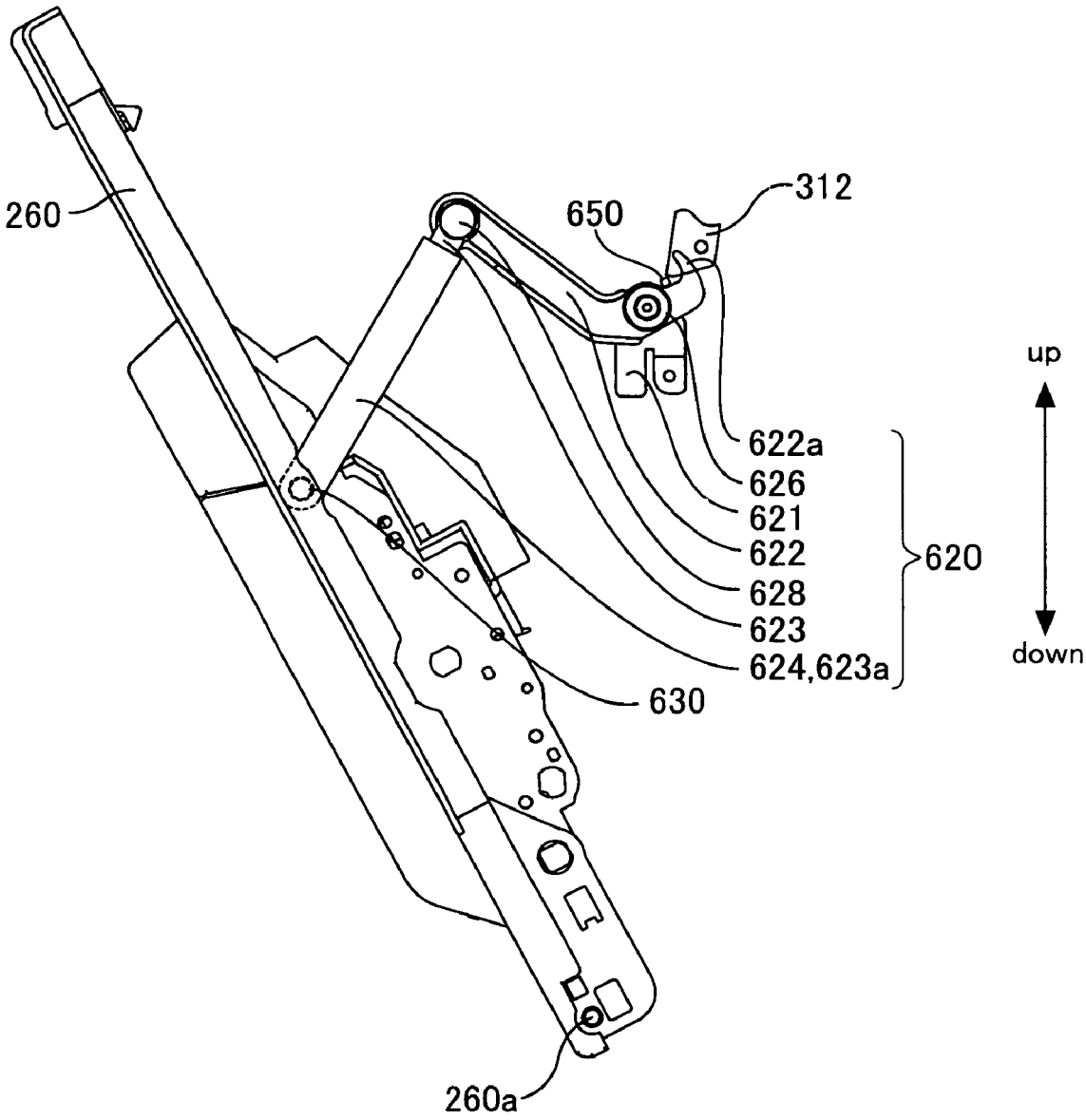
FIG. 17 is a diagram according to the first embodiment, showing a state of the arm 620 etc. when the fourth side-surface cover 260 is opened by or more than a certain amount and the press-contact of a pressurizing roller 304 against a fixing roller 302 is released.

Mechanism According to Which Printer-Body-Side Lever Rotates in Conjunction with Opening/Closing Movement of Fourth Side-Surface Cover of First Embodiment In this section, the mechanism according to which the printer-body-side lever 622 rotates in conjunction with the opening/closing movement of the fourth side-surface cover 260 will be described with reference to FIG. 16 and FIG. 17. FIG. 16 shows a state of an arm 620 etc. when the fourth side-surface cover 260 is closed. FIG. 17 shows a state of the arm 620 etc. when the fourth side-surface cover 260 is opened by or more than a certain amount and the press-contact of the pressurizing roller 304 against the fixing roller 302 is released. It should be noted that the arrows in FIG. 16 and FIG. 17 indicate the vertical direction.

The printer body 12 has, other than the printer-body-side lever 622, a fixed member 621, an intermediate member 623, and a sliding member 624, as structural elements of the above-described mechanism. A single arm 620 is made up of these and other members. It should be noted that two arms 620, one arm 620 on each end in the width direction of the fourth side-surface cover 260, are provided; however, since both arms 620 have substantially the same function etc., FIG. 16 and FIG. 17 show only one arm 620 on one end in the width direction, and below, the structure and operations of only the arm 620 on the above-mentioned end, in the width direction, will be described.

First, the structure of the above-mentioned mechanism (the arm 620) is described.

The fixed member 621 is fixed to a frame (not shown) of the printer body 12.

The printer-body-side lever 622 is rotatably supported on the fixed member 621 about a shaft 626. One end of the printer-body-side lever 622 is provided with a contacting section 622*a* that can come into contact with the lever 312 of the fixing unit 90. The other end of the printer-body-side lever 622 is rotatably connected to a shaft 628.

The intermediate member 623 is rotatably connected to the shaft 628 at one end. In this way, the intermediate member 623 can rotate relative to the printer-body-side lever 622 about the shaft 628. The other end of the intermediate member 623 is provided with a slide section 623*a*. (In FIG. 16 and FIG. 17, the slide section 623*a* is positioned inside the sliding member 624.)

The sliding member 624 slides with respect to the slide section 623*a*. The movement of the sliding member 624 is restricted by the slide section 623*a* such that the sliding member 624 slides only in a predetermined direction with respect to the slide section 623*a* (this predetermined direction is referred to as a "slide direction"). The static friction between the sliding member 624 and the slide section 623*a* allows for a force in the slide direction to be transmitted between the sliding member 624 and the slide section 623*a*. Further, the sliding member 624 is rotatably connected to a shaft 630 that is supported on the fourth side-surface cover 260.

It should be noted that when the fourth side-surface cover 260 is opened and closed, the shaft 626 does not move because it is fixed to the printer body 12. In contrast, since the shaft 630 is supported on the fourth side-surface cover 260 and the shaft 628 is not fixed, the shafts 628 and 630 can move in conjunction with the opening and closing of the fourth side-surface cover 260.

Next, an operation of the printer-body-side lever 622 rotating in conjunction with the opening movement of the fourth side-surface cover 260 is described below as an example of an operation of the mechanism having the structure described above. It should be noted that the operation of the printer-body-side lever 622 rotating in conjunction with the closing movement of the fourth side-surface cover 260 is basically opposite from the below-described operation in which the printer-body-side lever 622 rotates in conjunction with the opening movement of the fourth side-surface cover 260.

As shown in FIG. 16, in a state where the fourth side-surface cover 260 is closed, the arm 620 (the printer-body-side lever 622, the intermediate member 623, and the sliding member 624) is folded up in a compact manner. In this state, the printer-body-side lever 622 is in the above-described first rotated position and is not in contact with the lever 312.

When the user etc. pulls the closed fourth side-surface cover 260 frontward, the fourth side-surface cover 260 rotates about a connection shaft 260*a* in the counterclockwise direction (the direction shown by the arrow in FIG. 16). In conjunction with this rotation of the fourth side-surface cover 260, the shaft 630 supported on the fourth side-surface cover 260 moves about the connection shaft 260*a*.

Then, the sliding member 624 connected to the shaft 630 moves in conjunction with the movement of the shaft 630, and further, the intermediate member 623 moves in conjunction with the movement of the sliding member 624. At this time, the printer-body-side lever 622 receives a force in the slide direction from the intermediate member 623 via the shaft 628 and rotates about the shaft 626 in the counterclockwise direction in FIG. 16. As a result, the contacting section 622*a* of the printer-body-side lever 622 eventually comes into contact with the lever 312.

In conjunction with further opening movement of the fourth side-surface cover 260, the printer-body-side lever 622 rotates up to the above-described second rotated position (FIG. 17) while pressing the lever 312 in a state where the contacting section 622*a* is in contact with the lever 312. When the printer-body-side lever 622 reaches the second rotated position, further rotation (rotation beyond the second rotated position) is restricted by the above-described stopper 650, and the printer-body-side lever 622 stops.

When the user etc. further pulls the fourth side-surface cover 260 frontward in the state shown in FIG. 17, the sliding member 624 slides with respect to the slide section 623*a* of the intermediate member 623 and the arm from the shaft 628 to the shaft 630 will fully extend, while the printer-body-side lever 622 maintains its stopped state. In this way, the fourth side-surface cover 260 eventually reaches a fully-opened state.

Advantages of Printer Etc. According to First Embodiment

As described above, in the printer 10 according to the first embodiment, the fixing unit 90 is provided with a cam 336 adapted to retain a state in which the press-contact of the pressurizing roller 304 against the fixing roller 302 has been released by the printer-body-side lever 622. In this way, a printer 10 etc. with which the press-contact of the pressurizing roller 304 against the fixing roller 302 is reliably released even when the fixing unit 90 has been detached from the printer body 12, is achieved.

As described in the "BACKGROUND", in a printer 10 in which the fixing unit 90 can be attached to and detached from the printer body 12, there are instances in which the user etc. detaches the fixing unit 90 from the printer body 12. In a state where the fixing unit 90 is detached from the printer body 12, it is preferable that the press-contact of the pressurizing roller 304 against the fixing roller 302 is released, from the standpoint of preventing warping of the fixing roller 302 and the pressurizing roller 304, and from the standpoint of allowing troubleshooting to be carried out properly after the user etc. detaches the fixing unit 90 from the printer body 12 when the fixing unit 90 gets jammed.

When the user etc. detaches the fixing unit 90 from the printer body 12, the user etc. will first open the fourth side-surface cover 260 and then take the fixing unit 90 off. As described above, when the fourth side-surface cover 260 is opened, the printer-body-side lever 622 moves together with the opening movement of the fourth side-surface cover 260 to release the press-contact.

When, however, the fixing unit 90 is once detached from the printer body 12, the fixing unit 90 will be moved to a location far away from the printer-body-side lever 622. Thus, the function of the printer-body-side lever 622 of releasing the press-contact will no longer be achieved. As a result, the pressurizing roller 304 may get pressed in contact against the fixing roller 302 when the fixing unit 90 is in a state detached from the printer body 12.

In contrast, in the printer 10 according to the first embodiment, the fixing unit 90 is provided with a cam 336 adapted to retain a state in which the press-contact of the pressurizing roller 304 against the fixing roller 302 has been released. In this way, the press-contact released state is maintained even when the fixing unit 90 is detached from the printer body 12.

That is, as described above, when the grip 320 is operated at the time the user etc. detaches the fixing unit 90 from the printer body 12, the cam 336 moves (rotates) in conjunction with the movement of the grip 320 and comes into contact with the lever 312. In this state, even when the fixing unit 90 is detached from the printer body 12 and moved far away from the printer-body-side lever 622, the state in which the press-contact is released will be maintained thanks to the action of the cam 336 provided in the fixing unit 90.

Accordingly, it is possible to achieve a printer 10 with which the press-contact is reliably released even when the fixing unit 90 has been detached from the printer body 12, and it is possible to attain advantages such as preventing warping of the fixing roller 302 and the pressurizing roller 304 and allowing troubleshooting to be carried out properly after the user etc. detaches the fixing unit 90 from the printer body 12 when the fixing unit 90 gets jammed.

Further, the fixing unit 90 according to the first embodiment has a grip 320 used for holding the fixing unit 90, and this grip 320 is a handle adapted to lock the fixing unit 90 to the printer body 12 when the fixing unit 90 is attached to the printer body 12. By making the grip 320 function both as a grip used for holding the fixing unit 90 and a handle for locking the fixing unit 90 to the printer body 12, a fixing unit 90 etc. having a high level of convenience for users etc. is achieved.

As described in the "BACKGROUND", when the user etc. attaches the fixing unit 90 to the printer body 12, the user etc. will carry out, as a series of operations, an operation of holding and carrying the fixing unit 90 to a fixing-unit holding section 91 provided in the printer body 12 and an operation of locking the fixing unit 90 to the printer body 12.

If the grip used for holding the fixing unit 90 and the handle for locking the fixing unit 90 to the printer body 12 are separate structural members, then, when the user etc. attaches the fixing unit 90 to the printer body 12, the user etc. will have to perform an operation of taking his/her hand off from the grip and then grasping the handle between the operation of carrying the fixing unit 90 to the fixing-unit holding section 91 and the operation of locking the fixing unit 90 to the printer body 12. In such a case, it cannot be said that the series of operations are being carried out smoothly.

In contrast, in the fixing unit 90 according to the present embodiment, since the grip used for holding the fixing unit 90 and the handle for locking the fixing unit 90 to the printer body 12 are the same structural member, the operation of releasing the grip and then grasping the handle is omitted. Therefore, the series of operations described above can be carried out smoothly and a fixing unit 90 that is highly convenient for users etc. is achieved.

Further, the fact that the grip used for holding the fixing unit 90 and the handle for locking the fixing unit 90 to the printer body 12 are the same structural member also allows for the fixing unit 90 according to the present embodiment to achieve various other advantages.

First, in such a fixing unit 90 of the present embodiment, the number of components can be reduced, thereby being advantageous in terms of cost.

Further, the grip (handle) can be made large in size so that the user etc. can operate it easily. (In contrast, in cases where the grip and the handle are separate members, they will have to be made small due to limitations in installation space.)

Further, the grip (handle) can be provided in the central section with respect to the width direction of the fixing unit 90 (the direction shown in FIG. 5; that is, the direction intersecting with both the longitudinal direction of the fixing unit 90 and the vertical direction). When the grip (handle) is provided in the central section with respect to the width direction of the fixing unit 90, the position (posture) of the fixing unit 90 when the user etc. holds the fixing unit 90, or when the fixing unit 90 is locked to the printer body 12, becomes stable. Therefore, in cases where the grip and the handle are the same structural member, the grip (handle) can be provided at a position that is preferable for making the posture of the fixing unit 90 stable. (In contrast, in cases where the grip and the handle are separate members, it would be difficult to provide both members at a position that is preferable for making the posture of the fixing unit 90 stable, that is, provide both members in the central section in the width direction of the fixing unit 90, due to limitations in installation space.)

Further, in the foregoing embodiment, the grip 320 is a handle for releasing the lock of the fixing unit 90 with respect to the printer body 12 when detaching the fixing unit 90 from the printer body 12. By providing the grip 320 with the function as a handle for releasing the lock between the fixing unit 90 and the printer body 12, in addition to the above-mentioned two functions, it is possible to achieve a fixing unit 90 etc. that is even more convenient for users etc.

More specifically, when a user etc. detaches the fixing unit 90 from the printer body 12, the user etc. will perform the operation of releasing the lock of the fixing unit 90 with respect to the printer body 12 and the operation of lifting up the fixing unit 90 from the fixing-unit holding section 91 of the printer body 12, as a series of operations.

If the grip used for holding the fixing unit 90 and the handle for releasing the lock of the fixing unit 90 with respect to the printer body 12 are separate members, the user etc. will have to perform an operation of taking his/her hand off from the handle and then grasping the grip between the operation of releasing the lock of the fixing unit 90 with respect to the printer body 12 and the operation of lifting up the fixing unit 90 from the fixing-unit holding section 91, when detaching the fixing unit 90 from the printer body 12. In such a case, it cannot be said that the series of operations are being carried out smoothly.

In contrast, in the fixing unit 90 according to the present embodiment, since the grip used for holding the fixing unit 90 and the handle for releasing the lock of the fixing unit 90 with respect to the printer body 12 are the same structural member, the operation of releasing the handle and then grasping the grip is omitted. Therefore, the series of operations described above can be carried out smoothly and a fixing unit 90 that is even more convenient for users etc. is achieved.

Further, the printer 10 according to the first embodiment has: a fixing unit 90 that is attachable to a printer body 12 and that has a grip 320 adapted to lock the fixing unit 90 to the printer body 12 when the fixing unit 90 is attached to the printer body 12; and an improper-attachment preventing section that prevents the fixing unit 90 from being attached improperly, by restricting movement of the grip 320 when the fixing unit 90 is not attached to a predetermined position of the printer body 12, and allowing movement of the grip 320 when the fixing unit 90 is attached to the predetermined position. In this way, a printer 10 that can let users etc. know that a fixing unit 90 has not been attached properly at an early stage, is achieved.

As described in the "BACKGROUND", when the user etc. attaches a fixing unit 90 to the printer body 12, there is a possibility that the user etc. may make an error in operation and the fixing unit 90 may not be attached in a predetermined position (i.e., the correct position) of the printer body 12. In such a case, various problems (such as malfunctioning or damaging of the fixing unit 90 due to the printer 10 operating without the fixing unit 90 being attached in the predetermined position) may arise. Therefore, it is necessary to let the user etc. know that the fixing unit 90 has not been attached properly when the fixing unit 90 is not attached properly.

Further, when the fixing unit 90 has not been attached in the predetermined position, the user etc. will have to attach the fixing unit 90 again in the predetermined position (i.e., reattach the fixing unit 90). In order to allow the user etc. to carry out this reattachment smoothly, it is preferable to let the user etc. know that the fixing unit 90 has not been attached properly immediately after the user etc. attaches the fixing unit 90 in a position other than the predetermined position (i.e., the incorrect position).

This is described in detail by giving an example. As a printer 10 that lets a user etc. know that the fixing unit 90 has not been attached properly, it is possible to conceive a printer 10 that notifies the user etc. of improper attachment of the fixing unit 90 by not allowing the fourth side-surface cover 260 to close when the fixing unit 90 is not attached to the predetermined position of the printer body 12, or a printer 10 that notifies the user etc. of improper attachment of the fixing unit 90 by outputting an error message from an information outputting section of the control panel after the fourth side-surface cover 260 has been closed.

In such printers 10, however, the user etc. cannot know that the fixing unit 90 has been attached improperly until the user etc. closes the fourth side-surface cover 260, and therefore, the user etc. is not notified of improper attachment of the fixing unit 90 immediately after the user etc. attaches the fixing unit 90 to a position (incorrect position) other than the predetermined position. Thus, in such printers 10, the user etc. will have to reopen the fourth side-surface cover 260 after he/she recognizes that the fixing unit 90 has been attached improperly and then reattach the fixing unit 90 to the predetermined position, which means that the reattachment by the user etc. cannot be carried out smoothly.

In contrast, the printer 10 according to the present embodiment lets the user etc. know that the fixing unit 90 has not been attached properly by restricting movement of the grip 320 by means of the improper-attachment preventing section so as to disable the above-mentioned lock when the fixing unit 90 is not attached to the predetermined position. Since attachment of the fixing unit 90 to the printer body 12 and the locking of the fixing unit 90 to the printer body 12 are carried out as a series of operations by the user etc., with the above configuration, the user etc. will be able to recognize the improper attachment of the fixing unit 90 immediately after the user etc. attaches the fixing unit 90 to a position (incorrect position) other than the predetermined position.

As described above, with the printer 10 according to the present embodiment, the user etc. can recognize the improper attachment of the fixing unit 90 at an early state. Accordingly, it is possible for the user etc. to carry out reattachment of the fixing unit 90 smoothly.

Other Embodiments of First Embodiment

In the foregoing, a fixing unit, a printer, etc. according to the present invention were described according to the foregoing first embodiment. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing first embodiment, an intermediate-transferring-type full-color laser-beam printer was described as an example of an image forming apparatus. The present invention, however, is applicable to various types of image forming apparatuses such as full-color laser-beam printers of types other than the intermediate-transferring type, monochrome laser-beam printers, copying machines, and facsimile machines.

Further, the photoconductor is not limited to the so-called photoconductive roller in which a photoconductive layer is provided on the outer circumferential surface of a cylindrical, conductive base. The photoconductor can be, for example, a so-called photoconductive belt structured by providing a photoconductive layer on a surface of a belt-like conductive base.

In the foregoing first embodiment, an example was described in which the first roller is the fixing roller 302 and the second roller is the pressurizing roller 304. This, however, is not a limitation, and the first roller may be the pressurizing roller 304 and the second roller may be the fixing roller 302.

Further, in the foregoing first embodiment, the fixing unit 90 had a grip 320; and when the grip 320 is operated, the cam 336 moved in conjunction with the movement of the grip 320 and retained the state in which the press-contact has been released. This, however, is not a limitation. For example, the detachment of the fixing unit 90 may be detected and the cam 336 may automatically be moved according to the detection result, so that the press-contact released state is retained.

The foregoing first embodiment, however, is more preferable in terms that it is possible to obtain the above-described effect, i.e., the effect that it is possible to achieve an printer 10 with which the press-contact is reliably released even when the fixing unit 90 has been detached from the printer body 12, with a simple structure.

Further, in the foregoing first embodiment, the grip 320 was adapted to release a lock of the fixing unit 90 with respect to the printer body 12 when the fixing unit 90 is detached from the printer body 12; and the lock of the fixing unit 90 with respect to the printer body 12 was released when the grip 320 is operated and the state in which the press-contact has been released is retained by the cam 336. This, however, is not a limitation. For example, the handle for moving the cam 336 and making the cam 336 retain the press-contact released state and the handle for releasing the lock of the fixing unit 90 with respect to the printer body 12 when the fixing unit 90 is detached from the printer body 12, may be separate structural members, and the above two functions may be achieved by operating those handles separately.

The foregoing first embodiment, however, is more preferable in terms that the press-contact released state is retained at the same time as the releasing of the lock, which is inevitably performed when detaching the fixing unit 90 from the printer body 12, and therefore, it is possible to suitably avoid a situation in which the user etc. forgets to operate the handle to retain the press-contact released state with the cam 336.

Further, in the foregoing first embodiment, the fixing unit 90 had a pressing member 310 adapted to press the pressurizing roller 304 toward the fixing roller 302 to make the pressurizing roller 304 be pressed in contact against the fixing roller 302; and the pressing member 310 was provided with a tension spring 316. This, however, is not a limitation, and the tension spring 316 does not necessarily have to be provided.

However, by providing the tension spring 316 in/on the pressing member 310, it not only becomes possible to obtain the effect that the press-contact of the pressurizing roller 304 against the fixing roller 302 is prevented even when the fixing unit 90 has been detached from the printer body 12, but it also becomes possible to obtain the effect that an impact that occurs when the pressurizing roller 304 is pressed in contact against the fixing roller 302 due to the urging force of the tension spring 316 can be prevented from being applied to the user etc., by retaining the press-contact released state with the cam 336. The foregoing first embodiment is therefore more effective in this sense.

Further, in the foregoing first embodiment, the pressing member 310 had a rotatable lever 312 that is connected to the tension spring 316 and the pressurizing roller 304; and the printer-body-side lever 622 came into contact with the lever 312 to make the lever 312 rotate, make the pressurizing roller 304 move, and release the press-contact. This, however, is not a limitation, and the function of releasing the press-contact achieved by the printer-body-side lever 622 may be achieved through another configuration. For example, the connecting member that connects the tension spring 316 and the pressurizing roller 304 does not have to be a rotatable lever, and the printer-body-side lever 622 may be configured to come into contact with the connecting member and thereby shift the position of the connecting member so as to move the pressurizing roller 304.

Further, in the foregoing first embodiment, the cam 336 moved and came into contact with the lever 312 to retain the state in which the press-contact has been released. This, however, is not a limitation, and the function of retaining the press-contact released state achieved by the cam 336 may be achieved through another configuration.

Further, in the foregoing first embodiment, when the cam 336 moved and came into contact with the lever 312, the cam 336 made the lever 312 rotate to disengage the lever 312 from the printer-body-side lever 622. This, however, is not a limitation. For example, the cam 336 may be configured such that it does not make the lever 312 disengage from the printer-body-side lever 622 (i.e., the printer-body-side lever 622 and the lever 312 may be kept in the contacting state) when the cam 336 moves and comes into contact with the lever 312.

In cases where the printer-body-side lever 622 and the lever 312 maintain the contacting state when the cam 336 moves and comes into contact with the lever 312, there is a possibility that smooth detachment/attachment of the fixing unit 90 is inhibited due to interference between the lever 312, which is provided on the fixing unit 90, and the printer-body-side lever 622, which is provided on the printer body 12, when the fixing unit 90 is detached from the printer body 12 or when the fixing unit 90 is attached to the printer body 12 by the user etc. In contrast, with the printer 10 according to the foregoing first embodiment, such an inconvenience will not arise. The printer 10 of the foregoing first embodiment is therefore more preferable.

Further, in the foregoing first embodiment, the grip 320 was a handle adapted to release the lock of the fixing unit 90 with respect to the printer body 12 when the fixing unit 90 is detached from the printer body 12. This, however, is not a limitation. For example, the handle for releasing the lock of the fixing unit 90 with respect to the printer body 12 may be a structural member separate from the grip 320.

Further, in the foregoing first embodiment, two grips 320 were provided on an upper section of the fixing unit 90, one each being provided at both ends, in a longitudinal direction, of the fixing unit 90. This, however, is not a limitation. For example, a single grip 320 may be provided, or grip(s) 320 may be provided on an upper section and in a central section, in the longitudinal direction, of the fixing unit 90.

The foregoing first embodiment, however, is preferable in terms that the user etc. can hold the fixing unit 90 reliably and easily and also lock the fixing unit to the printer body 12 more reliably.

Further, in the foregoing first embodiment, a support shaft 324 adapted to support the grip 320 was provided on the fixing unit 90 in such a manner that the support shaft 324 projects upward from a fixing-unit body 90*b*, and one end 320*a*, in a longitudinal direction, of the grip 320 is fixed to the support shaft 324; and in a state where the lock is released, the longitudinal direction of the grip 320 was parallel to the longitudinal direction of the fixing-unit body 90*b*. This, however, is not a limitation. For example, the longitudinal direction of the grip 320 may intersect with the longitudinal direction of the fixing-unit body 90*b* in a state where the above-described lock is released.

The foregoing first embodiment, however, is preferable in terms that the user etc. can hold the fixing unit 90 reliably and easily.

Further, in the foregoing first embodiment, in a state where the lock is released, the other end 320*b*, in the longitudinal direction, of the grip 320 was positioned on an outer side of the fixing-unit body 90*b* in the longitudinal direction of the fixing-unit body 90*b*. This, however, is not a limitation. For example, the other end 320*b*, in the longitudinal direction, of the grip 320 may be positioned on the inner side of the fixing-unit body 90*b* in the longitudinal direction of the fixing-unit body 90*b* in a state where the lock is released.

When the other end 320*b*, in the longitudinal direction, of the grip 320 is positioned on the outer side of the fixing-unit body 90*b* in a state where the lock is released, the grip 320 will be positioned farther from the fixing roller 302 compared to when the other end 320*b* is positioned on the inner side. Therefore, it is possible to prevent any negative influence of the heat, which is generated by the fixing roller 302, to the hand more suitably when the user etc. holds or operates the grip 320. The foregoing first embodiment is therefore more preferable in this sense.

Further, in the foregoing first embodiment, the fixing unit 90 further included a restricting section adapted to restrict movement of the grip 320 when the lock has been released due to the grip 320 having been operated. This, however, is not a limitation, and such a restricting section does not necessarily have to be provided.

In cases where the fixing unit 90 is provided with such a restricting section, movement of the grip 320 will be restricted when the user etc. uses the grip 320 to hold the fixing unit 90, and therefore, the user etc. will be able to hold the fixing unit 90 reliably. The foregoing first embodiment is therefore more preferable in this sense.

Further, in the foregoing first embodiment, the restricting section included a pin 342 that moves in conjunction with the movement of the grip 320, and a pin-fitting hole 344 into which the pin 342 can be fitted; and the movement of the grip 320 was restricted as a result of the pin 342 fitting into the pin-fitting hole 344 when the lock has been released due to the grip 320 having been operated. The structure of the restricting section, however, is not limited to the above.

The foregoing first embodiment, however, is more preferable in terms that the above-described effect, that is, the effect that the user etc. can hold the fixing unit 90 reliably, can be obtained with a simple configuration.

Further, in the foregoing first embodiment, the printer 10 further included an openable and closable fourth side-surface cover 260; the fixing unit 90 further included a fixing roller 302 and a pressurizing roller 304 that can be pressed in contact against the fixing roller 302, and fixes the toner image, which is formed on the recording medium that is pinched between the fixing roller 302 and the pressurizing roller 304 being pressed in contact against the fixing roller 302 via the recording medium, onto that recording medium in a state where the fourth side-surface cover 260 is closed; the printer 10 further included a printer-body-side lever 622 adapted to release the press-contact of the pressurizing roller 304 against the fixing roller 302 in conjunction with an opening movement of the fourth side-surface cover 260; the fixing unit 90 further included a cam 336 adapted to retain a state in which the press-contact has been released by the printer-body-side lever 622; the grip 320 was a handle adapted to move the cam 336 to make the cam 336 retain the state in which the press-contact has been released; and the state in which the press-contact has been released was retained by the cam 336 when the grip 320 is operated and the lock is released. That is, the grip 320 also had the function as a handle adapted to move the cam 336 to make the cam 336 retain the state in which the press-contact has been released. This, however, is not a limitation, and the grip 320 does not necessarily have to be provided with this function.

However, in cases where the grip 320 is also provided with the function as a handle for making the cam 336 retain the state in which the press-contact has been released, it is not necessary to provide a separate handle having such a function. The foregoing first embodiment is therefore more preferable.

Further, in the foregoing first embodiment, the fixing unit 90 further included a restricting section adapted to restrict movement of the grip 320 when the lock has been released and the state in which the press-contact has been released is being retained by the cam 336 due to the grip 320 having been operated. This, however, is not a limitation, and such a restricting section does not necessarily have to be provided.

However, in cases where the fixing unit 90 is provided with such a restricting section, not only is it possible to obtain the effect that movement of the grip 320 is restricted when the user etc. uses the grip 320 for holding the fixing unit 90, but it is also possible to obtain the effect that the press-contact released state retained by the cam 336 can be maintained more appropriately by restricting the movement of the grip 320. The foregoing first embodiment is therefore more preferable.

Further, in the foregoing first embodiment, a fixing unit 90 was described as an example of a unit that is attachable to the printer body 12 and that has a handle adapted to lock the unit to the printer body 12 when the unit is attached to the printer body 12. This, however, is not a limitation. Any unit is applicable as long as it is a unit that is attachable to the printer body 12 and that has a handle adapted to lock the unit to the printer body 12 when the unit is attached to the printer body 12.

Further, in the foregoing first embodiment, the improper-attachment preventing section restricted the movement of the grip 320 when the fixing unit 90 is in a state detached from the printer body 12. This, however, is not a limitation. For example, the movement of the grip 320 may be permitted in such a state.

However, in cases where the movement of the grip 320 is restricted when the fixing unit 90 is in a state detached from the printer body 12, the grip 320 can be used as a holding section used for holding the fixing unit 90. The foregoing first embodiment is therefore more preferable in this sense.

Further, in the foregoing first embodiment, the improper-attachment preventing section included a pin 342 that is provided in the fixing unit 90 and that is movable in conjunction with the movement of the grip 320, and a pin-fitting hole 344 that is also provided in the fixing unit 90 and into which the pin 342 can be fitted; the pin 342 was fitted into the pin-fitting hole 344 when the fixing unit 90 is in a state detached from the printer body 12; when the fixing unit 90 is not attached to the predetermined position, a state in which the pin 342 is fitted into the pin-fitting hole 344 was maintained and the pin-fitting hole 344 restricted the movement of the pin 342 in conjunction with the movement of the grip 320; and when the fixing unit 90 is attached to the predetermined position, the state in which the pin 342 is fitted into the pin-fitting hole 344 was canceled and the movement of the pin 342 in conjunction with the movement of the grip 320 was allowed. This, however, is not a limitation.

The foregoing first embodiment, however, is more preferable in terms that it is possible to achieve the improper-attachment preventing section having the above-mentioned function using a simple configuration consisting of a pin 342 and a pin-fitting hole 344.

Further, in the foregoing first embodiment, the improper-attachment preventing section further included a canceling section that is provided in the printer body 12 and that is adapted to cancel the state in which the pin 342 is fitted into the pin-fitting hole 344; and when the fixing unit 90 is not attached to the predetermined position, the canceling section did not cancel the state in which the pin 342 is fitted into the pin-fitting hole 344, and when the fixing unit 90 is attached to the predetermined position, the canceling section canceled the state in which the pin 342 is fitted into the pin-fitting hole 344. This, however, is not a limitation. For example, the canceling section may be provided on the fixing unit 90 and not the printer body 12.

Further, in the foregoing first embodiment, the canceling section was a projecting section 512 projecting upward; and when the fixing unit 90 is attached to the predetermined position, the pin 342 came into contact with the projecting section 512 and the projecting section 512 pushed the pin 342 up to cancel the state in which the pin 342 is fitted into the pin-fitting hole 344, and when the fixing unit 90 is not attached to the predetermined position, the pin 342 did not come into contact with the projecting section 512 and the state in which the pin 342 is fitted into the pin-fitting hole 344 was maintained. This, however, is not a limitation. For example, the canceling section may come into contact with the pin 342 regardless of whether the fixing unit 90 is attached to the predetermined position or not, and the canceling section may be configured to actuate and push the pin 342 upward when the fixing unit 90 is attached to the predetermined position and to not actuate, and therefore not push the pin 342 upward, when the fixing unit 90 is not attached to the predetermined position.

The foregoing first embodiment, however, is more preferable in terms that it is possible to achieve the improper-attachment preventing section having the above-mentioned function with a simple configuration.

Further, in the foregoing first embodiment, the improper-attachment preventing section further included a second compression spring 346 provided in the fixing unit 90 and adapted to urge the pin 342 downward. This, however, is not a limitation, and the second compression spring 346 does not necessarily have to be provided.

The foregoing first embodiment, however, is more preferable in terms that the state in which the pin 342 is fitted into the pin-fitting hole 344 is reliably maintained when, for example, the fixing unit 90 is not attached to the predetermined position.

Further, in the foregoing first embodiment, the printer 10 further included an openable and closable fourth side-surface cover 260; the fixing unit 90 further included a fixing roller 302 and a pressurizing roller 304 that can be pressed in contact against the fixing roller 302, and fixed the toner image, which is formed on the recording medium that is pinched between the fixing roller 302 and the pressurizing roller 304 being pressed in contact against the fixing roller 302 via the recording medium, onto that recording medium in a state where the fourth side-surface cover 260 is closed; the printer 10 further included a printer-body-side lever 622 adapted to release the press-contact of the pressurizing roller 304 against the fixing roller 302 in conjunction with an opening movement of the fourth side-surface cover 260; the fixing unit 90 further included a cam 336 adapted to retain a press-contact released state in which the press-contact has been released by the printer-body-side lever 622; the grip 320 was a handle adapted to release the lock of the fixing unit 90 with respect to the printer body 12 when the fixing unit 90 is detached from the printer body 12, and also adapted to move the cam 336 to make the cam 336 retain the state in which the press-contact has been released; and if the fixing unit 90 is not attached to the predetermined position when being attached to the printer body 12, the improper-attachment preventing section restricted the movement of the grip 320 to maintain the press-contact released state that is retained by the cam 336. This, however, is not a limitation. For example, the improper-attachment preventing section does not necessarily have to be provided with the function of maintaining the press-contact released state retained by the cam 336.

From the viewpoint of preventing warping of the fixing roller 302 and the pressurizing roller 304, it is preferable that the press-contact of the pressurizing roller 304 against the fixing roller 302 is released when the fixing unit 90 is in a state detached from the printer body 12.

With the foregoing first embodiment, the improper-attachment preventing section not only has the function of letting the user etc. know that the fixing unit 90 has not been attached properly, but also the function of maintaining the press-contact released state retained by the cam 336 when the fixing unit 90 is not attached correctly to the printer body 12. Therefore, even when the user etc. detaches the fixing unit 90 from the printer body 12 in order to re-attach the fixing unit 90, the press-contact released state will be retained by the cam 336, and thus, the above-mentioned warping can be suitably prevented. The foregoing first embodiment is therefore more preferable.

Second Embodiment

Configuration Example of Fixing Unit, and Its Periphery, According to Second Embodiment Next, with reference to FIG. 18 through FIG. 22, description will be made on a configuration example of the fixing unit 90 and members of the printer body 12 located in the periphery of the fixing unit 90 when the fixing unit 90 is attached to the printer body 12 (also referred to as "peripheral members").

Figure 18:
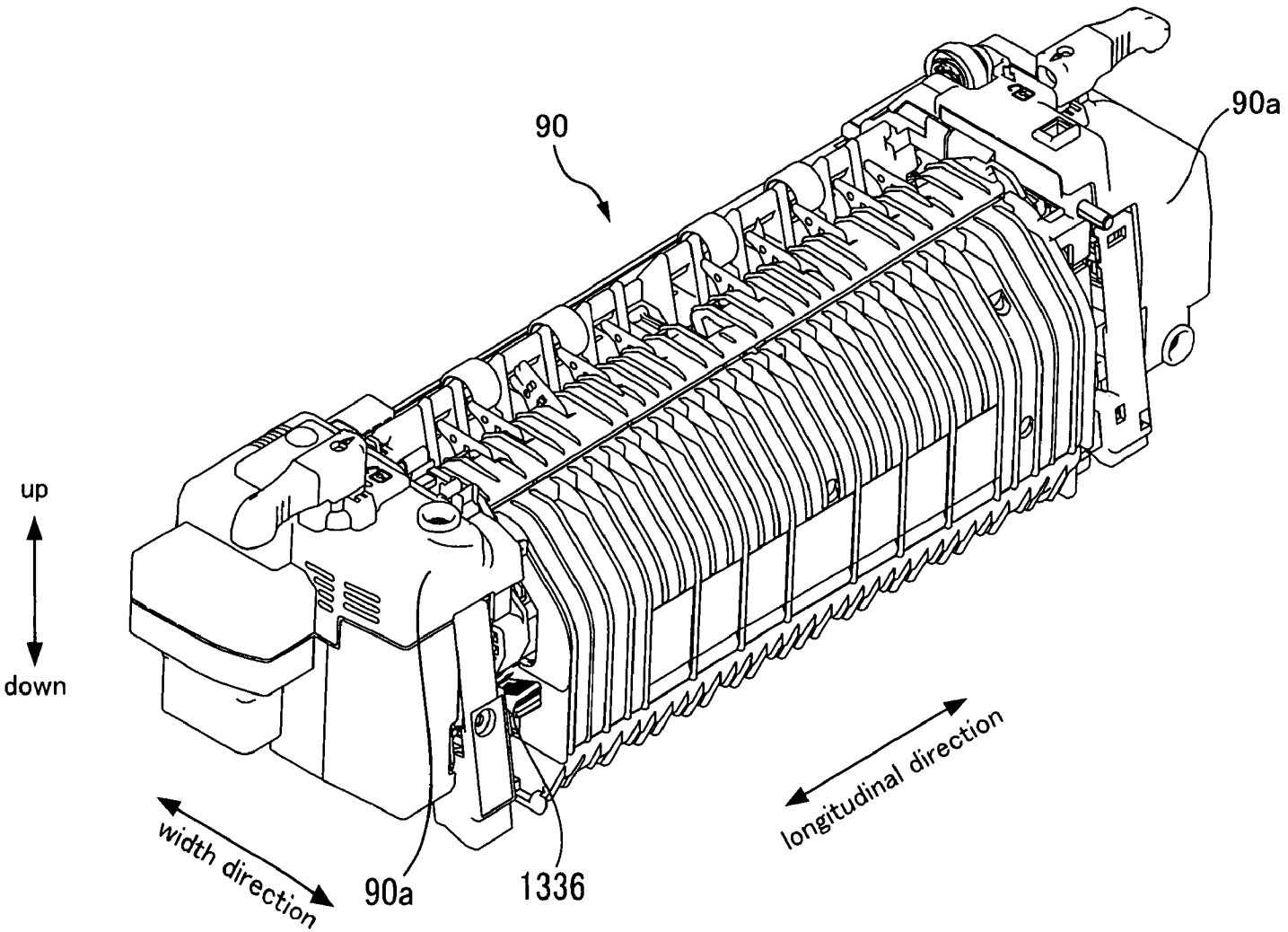
FIG. 18 is a perspective view showing an external configuration of a fixing unit 90 according to a second embodiment.

FIG. 18 is a perspective view showing an external configuration of the fixing unit 90.

Figure 19:
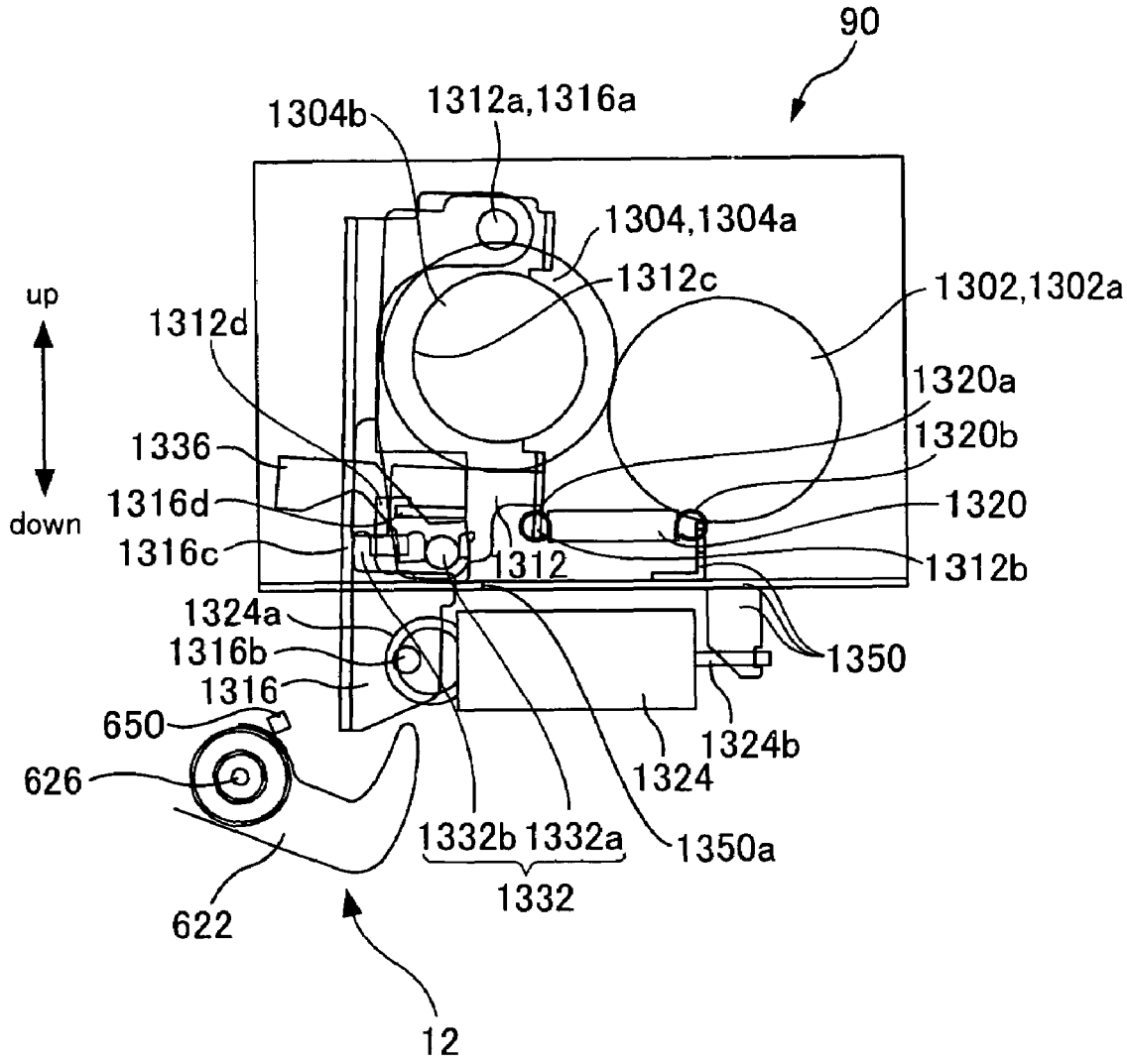
FIG. 19 is a front view according to the second embodiment, showing a state of the fixing unit 90 when the high-press-contact-force mode has been selected and the fourth side-surface cover 260 is closed.
Figure 20:
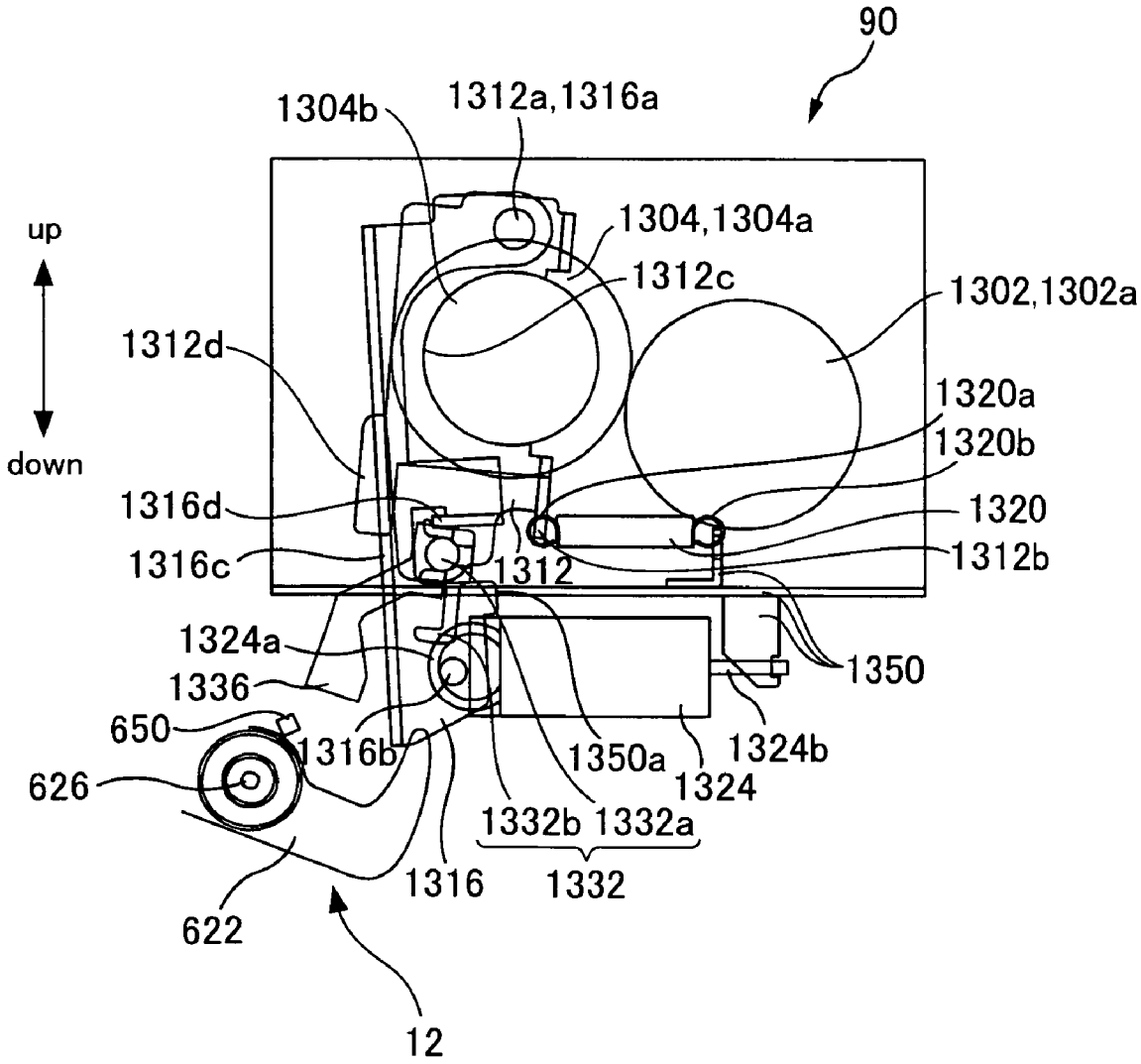
FIG. 20 is a front view according to the second embodiment, showing a state of the fixing unit 90 when the low-press-contact-force mode has been selected and the fourth side-surface cover 260 is closed.
Figure 21:
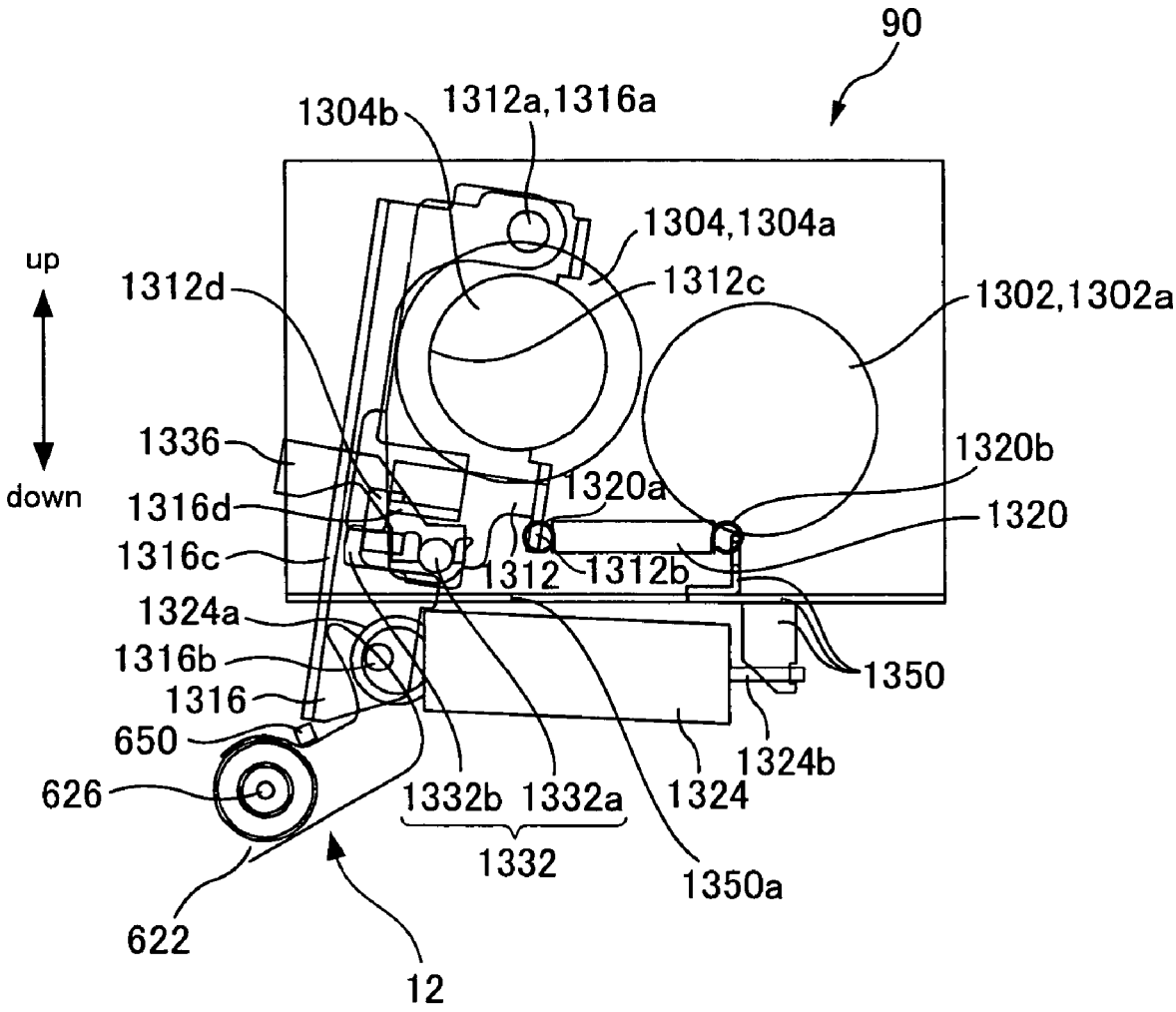
FIG. 21 is a front view according to the second embodiment, showing a state of the fixing unit 90 when the high-press-contact-force mode has been selected and the fourth side-surface cover 260 is opened.
Figure 22:
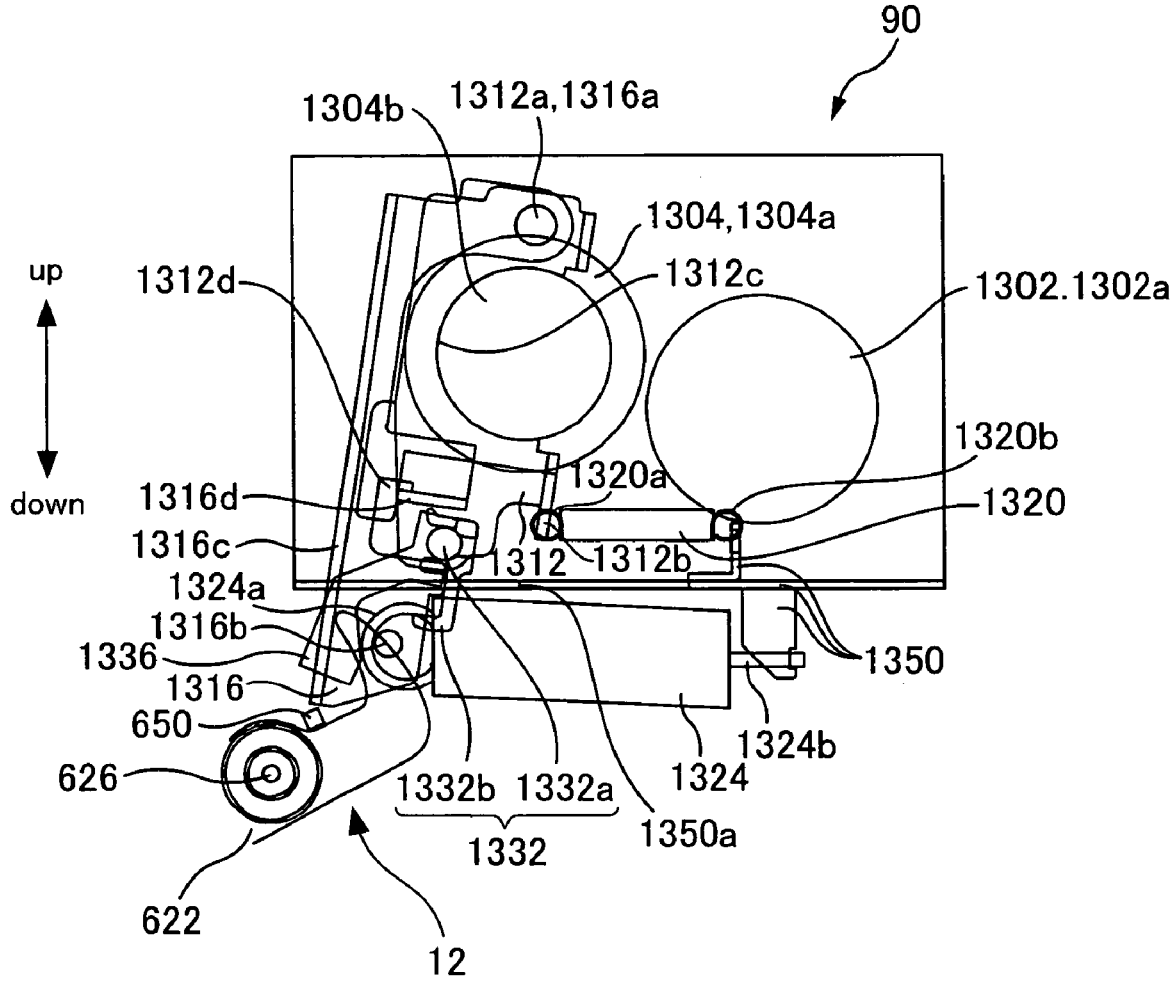
FIG. 22 is a front view according to the second embodiment, showing a state of the fixing unit 90 when the low-press-contact-force mode has been selected and the fourth side-surface cover 260 is opened.

FIG. 19 through FIG. 22 are diagrams showing one end 90*a*, in the longitudinal direction, of the fixing unit 90, and peripheral members in its periphery when the fixing unit 90 is attached to the printer body 12. FIG. 19 is a front view showing a state of the fixing unit 90 when the high-press-contact-force mode (described later) has been selected. FIG. 20 is a front view showing a state of the fixing unit 90 when the low-press-contact-force mode (described later) has been selected. FIG. 21 is similar to FIG. 19 and is a front view showing a state of the fixing unit 90 when the high-press-contact-force mode has been selected; FIG. 19 shows a state in which the fourth side-surface cover 260 is closed, but FIG. 21 shows a state in which the fourth side-surface cover 260 is opened. Likewise, FIG. 22 is similar to FIG. 20 and is a front view showing a state of the fixing unit 90 when the low-press-contact-force mode has been selected; FIG. 20 shows a state in which the fourth side-surface cover 260 is closed, but FIG. 22 shows a state in which the fourth side-surface cover 260 is opened.

It should be noted that the arrows in FIGS. 18 through 22 indicate the vertical direction, and the other arrows in FIG. 18 respectively indicate the longitudinal direction and the width direction of the fixing unit 90.

As described above, FIG. 19 through FIG. 22 are diagrams showing an end 90*a* etc., in the longitudinal direction, of the fixing unit 90; since one longitudinal-direction end and the other longitudinal-direction end of the fixing unit 90 have substantially the same structure, only one end, in the longitudinal direction, of the fixing unit 90 is shown in the figures.

The fixing unit 90 is a device that heats and pressurizes the toner image on the recording medium to fix the image onto the recording medium. The fixing unit 90 has: a fixing roller 1302, which is an example of a "first roller"; a pressurizing roller 1304, which is an example of a "second roller"; a plurality of pressing members, that is, a first pressing lever 1312 as an example of a "first pressing member" and a second pressing lever 1316 as an example of a "second pressing member"; a plurality of urging members, that is, a first tension spring 1320 as an example of a "first spring" and a second tension spring 1324 as an example of a "second spring"; a rotating member 1332 which is an example of a "changing section"; and an operating section 1336. Further, a printer-body-side lever 622, which is described later on, is provided as the peripheral member.

The fixing roller 1302 heats the toner image on the recording medium and fuses the toner image onto the recording medium. The fixing roller 1302 is provided so that its longitudinal direction is arranged in the longitudinal direction of the fixing unit 90. Further, the fixing roller 1302 has a rotation shaft (not shown) and a large-diameter section 1302*a*, and is rotatable about the rotation shaft. A heater (not shown) is provided inside the large-diameter section 1302*a*, and the heat generated by the heater causes the toner image on the recording medium to be heated and become fused onto the recording medium.

The pressurizing roller 1304 operates in cooperation with the fixing roller 1302 to pressurize the toner image on the recording medium. The pressurizing roller 1304 is provided such that its longitudinal direction is arranged in the longitudinal direction of the fixing unit 90 and that it is positioned adjacent to the fixing roller 1302. Further, the pressurizing roller 1304 has a rotation shaft (not shown) and a large-diameter section 1304*a*, and is rotatable about the rotation shaft.

Further, the pressurizing roller 1304 is configured such that it can be pressed in contact against the fixing roller 1302. When the fixing unit 90 fixes the toner image on the recording medium onto that recording medium, the pressurizing roller 1304 presses against the fixing roller 1302 via the recording medium, so that the toner image on the recording medium that is pinched between the fixing roller 1302 and the pressurizing roller 1304 is pressurized by these two rollers. Further, the ends, in the longitudinal direction, of the pressurizing roller 1304 (that is, the two outer portions of the large-diameter section 1304*a*) are each provided with a grasped section 1304*b* that is grasped by a later-described first pressing lever 1312.

As shown in FIG. 19 and FIG. 20, the first pressing lever 1312 and the first tension spring 1320 press and urge the pressurizing roller 1304 toward the fixing roller 1302 so as to press the pressurizing roller 1304 in contact against the fixing roller 1302. Each end, in the longitudinal direction, of the fixing unit 90 is provided with a pair of the first pressing lever 1312 and the first tension spring 1320.

As shown in FIG. 19 and FIG. 20, the first pressing lever 1312 has a rotation shaft 1312*a* in its upper section, and a connecting section 1312*b* for connection with the first tension spring 1320 (described later) in its lower section. Between the rotation shaft 1312*a* and the connecting section 1312*b* is provided a grasping section 1312*c* for grasping the grasped section 1304*b*. The first pressing lever 1312 is configured such that, in a state where the grasping section 1312*c* is grasping the grasped section 1304*b* (i.e., in a state where the first pressing lever 1312 is connected to the pressurizing roller 1304), the first pressing lever 1312 can rotate (e.g., pivot) about the rotation shaft 1312*a*.

As shown in FIG. 19 and FIG. 20, the first tension spring 1320 has hooks 1320*a* and 1320*b* at both ends; the hook 1320*a* on one end side (on the left in FIG. 19) is connected to the connecting section 1312*b* of the first pressing lever 1312, and the hook 1320*b* on the other end side (on the right in FIG. 19) is connected to the frame 1350. The first tension spring 1320, with its tension force (urging force), pulls the lower section of the first pressing lever 1312 (i.e., the connecting section 1312*b* of the first pressing lever 1312) to the side of the fixing roller 1302 (in FIG. 19, the direction from the left toward the right).

More specifically, since the rotation shaft 1312*a* of the first pressing lever 1312 is positioned in the upper section of the first pressing lever 1312, the tension force (urging force) of the first tension spring 1320 is transmitted to the first pressing lever 1312 and thus converted into a rotation force of the first pressing lever 1312 in the counterclockwise direction in FIG. 19 and FIG. 20. Accordingly, the pressurizing roller 1304 that is grasped by the grasping section 1312*c*, which is positioned between the rotation shaft 1312*a* and the connecting section 1312*b*, is urged and pressed toward the fixing roller 1302 by the rotation force exerted on the first pressing lever 1312, as shown in FIG. 19 and FIG. 20.

The rotating member 1332 includes a rotation shaft 1332*a* and two contacting sections 1332*b*. An operating section 1336 operated for changing the intensity of the press-contact force is fixed to the rotating member 1332.

The rotation shaft 1332*a* is provided from one end side to the other end side of the fixing unit 90 such that its longitudinal direction is parallel to the longitudinal direction of the fixing unit 90. The rotation shaft 1332*a* is rotatably fixed to the first pressing lever 1312 (lower section of the lever 1312) at both ends thereof. When the user etc. operates the operating section 1336 (described below), the rotation shaft 1332*a* rotates back and forth between a first rotated position shown in FIG. 19 and a second rotated position shown in FIG. 20.

The two contacting sections 1332*b* are respectively fixed to each end of the rotation shaft 1332*a*, and rotate in conjunction with the rotation of the rotation shaft 1332*a*. The contacting sections 1332*b* are configured such that they can come into contact with the second pressing lever 1316 described below when the rotation shaft 1332*a* is positioned at the first rotated position (FIG. 19), and such that they do not come into contact with the second pressing lever 1316 when the rotation shaft 1332*a* is positioned at the second rotated position (FIG. 20).

The operating section 1336 is a lever that is fixed to one end of the rotation shaft 1332*a*, and as shown in FIG. 18, it is exposed outside the fixing unit 90 so that the user etc. can operate it. When the user etc. pushes the operating section 1336 upward in a state where the rotation shaft 1332*a* is positioned at the second rotated position, the rotation shaft 1332*a* rotates and moves to the first rotated position. Conversely, when the user etc. presses the operating section 1336 downward in a state where the rotation shaft 1332*a* is positioned at the first rotated position, the rotation shaft 1332*a* rotates and moves to the second rotated position.

The second pressing lever 1316 and the second tension spring 1324 press and urge the pressurizing roller 1304 toward the fixing roller 1302 so as to press the pressurizing roller 1304 against the fixing roller 1302, as shown in FIG. 19. Each end, in the longitudinal direction, of the fixing unit 90 is provided with a pair of the second pressing lever 1316 and the second tension spring 1324.

As shown in FIG. 19 and FIG. 20, the second pressing lever 1316 has a rotation shaft 1316*a* in its upper section and a connecting section 1316*b* for connection with the second tension spring 1324 (described later) in its lower section, and is configured such that it can rotate about the rotation shaft 1316*a*. Between the rotation shaft 1316*a* and the connecting section 1316*b* is provided a contacted section 1316*c* with which the contacting sections 1332*b* of the rotating member 1332 can contact. The connecting section 1316*b* of the second pressing lever 1316 is positioned below the connecting section 1312*b* of the first pressing lever 1312; therefore, the distance from the rotation shaft 1316*a* to the connecting section 1316*b* of the second pressing lever 1316 is longer than the distance from the rotation shaft 1312*a* to the connecting section 1312*b* of the first pressing lever 1312.

The second tension spring 1324 is a spring that has a spring constant different from that of the first tension spring 1320 (in the present embodiment, the spring constant of the first tension spring 1320 is smaller than the spring constant of the second tension spring 1324), and as shown in FIG. 19 and FIG. 20, it has hooks 1324*a* and 1324*b* at both ends. The hook 1324*a* on one end side (on the left in FIG. 19) is connected to the connecting section 1316*b* of the second pressing lever 1316, and the hook 1324*b* on the other end side (on the right in FIG. 19) is connected to the frame 1350. The second tension spring 1324, with its tension force (urging force), pulls the lower section of the second pressing lever 1316 (i.e., the connecting section 1316*b* of the second pressing lever 1316) to the side of the fixing roller 1302 (in FIG. 19 and FIG. 20, the direction from the left toward the right).

When the rotation shaft 1332*a* of the rotating member 1332 is positioned at the first rotated position, the contacting section 1332*b* will be located at a position where it can come into contact with the contacted section 1316*c*, which is positioned between the rotation shaft 1316*a* and the connecting section 1316*b* of the second pressing lever 1316. Therefore, as shown in FIG. 19, the rotating member 1332 is urged and pressed by the second pressing lever 1316 and the second tension spring 1324 in a state that the contacting section 1332*b* is in contact with the contacted section 1316*c*. Since the rotating member 1332 is provided on (fixed to) the first pressing lever 1312, the first pressing lever 1312 that grasps the pressurizing roller 1304 is urged and pressed toward the fixing roller 1302. On the other hand, when the rotation shaft 1332*a* of the rotating member 1332 is positioned at the second rotated position, the contacting section 1332*b* will be located at a position where it cannot come into contact with the contacted section 1316*c*. Therefore, as shown in FIG. 20, the rotating member 1332, as well as the first pressing lever 1312, will not be subjected to the urging force nor the pressing force of the second pressing lever 1316 and the second tension spring 1324.

More specifically, when the rotation shaft 1332*a* of the rotating member 1332 is positioned at the first rotated position, the pressing force of the first pressing lever 1312 is transmitted to the pressurizing roller 1304, and also the pressing force of the second pressing lever 1316 is transmitted to the pressurizing roller 1304 via the rotating member 1332 and the first pressing lever 1312. At this time, both the first tension spring 1320 and the second tension spring 1324 will urge the pressurizing roller 1304. On the other hand, when the rotation shaft 1332*a* of the rotating member 1332 is positioned at the second rotated position, the pressing force of the second pressing lever 1316 is not transmitted to the rotating member 1332 nor the first pressing lever 1312, and therefore, only the pressing force of the first pressing lever 1312 is transmitted to the pressurizing roller 1304. At this time, only the first tension spring 1320 will urge the pressurizing roller 1304.

As described above, in the printer 10 according to, the present embodiment, the press-contact force of the pressurizing roller 1304 against the fixing roller 1302 can be changed. The above-described rotating member 1332 has the function of changing the intensity of the press-contact force of the pressurizing roller 1304 against the fixing roller 1302 by appropriately selecting the tension spring(s) for urging the pressurizing roller 1304 from among a plurality of tension springs (that is, the first tension spring 1320 and the second tension spring 1324) (in other words, the function of changing the intensity of the press-contact force in two stages, namely by selecting either both the first tension spring 1320 and the second tension spring 1324 or only the first tension spring 1320 as the spring(s) for urging the pressurizing roller 1304). Further, the operating section 1336 has the function as a lever that is operated for changing the intensity of the press-contact force. For example, if the user etc. wishes that the toner image be fixed to a recording medium in which crimples are prone to occur, such as an envelope, then the user etc. can select the low-press-contact-force mode (mode in which the press-contact force is small) by operating the operating section 1336 and positioning the rotating member 1332 at the second rotated position, in order to prevent crimples from occurring. On the other hand, if the user etc. wishes that the toner image be fixed to a recording medium such as plain paper, then the user etc. can select the high-press-contact-force mode (mode in which the press-contact force is large) by operating the operating section 1336 and positioning the rotating member 1332 at the first rotated position.

Further, a rotatable printer-body-side lever 622 is provided on the side of the printer body 12 and below the second pressing lever 1316. The printer-body-side lever 622 rotates (e.g., pivots) in conjunction with the opening movement of the fourth side-surface cover 260, and achieves the function of releasing the press-contact of the pressurizing roller 1304 against the fixing roller 1302.

When the fourth side-surface cover 260 is closed, the printer-body-side lever 622 is positioned at a first rotated position shown in FIG. 19 and FIG. 20. When the printer-body-side lever 622 is positioned at the first rotated position, the printer-body-side lever 622 is not in contact with the second pressing lever 1316 as shown in FIG. 19 and FIG. 20, and the pressurizing roller 1304 is pressed in contact against the fixing roller 1302 due to the first pressing lever 1312 and the second pressing lever 1316 pressing against the pressurizing roller 1304 in the high-press-contact-force mode (FIG. 19), and due to the first pressing lever 1312 pressing against the pressurizing roller 1304 in the low-press-contact-force mode (FIG. 20).

On the other hand, the printer-body-side lever 622 rotates in conjunction with the opening movement of the fourth side-surface cover 260, and rotates, in the counterclockwise direction in FIG. 19 and FIG. 20, from the first rotated position to a second rotated position shown in FIG. 21 and FIG. 22. When the printer-body-side lever 622 is positioned at the second rotated position, the printer-body-side lever 622 is in contact with the second pressing lever 1316 as shown in FIG. 21 and FIG. 22 and presses the lower section of the second pressing lever 1316 in a direction opposite from the direction in which the second tension spring 1324 is pulling the second pressing lever 1316 (the direction from left to right in FIG. 21 and FIG. 22). The second pressing lever 1316 is provided with an abutment section 1316*d* that abuts against the first pressing lever 1312 when the lower section of the second pressing lever 1316 is pressed in the above-mentioned opposite direction. When the printer-body-side lever 622 is positioned at the second rotated position, the abutment section 1316*d* presses an abutted section 1312*d* of the first pressing lever 1312 in a direction opposite from the direction in which the first tension spring 1320 is pulling the first pressing lever 1312 (the direction from left to right in FIG. 21 and FIG. 22). Thus, in this state, the press-contact of the pressurizing roller 1304, which is grasped by the grasping section 1312*c* of the first pressing lever 1312, against the fixing roller 1302 is released as shown in FIG. 21 and FIG. 22. It should be noted that a stopper 650 for restricting the printer-body-side lever 622 from rotating beyond the second rotated position is provided in the vicinity of the printer-body-side lever 622.

In this way, when the fourth side-surface cover 260 is closed (for example, when the fixing unit 90 is fixing the toner image formed on the recording medium onto the recording medium), the pressing lever/s (the first pressing lever 1312 and the second pressing lever 1316 in the high-press-contact-force mode, and the first pressing lever 1312 in the low-press-contact-force mode) presses/press the pressurizing roller 1304 toward the fixing roller 1302 to make the pressurizing roller 1304 be in press-contact with the fixing roller 1302. On the other hand, when the fourth side-surface cover 260 is opened by or more than a certain amount, the above-described action of the printer-body-side lever 622, the abutment section 1316*d*, etc., prevents the pressurizing roller 1304 from being pressed in contact against the fixing roller 1302, even though the pressing lever/s (the first pressing lever 1312 and the second pressing lever 1316 in the high-press-contact-force mode, and the first pressing lever 1312 in the low-press-contact-force mode) is/are pressing the pressurizing roller 1304 toward the fixing roller 1302. It should be noted that the mechanism by which the printer-body-side lever 622 rotates in conjunction with the opening movement of the fourth side-surface cover 260 will be described in detail later on.

Example of How Fixing Unit and Its Peripheral Sections Operate According to Second Embodiment Next, operations of the fixing unit 90 and the peripheral members when the user etc. changes the mode of the printer 10 from the high-press-contact-force mode to the low-press-contact-force mode will be described as an example of an operation of the fixing unit 90 and the peripheral members that have the above-described configuration.

[1. Initial State (FIG. 19)]

In this section, the initial state of the fixing unit 90 and the peripheral members, that is, the state of the fixing unit 90 and the peripheral members before the user etc. changes the mode of the printer 10 from the high-press-contact-force mode to the low-press-contact-force mode, will be described. In this initial state, the fixing unit 90 is attached to the printer body 12 and the fourth side-surface cover 260 is closed. Further, the "high-press-contact-force mode" is selected as the mode of the printer 10.

As described above, when the fourth side-surface cover 260 is closed, the printer-body-side lever 622 is not in contact with the second pressing lever 1316, and therefore, as shown in FIG. 19, the pressurizing roller 1304 is pressed in contact against the fixing roller 1302 due to the pressing lever being pressed against the pressurizing roller 1304.

Further, when the high-press-contact-force mode is selected, the rotation shaft 1332*a* of the rotating member 1332 is positioned at the first rotated position, and therefore, the contacting section 1332*b* of the rotating member 1332 is located at a position where it can come into contact with the contacted section 1316*c* of the second pressing lever 1316. Because the contacting section 1332*b* is in contact with the contacted section 1316*c*, both the first pressing lever 1312 and the second pressing lever 1316 press the pressurizing roller 1304 toward the fixing roller 1302 so as to press the pressurizing roller 1304 in contact against the fixing roller 1302. At this time, both the first tension spring 1320 and the second tension spring 1324 are selected as the spring(s) for urging the pressurizing roller 1304.

[2. Operation of Fixing Unit 90 Etc. when Opening Fourth Side-Surface Cover 260]

In order to change the mode of the printer 10 from the high-press-contact-force mode to the low-press-contact-force mode, the user etc. will have to operate the operating section 1336 that is exposed outside the fixing unit 90. In order to operate the operating section 1336, the user etc. will first have to open the fourth side-surface cover 260. In this section, the operation of the fixing unit 90 etc. when opening the fourth side-surface cover 260, that is, the operation of the fixing unit 90 etc. from the initial state shown in FIG. 19 up to the state shown in FIG. 21, will be described.

As described above, in the initial state (FIG. 19), the printer-body-side lever 622 is not in contact with the second pressing lever 1316, and therefore, both the first pressing lever 1312 and the second pressing lever 1316 press the pressurizing roller 1304 toward the fixing roller 1302 so as to press the pressurizing roller 1304 in contact against the fixing roller 1302.

When the user etc. opens the fourth side-surface cover 260, the printer-body-side lever 622 rotates in conjunction with the opening movement of the fourth side-surface cover 260 and eventually comes into contact with the second pressing lever 1316. Then, in conjunction with further opening movement of the fourth side-surface cover 260, the printer-body-side lever 622, which is now in contact with the second pressing lever 1316, presses the lower section of the second pressing lever 1316 in a direction opposite from the direction in which the second tension spring 1324 is pulling the second pressing lever 1316 (the direction from left to right in FIG. 19).

Due to this force, the second pressing lever 1316 rotates in the clockwise direction in FIG. 19, and the contact between the contacting section 1332*b* and the contacted section 1316*c* is released immediately thereafter (that is, the contacted section 1316*c* of the second pressing lever 1316 disengages from the contacting section 1332*b* of the rotating member 1332).

With further rotation of the second pressing lever 1316, the abutment section 1316*d* of the second pressing lever 1316 eventually comes into abutment with the abutted section 1312*d* of the first pressing lever 1312. Then, with further opening movement of the fourth side-surface cover 260, the second pressing lever 1316, which is now in abutment with the first pressing lever 1312, presses the abutted section 1312*d* of the first pressing lever 1312 in a direction opposite from the direction in which the first tension spring 1320 is pulling the first pressing lever 1312 (the direction from left to right in FIG. 19).

Due to this force, the first pressing lever 1312 rotates in the clockwise direction in FIG. 19, and the press-contact between the pressurizing roller 1304, which is grasped by the grasping section 1312*c* of the first pressing lever 1312, and the fixing roller 1302 is released.

When the printer-body-side lever 622 has rotated to the second rotated position (FIG. 21), further rotation (rotation beyond the second rotated position) is restricted by the above-described stopper 650, and the printer-body-side lever 622 stops in a state in which the press-contact has been released.

It should be noted that in this state (the state shown in FIG. 21 and FIG. 22), the fourth side-surface cover 260 is opened and the press-contact of the pressurizing roller 1304 against the fixing roller 1302 is released. Therefore, in this state, it is possible to perform troubleshooting easily when the fixing unit 90 is jammed up.

[3. Operation of Fixing Unit 90 Etc. when User Etc. Changes Mode of Printer 10 from High-Press-Contact-Force Mode to Low-Press-Contact-Force Mode]

In the state shown in FIG. 21, the fourth side-surface cover 260 is opened and the rotating member 1332 (the contacting section 1332*b* of the rotating member 1332) is disengaged from the second pressing lever 1316 (the contacted section 1316*c* of the second pressing lever 1316). Therefore, the user etc. can suitably operate the operating section 1336 in order to change the mode of the printer 10. In this section, the operation of the fixing unit 90 etc. when the user etc. changes the mode of the printer 10 from the high-press-contact-force mode to the low-press-contact-force mode, that is, the operation of the fixing unit 90 etc. from the state shown in FIG. 21 to the state shown in FIG. 22, will be described.

In the state shown in FIG. 21, since the high-press-contact-force mode is selected, the rotation shaft 1332*a* of the rotating member 1332 is positioned at the first rotated position. Therefore, the contacting section 1332*b* of the rotating member 1332 is located at a position where it can come into the contacted section 1316*c* of the second pressing lever 1316.

When the user etc. presses the operating section 1336 downward, the rotation shaft 1332*a* rotates and moves to the second rotated position. Then, with the rotation of the rotation shaft 1332*a*, the contacting section 1332*b* also rotates and moves from the position where it can contact the contacted section 1316*c* of the second pressing lever 1316 to a position where it cannot come into contact with the contacted section 1316*c* (FIG. 22). In this way, the mode of the printer 10 is changed from the high-press-contact-force mode to the low-press-contact-force mode.

[4. Operation of Fixing Unit 90 Etc. when Closing Fourth Side-Surface Cover 260]

In order to make the fixing unit 90 operate, the user etc. will have to close the fourth side-surface cover 260. In this section, the operation of the fixing unit 90 etc. when closing the fourth side-surface cover 260, that is, the operation of the fixing unit 90 etc. from the state shown in FIG. 22 up to the state shown in FIG. 20, will be described.

In the state shown in FIG. 22, the printer-body-side lever 622 is in contact with the second pressing lever 1316, and therefore, the press-contact between the pressurizing roller 1304, which is grasped by the grasping section 1312*c* of the first pressing lever 1312, and the fixing roller 1302 is released. Further, since the low-press-contact-force mode is selected as the mode of the printer 10, the contacting section 1332*b* of the rotating member 1332 is located at a position where it cannot come into contact with the contacted section 1316*c* of the second pressing lever 1316.

When the user etc. closes the fourth side-surface cover 260, the printer-body-side lever 622 rotates in the clockwise direction in FIG. 22 in conjunction with the closing movement of the fourth side-surface cover 260. Then, with the rotation of the printer-body-side lever 622, the first pressing lever 1312 rotates in the counterclockwise direction in FIG. 22 due to the tension force (urging force) of the first tension spring 1320 and the second pressing lever 1316 also rotates counterclockwise due to the tension force (urging force) of the second tension spring 1324.

As the first pressing lever 1312 continues to rotate along with the rotation of the printer-body-side lever 622, the pressurizing roller 1304, which is grasped by the grasping section 1312*c* of the first pressing lever 1312, is eventually pressed in contact against the fixing roller 1302. The first pressing lever 1312 then stops at this point.

On the other hand, as the second pressing lever 1316 continues to rotate along with the rotation of the printer-body-side lever 622, the second pressing lever 1316 (the lower section of the second pressing lever 1316) eventually comes into contact with the stopper 1350*a* provided on the frame 1350. The second pressing lever 1316 then stops at this point. It should be noted that, since the contacting section 1332*b* of the rotating member 1332 is located at a position where it cannot come into contact with the contacted section 1316*c* of the second pressing lever 1316, the contacted section 1316*c* will not come into contact with the contacting section 1332*b* during the period in which the second pressing lever 1316 starts rotating and stops.

When the fourth side-surface cover 260 is completely closed, the printer-body-side lever 622 is ultimately positioned in the above-mentioned first rotated position (FIG. 20). At this time, the printer-body-side lever 622 is in a state where it is no longer in contact with the second pressing lever 1316 (a state in which it is disengaged from the second pressing lever 1316).

In the state where the fourth side-surface cover 260 is completely closed (FIG. 20), the contacting section 1332*b* is not in contact with the contacted section 1316*c*, and only the first pressing lever 1312 presses the pressurizing roller 1304 toward the fixing roller 1302 so as to press the pressurizing roller 1304 in contact with the fixing roller 1302. At this time, only the first tension spring 1320 is selected as the spring for urging the pressurizing roller 1304.

Figure 23:
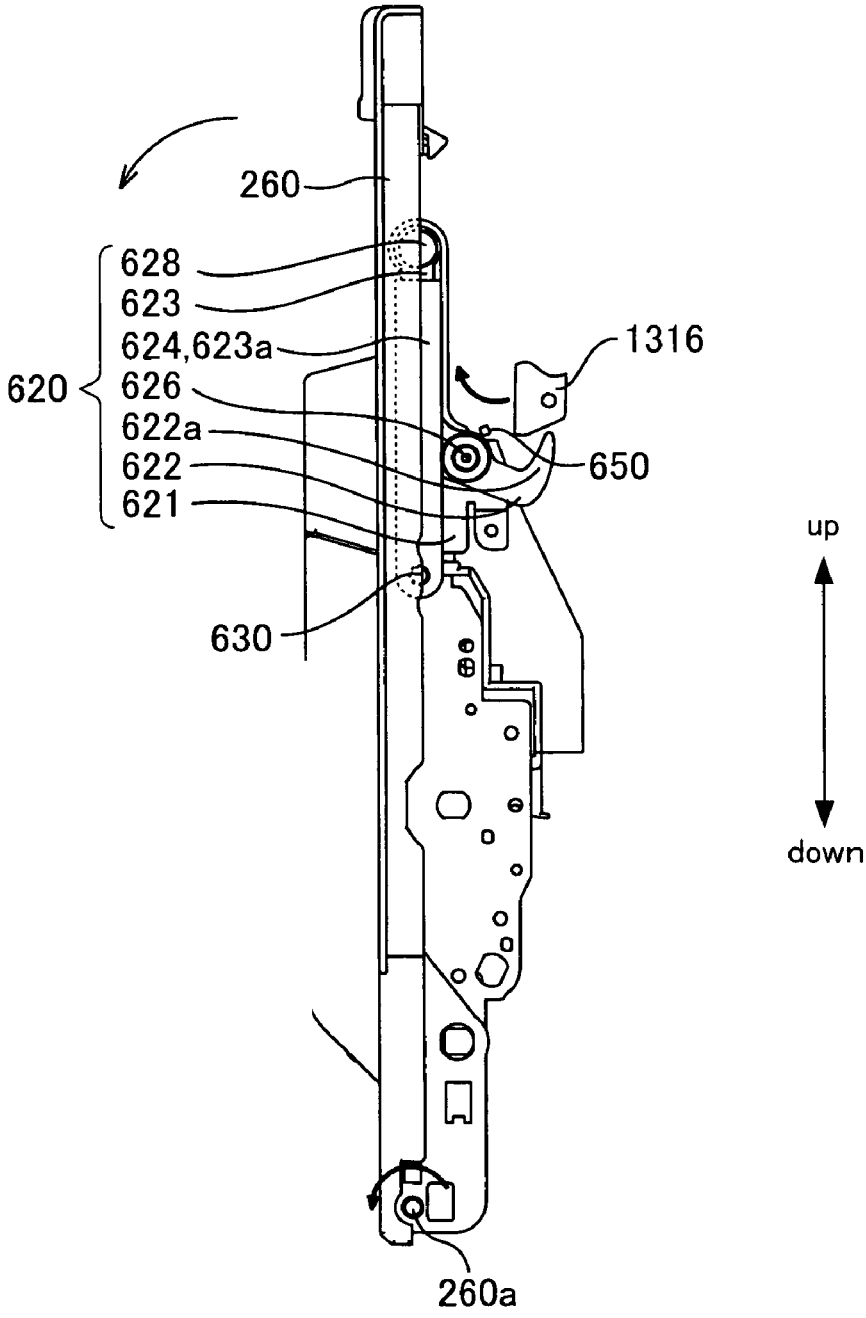
FIG. 23 is a diagram according to the second embodiment, showing a state of the arm 620 etc. when the fourth side-surface cover 260 is closed.
Figure 24:
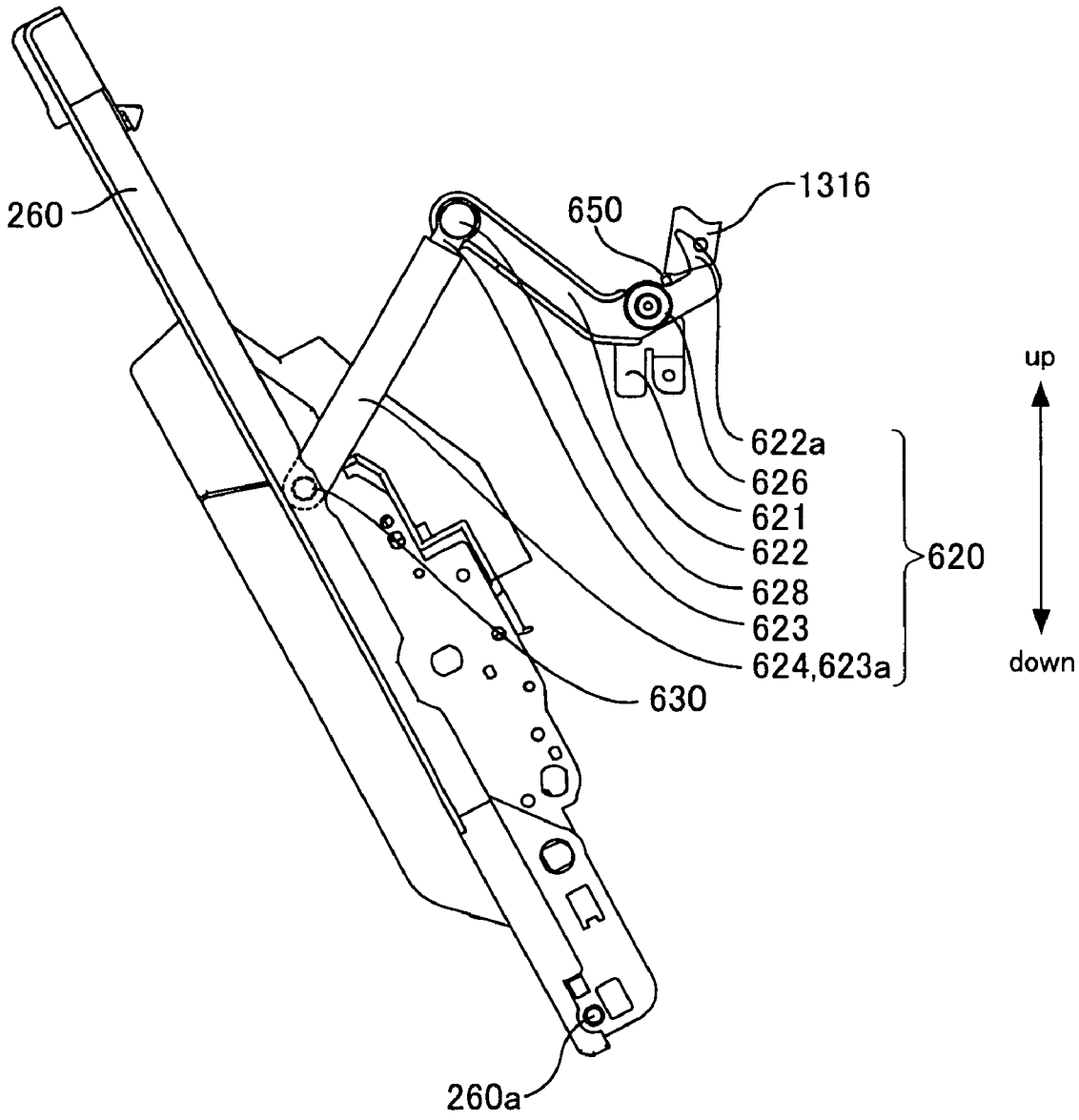
FIG. 24 is a diagram according to the second embodiment, showing a state of the arm 620 etc. when the fourth side-surface cover 260 is opened by or more than a certain amount and the press-contact of a pressurizing roller 1304 against a fixing roller 1302 is released.

Mechanism of Second Embodiment According to Which Printer-Body-Side Lever Rotates in Conjunction with Opening/Closing Movement of Fourth Side-Surface Cover In this section, the mechanism according to which the printer-body-side lever 622 rotates in conjunction with the opening/closing movement of the fourth side-surface cover 260 will be described with reference to FIG. 23 and FIG. 24. FIG. 23 shows a state of an arm 620 etc. when the fourth side-surface cover 260 is closed. FIG. 24 shows a state of the arm 620 etc. when the fourth side-surface cover 260 is opened by or more than a certain amount and the press-contact of the pressurizing roller 1304 against the fixing roller 1302 is released. It should be noted that the arrows in FIG. 23 and FIG. 24 indicate the vertical direction.

The printer body 12 has, other than the printer-body-side lever 622, a fixed member 621, an intermediate member 623, and a sliding member 624, as structural elements of the above-described mechanism. A single arm 620 is made up of these and other members. It should be noted that two arms 620, one arm 620 on each end in the width direction of the fourth side-surface cover 260, are provided; however, since both arms 620 have substantially the same function etc., FIG. 23 and FIG. 24 show only one arm 620 on one end in the width direction, and below, the structure and operations of only the arm 620 on the above-mentioned end, in the width direction, will be described.

First, the structure of the above-mentioned mechanism (the arm 620) is described.

The fixed member 621 is fixed to a frame (not shown) of the printer body 12.

The printer-body-side lever 622 is rotatably supported on the fixed member 621 about a shaft 626. One end of the printer-body-side lever 622 is provided with a contacting section 622*a* that can come into contact with the second pressing lever 1316 of the fixing unit 90. The other end of the printer-body-side lever 622 is rotatably connected to a shaft 628.

The intermediate member 623 is rotatably connected to the shaft 628 at one end. In this way, the intermediate member 623 can rotate relative to the printer-body-side lever 622 about the shaft 628. The other end of the intermediate member 623 is provided with a slide section 623*a*. (In FIG. 23 and FIG. 24, the slide section 623*a* is positioned inside the sliding member 624.)

The sliding member 624 slides with respect to the slide section 623*a*. The movement of the sliding member 624 is restricted by the slide section 623*a* such that the sliding member 624 slides only in a predetermined direction with respect to the slide section 623*a* (this predetermined direction is referred to as a "slide direction"). The static friction between the sliding member 624 and the slide section 623*a* allows for a force in the slide direction to be transmitted between the sliding member 624 and the slide section 623*a*. Further, the sliding member 624 is rotatably connected to a shaft 630 that is supported on the fourth side-surface cover 260.

It should be noted that when the fourth side-surface cover 260 is opened and closed, the shaft 626 does not move because it is fixed to the printer body 12. In contrast, since the shaft 630 is supported on the fourth side-surface cover 260 and the shaft 628 is not fixed, the shafts 628 and 630 can move in conjunction with the opening and closing of the fourth side-surface cover 260.

Next, an operation of the printer-body-side lever 622 rotating in conjunction with the opening movement of the fourth side-surface cover 260 is described below as an example of an operation of the mechanism having the structure described above. It should be noted that the operation of the printer-body-side lever 622 rotating in conjunction with the closing movement of the fourth side-surface cover 260 is basically opposite from the below-described operation in which the printer-body-side lever 622 rotates in conjunction with the opening movement of the fourth side-surface cover 260.

As shown in FIG. 23, in a state where the fourth side-surface cover 260 is closed, the arm 620 (the printer-body-side lever 622, the intermediate member 623, and the sliding member 624) is folded up in a compact manner. In this state, the printer-body-side lever 622 is in the above-described first rotated position and is not in contact with the second pressing lever 1316.

When the user etc. pulls the closed fourth side-surface cover 260 frontward, the fourth side-surface cover 260 rotates about a connection shaft 260*a* in the counterclockwise direction (the direction shown by the arrow in FIG. 23). In conjunction with this rotation of the fourth side-surface cover 260, the shaft 630 supported on the fourth side-surface cover 260 moves about the connection shaft 260*a*.

Then, the sliding member 624 connected to the shaft 630 moves in conjunction with the movement of the shaft 630, and further, the intermediate member 623 moves in conjunction with the movement of the sliding member 624. At this time, the printer-body-side lever 622 receives a force in the slide direction from the intermediate member 623 via the shaft 628 and rotates about the shaft 626 in the counterclockwise direction in FIG. 23. As a result, the contacting section 622*a* of the printer-body-side lever 622 eventually comes into contact with the second pressing lever 1316.

In conjunction with further opening movement of the fourth side-surface cover 260, the printer-body-side lever 622 rotates up to the above-described second rotated position (FIG. 24) while pressing the second pressing lever 1316 in a state where the contacting section 622*a* is in contact with the second pressing lever 1316. When the printer-body-side lever 622 reaches the second rotated position, further rotation (rotation beyond the second rotated position) is restricted by the above-described stopper 650, and the printer-body-side lever 622 stops.

When the user etc. further pulls the fourth side-surface cover 260 frontward in the state shown in FIG. 24, the sliding member 624 slides with respect to the slide section 623*a* of the intermediate member 623 and the arm from the shaft 628 to the shaft 630 will fully extend, while the printer-body-side lever 622 maintains its stopped state. In this way, the fourth side-surface cover 260 eventually reaches a fully-opened state.

Advantages of Printer Etc. According to Second Embodiment

As described above, the fixing unit 90 according to the second embodiment has: a plurality of tension springs that can urge the pressurizing roller 1304 in order to press the pressurizing roller 1304 in contact against the fixing roller 1302; and a changing section adapted to change an intensity of a press-contact force of the pressurizing roller 1304 against the fixing roller 1302, by selecting at least one tension spring for urging the pressurizing roller 1304 from among the plurality of tension springs. In this way, a fixing unit 90 etc. in which the intensity of the press-contact force of the pressurizing roller 1304 against the fixing roller 1302 can be changed appropriately, is achieved.

As described in the "BACKGROUND", in cases where the recording medium onto which the toner image is to be fixed is, for example, an envelope, it is known that crimples may occur on the recording medium if the press-contact force of the pressurizing roller 1304 against the fixing roller 1302 is too large. To address this problem, a fixing unit 90 would be particularly advantageous, in which the intensity of the press-contact force of the pressurizing roller 1304 against the fixing roller 1302 can be changed, that is, in which a low press-contact-force mode can be employed when fixing the toner image onto a recording medium in which crimples are prone to occur, such as an envelope, from the viewpoint of preventing crimples, and a high press-contact-force mode can be employed when fixing the toner image onto a recording medium such as plain paper from the viewpoint of fixing ability.

Existing fixing units 90 are provided with only a single spring for urging the pressurizing roller 1304, and achieves the change in the press-contact force by changing the amount of expansion (or the amount of contraction) of the spring between the high press-contact-force mode and the low press-contact-force mode using a cam, for example.

When, however, the press-contact force is changed through the above-described measure, there is a problem that a desired press-contact force cannot be obtained, due to the fact that it is difficult to set the amount of expansion of the spring to a predetermined value with high precision. Further, there is another problem that it is not possible to achieve a sufficient difference in press-contact force between the high press-contact-force mode and the low press-contact-force mode, due to restrictions in the size of the cam etc. Therefore, existing fixing units 90 are not capable of changing the intensity of the press-contact force appropriately.

In contrast, the fixing unit 90 according to the second embodiment has a plurality of tension springs that can urge the pressurizing roller 1304 in order to press the pressurizing roller 1304 in contact against the fixing roller 1302, and the intensity of the press-contact force of the pressurizing roller 1304 against the fixing roller 1302 is changed by appropriately selecting at least one tension spring for urging the pressurizing roller 1304 from among the plurality of tension springs. Therefore, with this configuration, characteristics (such as the spring constant) of the tension spring that urges the pressurizing roller 1304 during the high-press-contact-force mode, as well as characteristics (such as the spring constant) of the tension spring that urges the pressurizing roller 1304 during the low-press-contact-force mode, can be set separately and freely. In this way, it is possible to address the problem that a desired press-contact force cannot be obtained due to the fact that it is difficult to set the amount of expansion of the spring to a predetermined value using a cam etc.

Furthermore, since characteristics (such as the spring constant) of the tension spring that urges the pressurizing roller 1304 during the high-press-contact-force mode, as well as characteristics (such as the spring constant) of the tension spring that urges the pressurizing roller 1304 during the low-press-contact-force mode, can be set separately and freely, it is also possible to address the problem that it is not possible to achieve a sufficient difference in press-contact force between the high press-contact-force mode and the low press-contact-force mode.

Accordingly, with the present embodiment, it is possible to achieve a fixing unit 90 etc. in which the intensity of the press-contact force of the pressurizing roller 1304 against the fixing roller 1302 can be changed appropriately Other Embodiments of Second Embodiment In the foregoing, a fixing unit etc. according to the present invention was described according to the foregoing second embodiment. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing second embodiment, an intermediate-transferring-type full-color laser-beam printer was described as an example of an image forming apparatus. The present invention, however, is applicable to various types of image forming apparatuses such as full-color laser-beam printers of types other than the intermediate-transferring type, monochrome laser-beam printers, copying machines, and facsimile machines.

Further, the photoconductor is not limited to the so-called photoconductive roller in which a photoconductive layer is provided on the outer circumferential surface of a cylindrical, conductive base. The photoconductor can be, for example, a so-called photoconductive belt structured by providing a photoconductive layer on a surface of a belt-like conductive base.

In the foregoing second embodiment, an example was described in which the first roller is the fixing roller 1302 and the second roller is the pressurizing roller 1304. This, however, is not a limitation, and the first roller may be the pressurizing roller 1304 and the second roller may be the fixing roller 1302.

Further, in the foregoing second embodiment, a tension spring was described as an example of an urging member. This, however, is not a limitation, and other urging members may be employed.

Further, in the foregoing second embodiment, the plurality of tension springs were a first tension spring 1320 and a second tension spring 1324 whose spring constants differ from one another; and the rotating member 1332 changed the intensity of the press-contact force by selecting at least one tension spring for urging the pressurizing roller 1304 from among the first tension spring 1320 and the second tension spring 1324. This, however, is not a limitation. For example, three or more tension springs may be provided as the plurality of tension springs, and there may be tension springs having the same spring constant among those springs.

The foregoing second embodiment, however, is preferable in terms that it is possible to suitably change the press-contact force using a minimum number of springs.

Further, in the foregoing second embodiment, the rotating member 1332 changed the intensity of the press-contact force in two stages, by selecting either both the first tension spring 1320 and the second tension spring 1324 or only the first tension spring 1320 as the spring for urging the pressurizing roller 1304. This, however, is not a limitation. For example, the rotating member 1332 may change the intensity of the press-contact force in two stages, by selecting only the second tension spring 1324 or only the first tension spring 1320 as the spring for urging the pressurizing roller 1304.

The foregoing second embodiment, however, is preferable in terms that it becomes possible to make the intensity of the press-contact force during the high-press-contact-force mode even larger.

Further, in the foregoing second embodiment, the spring constant of the first tension spring 1320 was smaller than the spring constant of the second tension spring 1324. This, however, is not a limitation. For example, the spring constant of the first tension spring 1320 may be larger than the spring constant of the second tension spring 1324.

The foregoing second embodiment, however, is preferable in terms that it is possible to achieve a larger difference in press-contact force between the high-press-contact-force mode and the low-press-contact-force mode.

Further, in the foregoing second embodiment, the fixing unit further included a first pressing lever 1312 that is connected to the first tension spring 1320 and that is adapted to press the pressurizing roller 1304 toward the fixing roller 1302, and a second pressing lever 1316 that is connected to the second tension spring 1324 and that is adapted to press the pressurizing roller 1304 toward the fixing roller 1302 via the first pressing lever 1312; the changing section was a rotating member 1332 that is provided to the first pressing lever 1312 and that can come into contact with the second pressing lever 1316 by rotating; when the rotating member 1332 is rotated and is in contact with the second pressing lever 1316, a pressing force of the second pressing lever 1316 was transmitted to the pressurizing roller 1304 via the first pressing lever 1312 and both the first tension spring 1320 and the second tension spring 1324 urged the pressurizing roller 1304 via the first pressing lever 1312 and the second pressing lever 1316; and when the rotating member 1332 is not in contact with the second pressing lever 1316, the pressing force of the second pressing lever 1316 was not transmitted to the first pressing lever 1312 and only the first tension spring 1320 urged the pressurizing roller 1304 via the first pressing lever 1312. This, however, is not a limitation. For example, the changing section does not necessarily have to be a rotating member.

The foregoing second embodiment, however, is more preferable in terms that the pressing force of the second pressing lever 1316 is appropriately transmitted to the pressurizing roller 1304 via the changing section thanks to the configuration that the changing section provided in/on the first pressing lever 1312 can, by rotating, maintain the state of contact with the second pressing lever 1316.

Further, in the foregoing second embodiment, the first pressing lever 1312 was a lever that can rotate about a rotation shaft, and the second pressing lever 1316 was also a lever that can rotate about a rotation shaft; and a distance from the rotation shaft 1316*a* of the second pressing lever 1316 to a connecting section 1316*b* of the second pressing lever 1316 at which the second pressing lever 1316 is connected to the second tension spring 1324 was longer than a distance from the rotation shaft 1312*a* of the first pressing lever 1312 to a connecting section 1312*b* of the first pressing lever 1312 at which the first pressing lever 1312 is connected to the first tension spring 1320. This, however, is not a limitation. For example, the distance from the rotation shaft 1316*a* of the second pressing lever 1316 to the connecting section 1316*b* of the second pressing lever 1316 at which the second pressing lever 1316 is connected to the second tension spring 1324 may be shorter than the distance from the rotation shaft 1312*a* of the first pressing lever 1312 to the connecting section 1312*b* of the first pressing lever 1312 at which the first pressing lever 1312 is connected to the first tension spring 1320.

The foregoing second embodiment, however, is preferable in terms that it becomes possible to further increase the intensity of the press-contact force during the high-press-contact-force mode, in which the first tension spring 1320 is selected as the spring for urging the pressurizing roller 1304.

Further, in the foregoing second embodiment, the fixing unit further included an operating section 1336 operated for changing the intensity of the press-contact force. This, however, is not a limitation, and the operating section 1336 does not necessarily have to be provided. For example, the fixing unit may be configured such that the intensity of the press-contact force is automatically changed according to the type of recording medium (envelopes, plain paper, etc.)

The foregoing second embodiment, however, is more preferable in terms that it is possible to achieve a fixing unit 90 in which the intensity of the press-contact force of the pressurizing roller 1304 against the fixing roller 1302 is changed appropriately with a simple configuration.

Further, in the foregoing second embodiment, changing of the press-contact force was achieved in two states, but this is not a limitation, and it may be achieved in three or more stages.

Further, in the foregoing second embodiment, the printer 10 further included a press-contact-force changing member adapted to reduce the intensity of the press-contact force in a state where both the first tension spring 1320 and the second tension spring 1324 have been selected by the rotating member 1332 and both the first tension spring 1320 and the second tension spring 1324 are urging the pressurizing roller 1304, by canceling a state in which the second tension spring 1324 is urging the pressurizing roller 1304 in conjunction with an opening movement of the fourth side-surface cover 260.

Figure 25:
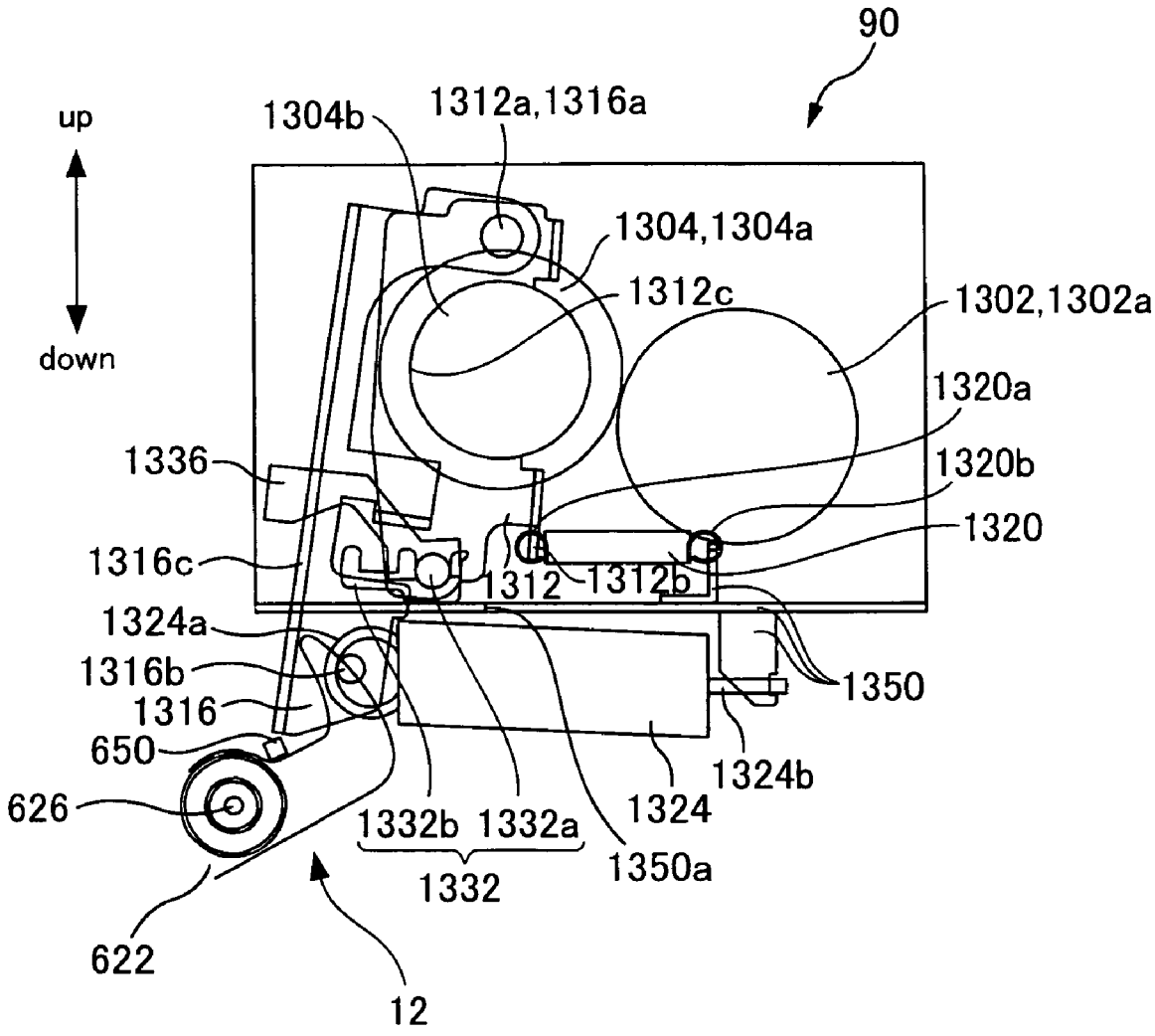
FIG. 25 is a diagram according to the second embodiment, and provides another example of a front view showing a state of the fixing unit 90 when the high-press-contact-force mode has been selected and the fourth side-surface cover 260 is opened.

More specifically, in the foregoing second embodiment, when the fourth side-surface cover 260 is opened in a state where both the first tension spring 1320 and the second tension spring 1324 have been selected by the rotating member 1332 and both the first tension spring 1320 and the second tension spring 1324 are urging the pressurizing roller 1304, the state in which both the first tension spring 1320 and the second tension spring 1324 urge the pressurizing roller 1304 was canceled in conjunction with the opening movement of the fourth side-surface cover 260, thereby completely releasing the press-contact of the pressurizing roller 1304 against the fixing roller 1302 (see FIG. 8). Instead, it is possible to reduce the intensity of the press-contact force (without releasing the press-contact) by canceling only the state in which the second tension spring 1324 urges the pressurizing roller 1304 when the fourth side-surface cover 260 is opened in the above-described state (that is, the state in which the first tension spring 1320 urges the pressurizing roller 1304 is maintained) (see FIG. 25). A configuration achieving such a function can easily be realized as shown in FIG. 25, that is, by omitting the abutment section 1316*d* and the abutted section 1312*d* from the fixing unit 90 shown in FIG. 22 for example.

A fixing unit 90 having such a function has an advantage in that, because the intensity of the press-contact force is reduced when the fourth side-surface cover 260 is opened, it is possible to allow easy troubleshooting when the fixing unit 90 gets jammed up. Moreover, such a fixing unit 90 has a further advantage in that, because the press-contact is not completely released when the fourth side-surface cover 260 is opened, it is, possible to suitably prevent an inconvenience that the user's hands become dirty with unfixed developer when the user performs troubleshooting.

Configuration of Image Forming System Etc.

Next, an embodiment of an image forming system, which serve as an example of an embodiment of the present invention, is described with reference to the drawings.

Figure 26:
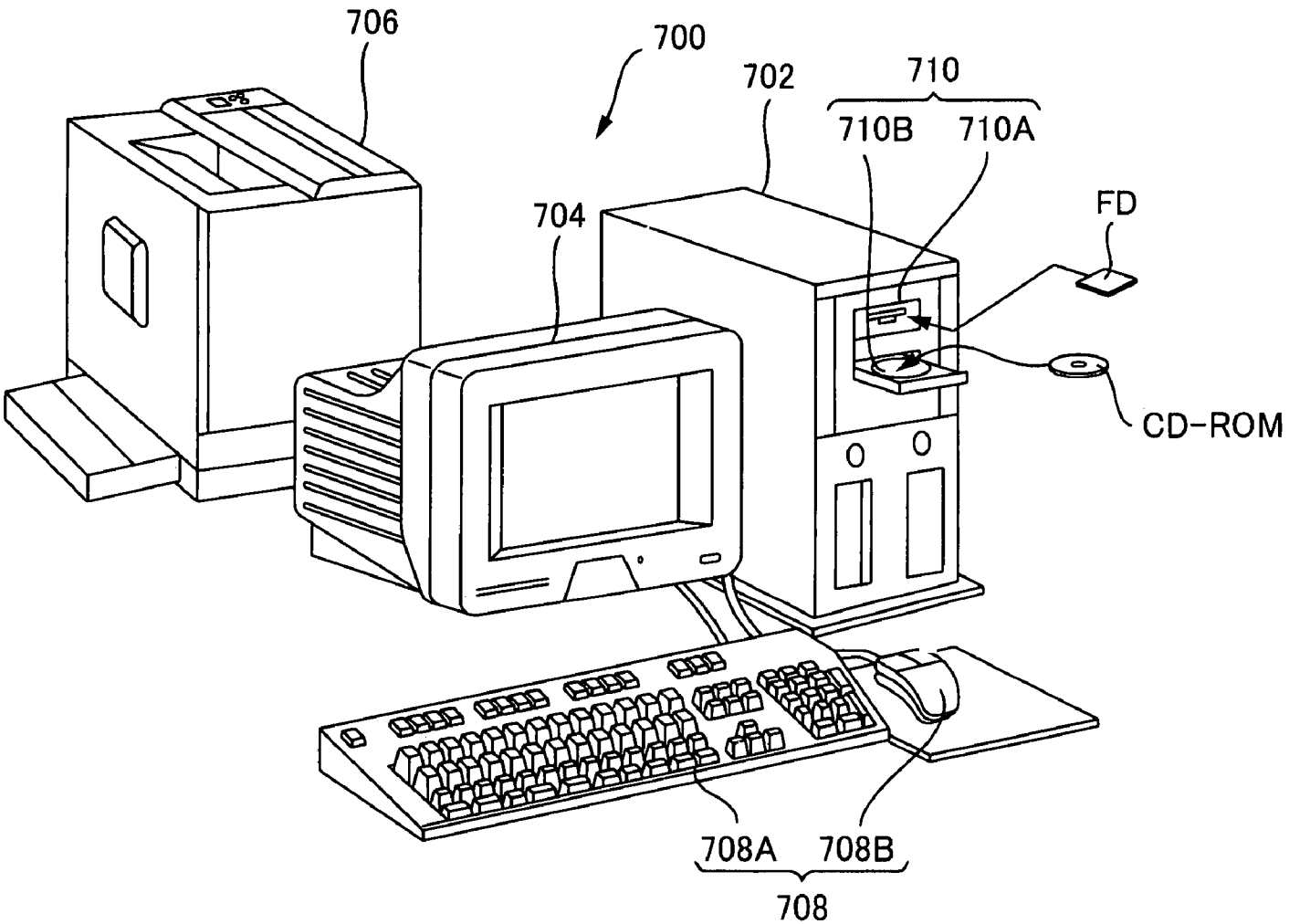
FIG. 26 is an explanatory drawing showing an external structure of an image forming system.

FIG. 26 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 27:
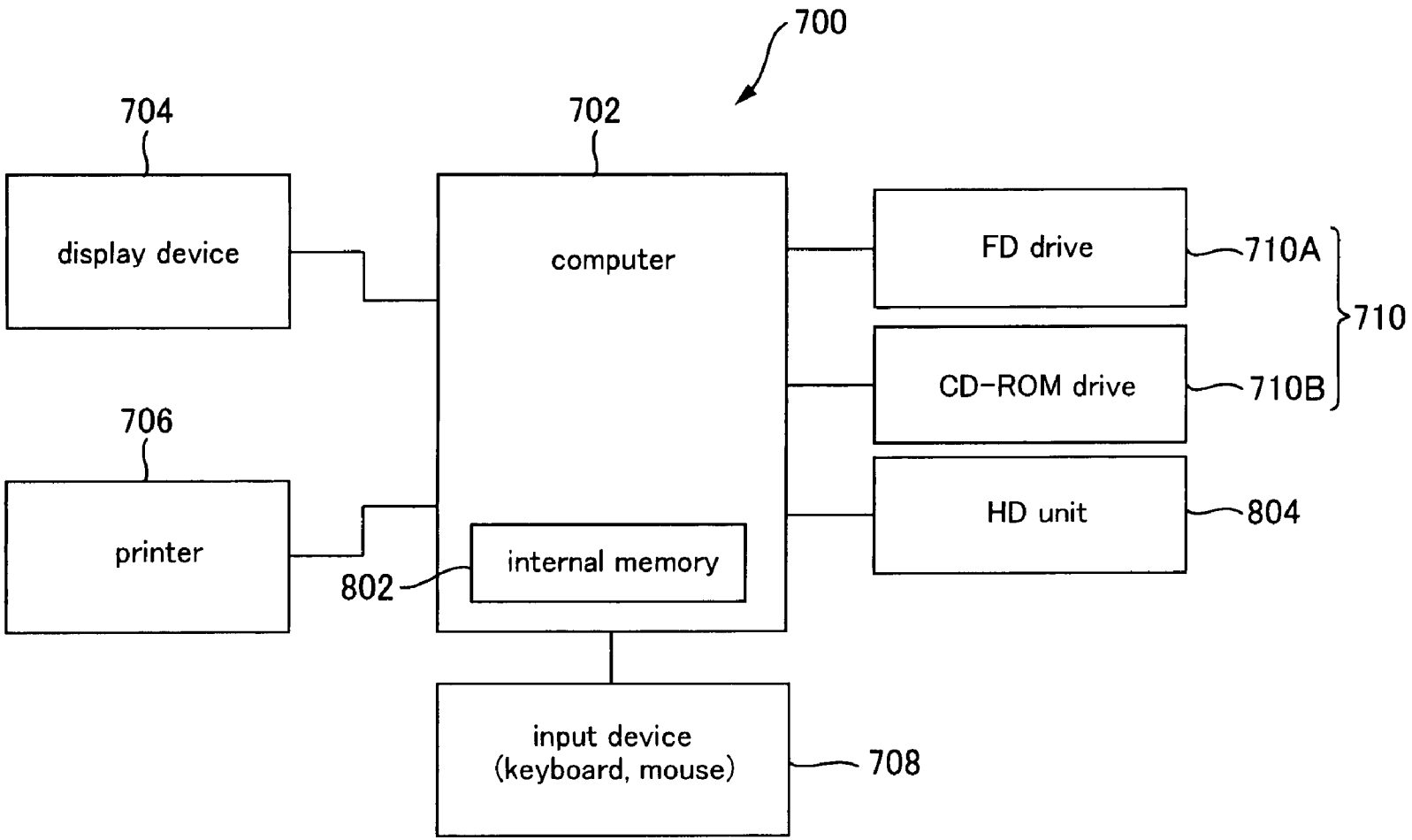
FIG. 27 is a block diagram showing a configuration of the image forming system shown in FIG. 26.

FIG. 27 is a block diagram showing a configuration of the image forming system shown in FIG. 26. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to be provided with one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A fixing unit adapted to fix a developer image formed on a medium onto that medium, comprising:

a first roller;

a second roller that can be pressed in contact against the first roller and that is pressed in contact against the first roller when the developer image formed on the medium is being fixed onto that medium;

a plurality of urging members that can urge the second roller in order to press the second roller in contact against the first roller; and a changing section adapted to change an intensity of a press-contact force of the second roller against the first roller, by selecting at least one urging member for urging the second roller from among the plurality of urging members.

2. A fixing unit according to claim 1, wherein the plurality of urging members are a first spring and a second spring whose spring constants differ from one another; and wherein the changing section changes the intensity of the press-contact force by selecting at least one spring for urging the second roller from among the first spring and the second spring.

3. A fixing unit according to claim 2, wherein the changing section changes the intensity of the press-contact force in two stages, by selecting either both the first spring and the second spring or only the first spring as the spring for urging the second roller.

4. A fixing unit according to claim 3, wherein the spring constant of the first spring is smaller than the spring constant of the second spring.

5. A fixing unit according to claim 4, further comprising a first pressing member that is connected to the first spring and that is adapted to press the second roller toward the first roller, and a second pressing member that is connected to the second spring and that is adapted to press the second roller toward the first roller via the first pressing member;

wherein the changing section is a rotating member that is provided to the first pressing member and that can come into contact with the second pressing member by rotating;

wherein, when the rotating member is rotated and is in contact with the second pressing member, a pressing force of the second pressing member is transmitted to the second roller via the first pressing member and both the first spring and the second spring urge the second roller via the first pressing member and the second pressing member; and wherein, when the rotating member is not in contact with the second pressing member, the pressing force of the second pressing member is not transmitted to the first pressing member and only the first spring urges the second roller via the first pressing member.

6. A fixing unit according to claim 5, wherein the first pressing member is a lever that can rotate about a rotation shaft, and the second pressing member is also a lever that can rotate about a rotation shaft; and wherein a distance from the rotation shaft of the second pressing member to a connecting section of the second pressing member at which the second pressing member is connected to the second spring is longer than a distance from the rotation shaft of the first pressing member to a connecting section of the first pressing member at which the first pressing member is connected to the first spring.

7. A fixing unit according to claim 1, further comprising an operating section operated for changing the intensity of the press-contact force.

8. A fixing unit adapted to fix a developer image formed on a medium onto that medium, comprising:

a first roller;

a second roller that can be pressed in contact against the first roller and that is pressed in contact against the first roller when the developer image formed on the medium is being fixed onto that medium;

a plurality of urging members that can urge the second roller in order to press the second roller in contact against the first roller; and a changing section adapted to change an intensity of a press-contact force of the second roller against the first roller, by selecting at least one urging member for urging the second roller from among the plurality of urging members;

wherein the plurality of urging members are a first spring and a second spring whose spring constants differ from one another;

wherein the changing section changes the intensity of the press-contact force by selecting at least one spring for urging the second roller from among the first spring and the second spring;

wherein the changing section changes the intensity of the press-contact force in two stages, by selecting either both the first spring and the second spring or only the first spring as the spring for urging the second roller;

wherein the spring constant of the first spring is smaller than the spring constant of the second spring;

wherein the fixing unit further comprises a first pressing member that is connected to the first spring and that is adapted to press the second roller toward the first roller, and a second pressing member that is connected to the second spring and that is adapted to press the second roller toward the first roller via the first pressing member;

wherein the changing section is a rotating member that is provided to the first pressing member and that can come into contact with the second pressing member by rotating;

wherein, when the rotating member is rotated and is in contact with the second pressing member, a pressing force of the second pressing member is transmitted to the second roller via the first pressing member and both the first spring and the second spring urge the second roller via the first pressing member and the second pressing member;

wherein, when the rotating member is not in contact with the second pressing member, the pressing force of the second pressing member is not transmitted to the first pressing member and only the first spring urges the second roller via the first pressing member;

wherein the first pressing member is a lever that can rotate about a rotation shaft, and the second pressing member is also a lever that can rotate about a rotation shaft;

wherein a distance from the rotation shaft of the second pressing member to a connecting section of the second pressing member at which the second pressing member is connected to the second spring is longer than a distance from the rotation shaft of the first pressing member to a connecting section of the first pressing member at which the first pressing member is connected to the first spring; and wherein the fixing unit further comprises an operating section operated for changing the intensity of the press-contact force.

9. An image forming apparatus comprising:

a fixing unit including a first roller and a second roller that can be pressed in contact against the first roller, the fixing unit being adapted to fix a developer image formed on a medium onto that medium in a state where the second roller is pressed in contact against the first roller via the medium, the fixing unit further including a plurality of urging members that can urge the second roller in order to press the second roller in contact against the first roller, and a changing section adapted to change an intensity of a press-contact force of the second roller against the first roller, by selecting at least one urging member for urging the second roller from among the plurality of urging members.

10. An image forming apparatus according to claim 9, further comprising an openable and closable cover;

wherein the fixing unit fixes the developer image formed on the medium onto that medium in a state where the cover is closed and the second roller is pressed in contact against the first roller via the medium;

wherein the plurality of urging members are a first spring and a second spring whose spring constants differ from one another;

wherein the changing section can change the intensity of the press-contact force in two stages, by selecting either both the first spring and the second spring or only the first spring as the spring for urging the second roller; and wherein the image forming apparatus further comprises a press-contact-force changing member adapted to reduce the intensity of the press-contact force in a state where both the first spring and the second spring have been selected by the changing section and both the first spring and the second spring are urging the second roller, by canceling a state in which the second spring is urging the second roller in conjunction with an opening movement of the cover.

11. An image forming system comprising:

a computer; and an image forming apparatus that is connectable to the computer and that includes:

a fixing unit including a first roller and a second roller that can be pressed in contact against the first roller, the fixing unit being adapted to fix a developer image formed on a medium onto that medium in a state where the second roller is pressed in contact against the first roller via the medium, the fixing unit further including a plurality of urging members that can urge the second roller in order to press the second roller in contact against the first roller, and a changing section adapted to change an intensity of a press-contact force of the second roller against the first roller, by selecting at least one urging member for urging the second roller from among the plurality of urging members.

* * * * *